US010829256B2

(12) United States Patent
Amano et al.

(10) Patent No.: US 10,829,256 B2
(45) Date of Patent: Nov. 10, 2020

(54) DRUG PORTION PACKAGING DEVICE

(71) Applicant: YUYAMA MFG. CO., LTD., Osaka (JP)

(72) Inventors: Hirokazu Amano, Osaka (JP); Koji Ito, Osaka (JP); Takayuki Fujikawa, Osaka (JP); Yasuyuki Yoshikawa, Osaka (JP)

(73) Assignee: YUYAMA MFG. CO., LTD., Osaka (JP)

( * ) Notice: Subject to any disclaimer, the term of this patent is extended or adjusted under 35 U.S.C. 154(b) by 418 days.

(21) Appl. No.: 15/560,545

(22) PCT Filed: Mar. 17, 2016

(86) PCT No.: PCT/JP2016/058539
§ 371 (c)(1),
(2) Date: Mar. 22, 2018

(87) PCT Pub. No.: WO2016/152731
PCT Pub. Date: Sep. 29, 2016

(65) Prior Publication Data

US 2018/0194505 A1 Jul. 12, 2018

(30) Foreign Application Priority Data

Mar. 23, 2015 (JP) ..... 2015-059078
Sep. 10, 2015 (JP) ..... 2015-178361

(51) Int. Cl.
*B65B 61/26* (2006.01)
*B65D 83/04* (2006.01)
(Continued)

(52) U.S. Cl.
CPC ..... *B65B 61/26* (2013.01); *B41J 15/04* (2013.01); *B65B 1/30* (2013.01); *B65B 1/46* (2013.01);
(Continued)

(58) Field of Classification Search
CPC ..... B65B 61/26; B65B 61/025; B65B 1/46; B65B 9/067; B65B 51/28; B65B 41/16;
(Continued)

(56) References Cited

U.S. PATENT DOCUMENTS 7,289,248 B2 * 10/2007 Yamazaki ..... B41J 2/04508 347/15
2014/0318078 A1 * 10/2014 Kondo ..... B65B 57/10 53/54

FOREIGN PATENT DOCUMENTS

JP S5758458 A 4/1982
JP H021148 U 1/1990
(Continued)

OTHER PUBLICATIONS

Written Opinion issued by the Japanese Patent Office acting as the International Searching Authority in relation to International Patent Application No. PCT/JP2016/058539 dated Apr. 12, 2016 (8 pages).
(Continued)

*Primary Examiner* — Justin Seo
(74) *Attorney, Agent, or Firm* — Robert P. Michal, Esq.; Carter, DeLuca & Farrell LLP

(57) ABSTRACT

The present invention has an object to provide a drug packaging device including a printing unit configured to perform printing by jetting ink and being capable of performing the printing on a packaging paper with high printing quality without including a support base or the like for the packaging paper. A drug packaging device (10) includes a drug supply unit (20), a packaging unit (30), a packaging paper conveying unit (40), and a printing unit (60). The printing unit (60) includes an ink ejection unit (62) capable of ejecting ink downward. A conveyance path (T) of the packaging paper conveying unit (40) includes: an intersecting-direction conveyance section (T1) for conveying a packaging paper (S) in a direction intersecting an ejection
(Continued)

direction of the ink; and a first conveyance direction switching section (46) and a second conveyance direction switching section (48) for changing the conveyance direction of the packaging paper (S) on upstream and downstream, respectively, of the intersecting-direction conveyance section (T1) in a conveyance direction of the packaging paper (S). The ink ejection unit (62) is arranged at a position spaced apart upward from the intersecting-direction conveyance section (T1) by a predetermined distance.

22 Claims, 31 Drawing Sheets

(51) Int. Cl.

| | |
|---|---|
| ***B65B 61/02*** | (2006.01) |
| ***B65B 1/46*** | (2006.01) |
| ***B65B 9/067*** | (2012.01) |
| ***B65B 51/28*** | (2006.01) |
| ***B65B 41/16*** | (2006.01) |
| ***B65B 57/08*** | (2006.01) |
| ***B65B 57/16*** | (2006.01) |
| ***B65B 1/30*** | (2006.01) |
| ***B41J 15/04*** | (2006.01) |
| ***B65B 5/10*** | (2006.01) |
| ***B65C 9/00*** | (2006.01) |
| *A61J 1/03* | (2006.01) |
| *B65C 9/30* | (2006.01) |

(52) U.S. Cl.
CPC ..... *B65B 5/103* (2013.01); *B65B 9/067* (2013.01); *B65B 41/16* (2013.01); *B65B 51/28* (2013.01); *B65B 57/08* (2013.01); *B65B 57/16* (2013.01); *B65B 61/025* (2013.01); *B65C 9/0015* (2013.01); *B65D 83/04* (2013.01); *A61J 1/03* (2013.01); *A61J 2205/10* (2013.01); *A61J 2205/30* (2013.01); *B65B 2220/14* (2013.01); *B65B 2220/22* (2013.01); *B65C 9/30* (2013.01)

(58) Field of Classification Search
CPC ..... B65B 57/08; B65B 57/16; B65B 5/103; B65B 1/30; B65B 2220/22; B65B 2220/14; B65D 83/04; B41J 15/04; B65C 9/0015; B65C 9/30; A61J 1/03; A61J 2205/10; A61J 2205/30
See application file for complete search history.

(56) References Cited

FOREIGN PATENT DOCUMENTS

| | | | |
|---|---|---|---|
| JP | H05-270100 | A | 10/1993 |
| JP | 2909450 | B2 | 6/1999 |
| JP | 3120545 | B2 | 12/2000 |
| JP | 2001-047699 | A | 2/2001 |
| JP | 2001130522 | A | 5/2001 |
| JP | 2002-529176 | A | 9/2002 |
| JP | 2003-103853 | A | 4/2003 |
| JP | 2003-237702 | A | 8/2003 |
| JP | 2005080838 | A | 3/2005 |
| JP | 2005-343699 | A | 12/2005 |
| JP | 2006-154146 | A | 6/2006 |
| JP | 2006-321516 | A | 11/2006 |
| JP | 2009-050672 | A | 3/2009 |
| JP | 2009-255082 | A | 11/2009 |
| JP | 2010-184482 | A | 8/2010 |
| JP | 2014-054819 | A | 3/2014 |
| JP | 2014230744 | A | 12/2014 |
| WO | WO-2011/052766 | A1 | 5/2011 |

OTHER PUBLICATIONS

International Search Report issued by the Japanese Patent Office acting as the International Searching Authority in relation to International Patent Application No. PCT/JP2016/058539 dated Apr. 12, 2016 (3 pages) along with English language translation (3 pages).
Notice of Reasons for Refusal dated Jun. 9, 2020, issued in JP Application No. 2017-508297, (including English tanslation, 18 pages).
Office Action dated Aug. 20, 2020 issued by the Japanese Patent Office (JPO) in Japanese Patent Application. No. 2019042219, 3 pages, along with English language translation, 3 pages.

* cited by examiner 140
142
144
146
患者マスタメンテナンス（新規）
患者ID:
患者名:
患者カナ:
基本
連絡
生年月日:
最終測定日: 2014/10/10
性別: 男性
対象有無: 対象外
色弱: 有
色覚の字色:
家族用画像1
家族用画像2
患者コメント:

DRUG PORTION PACKAGING DEVICE

CROSS-REFERENCE TO RELATED APPLICATIONS

This application is a National Phase Entry under 35 USC § 371 of PCT Patent Application Serial No. PCT/JP2016/058539 filed Mar. 17, 2016, which claims priority to Japanese Patent Application No. 2015-059078, filed Mar. 23, 2015, and claims priority to Japanese Patent Application No. 2015-178361, filed Sep. 10, 2015, the disclosure of each of these applications is expressly incorporated herein by reference in their entirety.

TECHNICAL FIELD

The present invention relates to a drug packaging device capable of performing printing on a packaging paper to be used for packaging a drug.

BACKGROUND ART

Hitherto, as disclosed in Patent Literature 1, there has been provided a drug packaging device capable of performing printing on a packaging paper. In most of drug packaging devices of this kind, a so-called thermal transfer printer using an ink ribbon is used as a printing unit, and printing is performed by bringing a head for printing into direct contact with a packaging paper. In addition, according to the related art, printing is performed on a packaging paper in a single color, for example, black.

For example, when the above-mentioned thermal transfer printer using the ink ribbon is employed, it is necessary to provide as many ink ribbons as colors to be used for printing. In a case of using ink ribbons of four colors, the printing can be performed in a given color among the respective colors only at a position provided with the ink ribbon of the given color. Therefore, a free layout of print items or free arrangement of print colors is not allowed on the packaging paper, which imposes a limitation on a printing method for issuing a caution to a patient or the like and transmitting information including a date/time of administration and a name of a drug.

CITATION LIST

Patent Literature

[PTL 1] JP 2005-342527 A

SUMMARY OF INVENTION

Technical Problem

After an extensive review, the inventors of the present invention have reached findings that multi-color printing and a free layout of print items may be easily achieved by employing, as a printing unit, so-called an ink-jet printer for performing printing by jetting ink. Meanwhile, when the ink-jet printer is employed as the printing unit, a packaging paper is arranged at a position spaced apart from a unit ink ejection unit configured to eject the ink, which forms the head, unlike when the above-mentioned thermal transfer printer is employed. Therefore, in order to achieve high printing quality, it is necessary to provide a support base or other such member for holding the packaging paper substantially straight at a position spaced, apart from the ink ejection unit by a predetermined distance.

However, in a situation in which downsizing is demanded for the entire device, it is difficult to sufficiently secure space enough to provide a support base or the like for supporting the packaging paper due to a complicated internal structure of a drug packaging device. In addition, the ink-jet printer is configured to eject ink, and hence the printing unit cannot be arranged so as to jet ink in a substantially horizontal direction. Therefore, when the printing unit of such a type as to perform printing by jetting ink is provided, an installation posture of the printing unit is restricted as well.

Therefore, the present invention has an object to provide a drug packaging device including a printing unit configured to perform, printing by jetting ink and being capable of performing the printing on a packaging paper with high printing quality without including a support base or the like for the packaging paper.

Solution to Problem

In order to solve the above-mentioned problems, according to one embodiment of the present invention, there is provided a drug packaging device including: a drug supply unit capable of supplying a drug on prescription; a packaging unit configured to package the drug supplied from the drug supply unit; a packaging paper conveying unit configured to convey a packaging paper toward the packaging unit along a predetermined conveyance path while exerting a predetermined tensile force on the packaging paper; and a printing unit capable of printing predetermined information on the packaging paper, in which: the printing unit includes an ink ejection unit capable of ejecting ink; the conveyance path includes: an intersecting-direction conveyance section for conveying the packaging paper in a direction intersecting an ejection direction of the ink; a first conveyance direction switching section for changing a conveyance direction of the packaging paper on upstream of the intersecting-direction conveyance section in the conveyance direction of the packaging paper; and a second conveyance direction switching section for changing the conveyance direction of the packaging paper on downstream of the intersecting-direction conveyance section in the conveyance direction of the packaging paper; and the ink ejection unit is arranged at a position spaced apart upward from the intersecting-direction conveyance section by a predetermined distance.

In the drug packaging device according to the one embodiment of the present invention, the intersecting-direction conveyance section for conveying the packaging paper exists in the direction intersecting the ejection direction of the ink midway through the conveyance path of the packaging paper used by the packaging paper conveying unit, and the ink ejection unit is provided above the intersecting-direction conveyance section. In addition, the conveyance path of the packaging paper is formed so that the conveyance direction of the packaging paper is changed at the first conveyance direction switching section located on upstream of the intersecting-direction conveyance section and at the second conveyance direction switching section located on downstream of the intersecting-direction conveyance section. Therefore, the first conveyance direction switching section and the second conveyance direction switching section each function as a fulcrum for supporting the packaging paper, and the intersecting-direction conveyance section located between the both has a state in which a fixed tensile force is exerted on the packaging paper, which eliminates the need to provide a support base or the like. Therefore, with the drug packaging device according to the one embodiment of the present invention, it is possible to perform printing on a packaging paper with high printing quality while simplifying a device configuration.

The drug packaging device according to the one embodiment of the present invention desirably further includes an urging unit configured to urge the packaging paper so as to cause a tensile force to exert on the packaging paper in the intersecting-direction conveyance section.

According to the above-mentioned configuration, a tensile force is more positively exerted on the packaging paper in the intersecting-direction conveyance section, and it is possible to perform printing by ejecting the ink onto the packaging paper in a stretched state. In addition, the packaging paper is formed substantially horizontally between the first conveyance direction switching section and the second conveyance direction switching section, which allows the ink to be ejected downward from the ink ejection unit located above the packaging paper. Therefore, stable deposition of ink with respect to the packaging paper is achieved. With this configuration; it is possible to further improve the printing quality with respect to the packaging paper.

In the drug packaging device according to the one embodiment of the present invention, the urging unit is desirably located on upstream of the first conveyance direction switching section in the conveyance direction.

With the above-mentioned configuration, an appropriate tensile force can be exerted on the packaging paper in order to bring the packaging paper to a stretched state without being bent.

The drug packaging device according to the one embodiment of the present invention preferably further includes a conveying roller to be brought into abutment against the packaging paper in the packaging paper conveying path, and the conveying roller is preferably arranged so as to have an axial direction extending along a direction intersecting the conveyance direction of the packaging paper, and is preferably formed to have an outer diameter of an intermediate portion in the axial direction which is smaller than an outer diameter of both end portions.

According to the above-mentioned configuration, the conveying roller is brought into contact with the packaging paper in both the end portions in the direction (width direction) intersecting the conveyance direction of the packaging paper, and it is possible to inhibit the conveying roller and the packaging paper from being brought into contact, with each other in the intermediate portion in the width direction. Therefore, when the conveying roller located on downstream of the intersecting-direction conveyance section is configured as described above, it can be expected to produce an effect of inhibiting deterioration in quality, for example, spreading or smudging of ink, from being caused due to contact between, the printing performed at a position corresponding to the intermediate portion in the width direction and the conveying roller and an effect of promoting the drying of the ink ejected onto the packaging paper. In addition, when the conveying roller located on upstream of the intersecting-direction conveyance section is configured as described above, it is possible to inhibit a wrinkle or the like, which, causes the deterioration in printing quality, from being formed in a printing area of the intermediate portion in the width direction, due to contact, with the conveying roller. Therefore, with the conveying roller having the above-mentioned configuration, it is possible to further improve the printing quality with respect to the packaging paper.

In the drug packaging device according to the one embodiment of the present invention, the ink ejection unit may include a linear nozzle array formed of a plurality of nozzles arranged in a direction intersecting the conveyance direction of the packaging paper used by the packaging paper conveying unit.

According to the above-mentioned configuration, it is possible to further speed up the printing for the packaging paper.

The drug packaging device according to the one embodiment of the present invention may further include: a prescription information input unit configured to receive input of prescription information; a drug image database obtained by accumulating an image of a drug; and a printing control unit configured to control the printing unit, and the printing control unit may be configured to: select from the drug image database an image of a drug to be packaged based on the prescription information; and control the printing unit so as to print the selected image of the drug on the packaging paper.

In the drug packaging device according to the one embodiment of the present invention, the image of a drug to be packaged into a packaging paper based on prescription information is printed on the packaging paper, and hence it is possible to confirm whether or not the drug has been packaged correctly in comparison between the printed, image of the drug and the drug packaged in the packaging paper in actuality. Therefore, with the drug packaging device according to the one embodiment of the present invention, the information printed on a packaging bag can be effectively used for the inspection based on visual observation.

The drug packaging device according to the one embodiment of the present invention may further include: a prescription information input unit configured to receive input of prescription information; a color vision information input unit configured to receive input of color vision information relating to whether or not a patient has color vision deficiency; and a printing control unit configured to control the printing unit, and the printing control unit may be configured to: determine whether or not a drug to be packaged is prescribed for a patient having color vision deficiency based on the color vision information; and control the printing unit so as to perform printing on the packaging paper in a color other than a color that is difficult for the patient to identify when the drug to be packaged is prescribed for the patient having color vision deficiency.

According to the above-mentioned configuration, even a patient having color vision deficiency can easily and correctly identify the information printed on the packaging paper.

In regard to the patient having color vision deficiency, an identifiable color differs depending on the individual. Therefore, the prescription for the patient having color vision deficiency may be printed in an identifiable color for each patient, but control required for the printing is complicated in this case. Therefore, the prescription for the patient having color vision deficiency may be printed uniformly in black and white or in gray scale. With this configuration, even the patient having color vision deficiency can grasp printed contents, and it is possible to simplify the control and the configuration required for the printing.

As the print items to be printed on a packaging paper S, not only the above-mentioned drug image but also a wide variety of information including a name of a patient and a date/time of administration can be printed based on prescription data. Those pieces of information are desired to be managed in linkage with databases used at a hospital, a pharmacy, or other such medical institution. Specifically, it is possible to record and use various databases including a patient master for registering patient information, a ward master for registering ward information, a user master for registering information relating to a doctor, a pharmacist, or other such user of the drug packaging device, a facility master for registering facility information, a facility-with-time-of-administration master, and a facility resident master, which are used at a medical institution, a facility, or the like.

When a drug prescribed for a plurality of patients across a plurality of ward floors is packaged, a nurse or a pharmacist sorts the packaging bags by the ward floor after the drug is packaged. When the printing is performed on the packaging bag based, on a print color designated in advance for each ward floor, the nurse, the pharmacist, or the like can sort the packaging bags by the ward floor based on the print color, which improves usability.

The drug packaging device according to the one embodiment of the present invention, which is provided based on such findings, further includes: a prescription information input unit configured to receive input of prescription information; a ward information database obtained by accumulating ward information relating to award in a medical institution; and sprinting control unit configured to control the printing unit, and the printing control unit is configured to: identify the ward information relating to a patient for which a drug to be packaged has been prescribed based on the prescription information; and control the printing unit so as to cause print information to be printed in a ward information specific color, which is set in advance for each piece of ward information.

When the above-mentioned configuration is employed, it is easy for the pharmacist or the like to sort the packaging bags by the ward floor, and it is expected to reduce erroneous sorting and erroneous administration.

The drug packaging device according to the one embodiment of the present invention further includes: a prescription information input unit configured to receive input of prescription information; a facility information database obtained by accumulating facility information relating to a facility; and a printing control unit configured to control the printing unit, and the printing control unit is configured to: identify the facility information relating to a patient for which a drug to be packaged has been prescribed based on the prescription information; and control the printing unit so as to cause print information to be printed in a facility information specific color, which is set in advance for each piece of facility information.

According to the above-mentioned configuration, the printing can be performed on the packaging paper in the facility information specific color set for each facility. With this configuration, it is possible to perform such an operation as to sort the packaging bags based on the color of the printing performed on the packaging paper, which can suppress erroneous administration to a minimum.

The drug packaging device according to the one embodiment of the present invention further includes: a patient information database obtained by accumulating patient information relating to a patient; a facility information database obtained by accumulating facility information relating to a facility; a facility resident information database obtained by accumulating information relating to a facility resident; and a printing control unit configured to control the printing unit. Further, the patient information, the facility resident information, and the facility information are associated with one another, and the patient information relating to a patient for which a drug to be packaged has been prescribed or the facility resident information relating to the facility resident is identified based on the prescription information, the facility information associated with the patient information or the facility resident information that has been identified is identified, and the printing unit is controlled so as to cause print information to be printed in a facility information specific color, which is set in advance for each piece of facility information.

According to the above-mentioned configuration, when a drug is to be packaged for a plurality of patients or a plurality of facility residents, it is possible to eliminate time and labor for selecting and setting the print color assigned to each facility. That is, when the facility resident or the patient information for which the drug has been prescribed is selected from the facility resident information database or the patient information database described above, the facility information specific color assigned to the facility in charge of the patient or the facility resident is identified, and printing control is performed so as to perform the printing in this color. As a result, there is no need to individually set the print color by examining to which facility the patient or the facility resident belongs each time the packaging is performed, which can suppress a human error made at the print color setting.

The drug packaging device according to the one embodiment of the present invention is configured to enable selection of whether to print a print item in a color image or a monochrome image.

With the above-mentioned configuration, a printing method for the print items can be selected appropriately in response to a demand from the user, which improves usability.

The drug packaging device according to the one embodiment of the present invention further includes a printing control unit configured to control the printing unit, and the drug packaging device is capable of carrying out, under control of the printing control unit, outline printing for performing printing on the packaging paper so that a printing density of an area surrounded by a contour line is lower than a printing density of the contour line.

When the above-mentioned configuration is employed, the outline printing is carried, out, to thereby be able to suppress exhaustion of ink and save an ink usage amount.

The drug packaging device according to the one embodiment of the present invention is capable of: depriving a decrease tendency index indicating a decrease tendency of the ink based on a relationship between a remaining amount of the ink prepared in the printing unit and a quantity of packages; and deriving a number of packages allowed to be subjected to printing with the remaining ink based on the decrease tendency index on condition that the remaining amount of the ink has been reduced to a predetermined amount.

According to the above-mentioned configuration, through use of the phenomenon tendency index derived from the relationship between a quantity of packages subjected to the packaging in actuality and a decrease amount of the ink, it is possible to predict the number of packages that can be subjected to the printing with the remaining ink at a time point when the remaining amount of the ink has decreased to a fixed value.

The drug packaging device according to the one embodiment of the present invention is configured to execute a maintenance operation for performing maintenance on the printing unit between printing performed on a last package formed last in preceding packaging processing and printing performed on a first package formed first in succeeding packaging processing.

With the above-mentioned, configuration, it is possible to efficiently execute the packaging operation while avoiding interrupting the packaging operation for the maintenance operation.

The drug packaging device according to the one embodiment of the present invention is capable of carrying out a drying suppression operation for suppressing drying of the ink ejection unit after printing is performed on the packaging paper until the printing is performed next.

According to the above-mentioned configuration, it is possible to prevent the ink ejection unit from drying during an interim of the printing on the packaging paper. With this configuration, it is possible to suppress an occurrence of a printing failure, which is involved in insufficient ejection of the ink, to a minimum.

Most drug packaging devices are provided with a roll setting unit capable of setting a body (paper roll) obtained by winding the packaging paper to have a roll shape, and can supply the packaging paper while unwinding the packaging paper. The roll setting unit is provided with a braking unit formed of a motor or the like, and can adjust a braking force (paper roll resistance) exerted on the paper roll by operating the braking unit to control a supply state of the packaging paper.

In order to maintain high packaging quality and high printing quality in the drug packaging device having the above-mentioned configuration, it is desired, to be able to hold the packaging paper with an appropriate tensile force being exerted thereon under a state in which the packaging paper has been stopped in order to perform the printing. Specifically, when an excessively large tensile force is exerted on the packaging paper, there is a fear that a problem may occur in the packaging quality, for example, wrinkles (darts) occur in the packaging paper or the package is shrunk in size. Meanwhile, when the tensile force exerted on the packaging paper is insufficient, there is a fear that in addition to the problem of the printing failure, a problem may occur in that precision in forming the packaging paper into a bag shape to obtain a packaging bag deteriorates, resulting in lowered packaging quality.

In order to handle such a problem, it is desired to stop the rotation of the paper roll at a timing to stop the sheet feeding of the packaging paper without a time lag. That is, when a time lag occurs before the braking force (paper roll resistance) is exerted at a level required for stopping rotating the paper roll, the paper roll rotates under inertia during that time lag, which causes an occurrence of slack in the packaging paper. However, in the related art, the applied voltage to be exerted on the braking unit of the roll setting unit is controlled by a PWM method, which inhibits the applied voltage from being changed steeply. Therefore, in the related art, it is difficult to inhibit the paper roll from rotating under inertia.

As a result of an extensive review based on such findings, the inventors of the present invention have reached findings that, when the above-mentioned paper roll resistance is controlled by an analog output method, the braking force exerted on the paper roll can be controlled in real time with almost no time lag by switching on and off with an analog signal.

The drug packaging device according to the one embodiment of the present invention, which is provided based on such findings, further includes: a roll setting unit configured to set a paper roll obtained by winding the packaging paper to have a roll shape so as to be capable of unwinding the packaging paper; a braking unit configured to exert a braking force on the paper roll; and a braking control unit capable of controlling power applied to the braking unit in an analog manner.

According to the above-mentioned configuration, a time lag required until a sufficient braking force (paper roll resistance) is exerted on the paper roll set in the roll setting unit, can be suppressed to a minimum. With this configuration, it is possible to inhibit the paper roll from rotating under inertia to feed an excess amount of the packaging paper when the sheet feeding of the packaging paper is stopped, and to avoid the printing failure caused due to slack exhibited by the packaging paper. It is also possible to lower the paper roll resistance to convey the packaging paper with a relatively weak tensile force during a sheet feeding operation, and to inhibit a wrinkle or misalignment of edges from occurring when the packaging paper is sealed. With those configurations, satisfactory quality can be achieved in both of the packaging quality and the printing quality.

In the drug packaging device according to the one embodiment of the present invention, the roll setting unit is desirably arranged on upstream of the printing unit in the conveyance direction of the packaging paper, the packaging unit is desirably arranged on downstream of the printing unit in the conveyance direction of the packaging paper, and the drug packaging device is desirably configured to: operate a drive unit provided in the packaging unit, to thereby be able to exert a conveyance force toward the conveyance direction on the packaging paper; and operate the braking unit in linkage with driving and stopping of the drive unit.

According to the above-mentioned configuration, it is possible to control the paper roll resistance while suppressing a time lag with each of the operations for starting the sheet feeding of the packaging paper and stopping the sheet feeding. With this configuration, it is possible to exert a proper paper roll resistance without causing the packaging paper to exhibit slack during both of the stopping of the sheet feeding and the sheet feeding operation. Therefore, according to the one embodiment of the present invention, higher quality can be achieved in both of the packaging quality and the printing quality.

In the drug packaging device according to the one embodiment of the present invention; the packaging paper to be used is provided with a receiving layer for receiving the ink on a surface of a sheet material used as a base material.

According to the above-mentioned configuration, high quality can be achieved in deposition of ink, color development, and the like.

When a drug is packaged through use of the related-art drug packaging device, drugs to be administered simultaneously are sometimes divided into a plurality of continuous packaging bags (divided drug package) due to property of the drugs, an amount of the drugs corresponding to one package, or other such reason.

When the divided drug package is applied for a plurality of packages, for example, three packages, information indicating division numbers, for example, "1/3", "2/3", and "3/3", are sometimes printed, on those respective drug packages. However, there are a wide variety of pieces of information to be printed on the drug packages, and when such a character string is additionally printed, it is difficult to intuitively recognize that the drug packages relate to the divided drug package. In particular, it is more difficult for an elderly person to recognize such a character string, which is one of the factors that cause such a person to miss out those kinds of information and forget to take the drug.

The drug packaging device according to the one embodiment of the present invention, which is provided in order to handle such a problem, further includes a printing control unit configured to control the printing unit, and the drug packaging device is capable of: executing drug package dividing processing for packaging drugs to be administered simultaneously by dividing the drugs into a plurality of continuous packaging bags; and controlling the printing unit so as to print divided drug package identification information for identifying the plurality of packaging bags as relating to the drug package dividing processing on the plurality of packaging bags formed by the drug package dividing processing.

According to the above-mentioned configuration, the patient is allowed to intuitively recognize that the drug packages relate to the divided drug package, and it is expected to produce an effect of inhibiting the patient from forgetting to take the drug.

When the above-mentioned divided drug package identification information is printed on the respective drug packages relating to the divided, drug package in a chromatic color, it is expected to produce another effect in addition to the effect of causing the patient or the like to recognize that the drug packages relate to the divided drug package. Specifically, identification precision can be improved when it is necessary to identify the presence of the divided drug package identification information through image analysis, for example, when inspection as to whether or not the drug has been packaged on prescription is performed through use of an inspection device configured to automatically or semiautomatically perform the inspection based on an image obtained by photographing the packaging bag in which the drug is packaged.

To be described in more detail, when the divided drug package identification information provided to the packaging bag is printed in black or other such achromatic color, it is not possible to easily discriminate whether or not a part mixed into a part in black or other such achromatic color within the image obtained by the photographing for the image analysis in the above-mentioned inspection device or the like corresponds to the divided drug package identification information or corresponds to a shadow of the drug or a foreign matter. However, as described above, when the divided drug package identification information is printed on the plurality of packaging bags formed by drug package dividing processing in a chromatic color, it is possible to easily discriminate between the divided drug package identification information and another thing (the shadow of the drug, the foreign matter, or the like) in the inspection device. That is, by enabling the divided drug package identification information to be printed in a chromatic color, it is possible to discriminate between the divided drug package identification information and another thing in terms of three elements of lightness, saturation, and hue. With this configuration, improvement in inspection precision and inspection speed can be achieved.

In the drug packaging device according to the one embodiment of the present invention, the printing control unit may be capable of controlling the printing unit so as to print the divided drug package identification information in a chromatic color.

According to the above-mentioned configuration, it is possible to further improve the effect of causing the patient or the like to recognize that the drug packages relate to the divided drug package. The identification precision can also be improved when it is necessary to identify the presence of the divided drug package identification information through image analysis as in the above-mentioned inspection device.

In the drug packaging device according to the one embodiment of the present invention, the printing control unit is preferably capable of printing the divided drug package identification information in a different manner for each of a plurality of packaging bag groups on condition that the plurality of packaging bag groups each formed of the plurality of packaging bags formed by the drug package dividing processing are to be formed.

According to the above-mentioned configuration, it is possible to clearly distinguish between packaging bag groups, and to prevent a problem of, for example, erroneous administration of the drugs within the packaging bags that form different packaging groups.

In the above-mentioned drug packaging device according to the one embodiment of the present invention, the divided drug package identification information may be printed across the plurality of packaging bags formed by the drug package dividing processing.

According to the above-mentioned configuration, it is possible to more intuitively recognize that the drug packages relate to the divided drug package, and it is expected to improve the effect of inhibiting the patient from forgetting to take the drug.

In addition, the divided drug package identification information may be a line extending along the conveyance direction of the packaging paper.

According to the above-mentioned configuration, it is possible to more intuitively recognize the packaging bags subjected to the execution of the drug package dividing processing.

Assuming that a plurality of drugs are to be packaged through use of the drug packaging device, in particular, the drugs are powdered drugs, those drugs are sometimes packaged separately in a case where a combination of drugs that are feared, to cause a change in property (change of color, change in quality, reduction in efficacy, or the like; hereinafter also referred to as "incompatibility") when compounded in the same package is prescribed so as to be administered simultaneously. Specifically, for example, when an alkaline drug and an acid drug are prescribed as the drugs to be administered simultaneously, those drugs are sometimes packaged separately. Even in such a case, the drugs to be administered simultaneously are packaged into a plurality of packages, and the patient needs to manage the plurality of packaging bags, which also causes, for example, the patient to forget to take the drug.

In order to handle the above-mentioned problem, in the drug packaging device according to the one embodiment of the present invention, the drug package dividing processing is carried out on condition that drugs defined to cause a change in property when being contained, together in a single packaging bag have been prescribed as the drugs to be administered simultaneously, and it is possible to print the divided drug package identification information for identifying that the packaging bags relate to the drug package dividing processing, across the plurality of packaging bags formed by the drug package dividing processing.

According to the above-mentioned configuration, the patient is allowed to easily recognize a plurality of drug packages subjected to the drug package dividing processing for the reason of the incompatibility of the drugs as a series of drug packages to be administered simultaneously, and it is expected to produce the effect of inhibiting the patient from forgetting to take the drug.

In a case of using the ink-jet printer employed for the drug packaging device according to the one embodiment of the present invention, when a photograph or other such a real image of a drug is set as a subject to be printed on the packaging paper, information (identification code) printed or inscribed on the external appearance of the drug may be printed lightly to be hard to identify depending on printing density or image quality. When the drug is a capsule, there also exists such a drug as to have the identification code printed along a circumferential direction of the drug, which also causes a situation in which only a part of the identification code can be seen from only the photograph of the external appearance of the drug. Therefore, when the drug image printed on the packaging paper is used for inspection, it is expected to cause a problem in that the identification code is difficult to identify and to use for inspection.

The drug packaging device according to the one embodiment of the present invention, which is provided based on such findings, further includes: a prescription information, input unit configured to receive input of prescription information; and a drug image database obtained by accumulating an image of a drug. Further, the drug image database includes: a real image database obtained by accumulating a real image of a drug so that a color of the real image is distinguishable; and an outline image database obtained by accumulating an outline image including a contour line of a drug, and the drug packaging device is capable of: executing composite image forming processing for forming a composite image by selecting the real image and the outline image of a drug to be packaged from the real image database and the outline image database, and matching a color of one or a plurality of areas included in the selected outline image with a color of an area within the real image corresponding to the one or the plurality of areas; and printing the composite image formed by the composite image forming processing on the packaging paper.

According to the above-mentioned configuration, the printing can be performed by adding the appearance color of a drug close to the real color to the contour line of the drug. As a result, improvement is expected for the inspection of the drug package.

The outline image may include information relating to a printed character or an inscription provided to the drug.

According to the above-mentioned configuration, the entirety of characters and symbols of the identification code on the drug, which is difficult to identify with only the real image, can be printed, and the printing can be performed in a color close to the real color of the drug. As a result, innovative improvement is expected for the inspection of the drug package. In addition, the entire identification code provided on the surface of the drug can be printed, which contributes to the discrimination of the drugs having contours and colors that are extremely similar to each other.

The drug packaging device according to the one embodiment of the present invention achieves the printing on the packaging paper with a free layout by employing an ink-jet printer. Therefore, depending on the selection of the user, an illustration, an image, a solid image, and the like having a large size with respect to the printing area may be selected as the subject to be printed. When such a subject to be printed is printed on the packaging paper, a density and range of ink ejection with respect to the packaging paper is large, and the ink takes time to dry. When the packaging paper is sent to the subsequent stage under a state of poor drying in which the ink has not sufficiently dried, various failures may occur. Meanwhile, when the density of ink ejection on the packaging paper is lowered in order to prevent the packaging paper from being sent to the subsequent stage while the ink has not sufficiently dried, there is a fear that visibility may be lowered, depending on the printed contents.

In order to handle such a problem, it is possible to operate the drug packaging device while uniformly lowering the conveyance speed of the packaging paper, but efficiency of packaging of the drug is lowered. Therefore, in order to avoid the poor drying of ink depending on the printed contents, it is desired to control the conveyance speed of the packaging paper based on the printed contents.

The drug packaging device according to the one embodiment of the present invention, which is provided in order to handle such a problem, is configured to lower a conveyance speed of a packaging bag on condition that a number of pixels exceeds a predetermined threshold value at any one of lightness values that form a lightness value histogram of an image to be printed.

According to the above-mentioned configuration, it is possible to optimize the conveyance speed of the packaging paper depending on whether or not the image to be printed requires much time after the printing until the ink dries. With this configuration, efficient packaging can be achieved while suppressing a failure due to the poor drying of ink.

As the drug to be packaged, a drug belonging to various drug categories among drug categories defined by categorizing drugs based, on attributes is assumed. For example, a poisonous drug, a powerful drug, a narcotic drug, or other such drug belonging to drug categories that require a person involved in use a caution in handling and management, for example, a drug category that requires such storage as to be distinguished from another drug and a drug category that requires storage inside a locked repository, is assumed. In regard to the drug belonging to such drug categories, it is desired that the drug category can be recognized easily and intuitively even after the drug is packaged in the packaging bag.

The drug packaging device according to the one embodiment of the present, invention, which is provided in order to achieve the object described above, further includes: a drug database obtained, by accumulating information relating to a drug, the information including a drug category defined by categorizing a drug based on an attribute; a drug image database obtained by accumulating an image of a drug; and a printing control unit configured to control the printing unit, and the printing control unit is configured to control, on condition that a drug to be packaged belongs to a predetermined drug category, the printing unit so as to print an image accumulated for the drug to be packaged in the drug image database by surrounding the image by drug category identification information for enabling recognition of the predetermined drug category.

According to the above-mentioned configuration, it is possible to easily discriminate whether or not the drug belongs to a predetermined drug category even after the drug is packaged. In addition, drug category recognition information is printed so as to surround the image of the subject drug, to thereby be able to prevent, the drug category recognition, information from being confused with other pieces of character information and the like printed on the drug package or a test drug package. With this configuration, the subject drug and corresponding drug category identification information can be intuitively recognized, and a caution can be issued, to the pharmacist or the like who handles the drug. As a result, it is expected that the handling and the management may be appropriately performed depending on the drug category.

The drug packaging device is desirably capable of printing the drug category identification information in a print color set in advance for each drug category.

According to the above-mentioned configuration, the type of the drug category can be identified in addition to the identification that the drug belongs to the predetermined drug category.

Further, the drug packaging device according to the one embodiment of the present invention is capable of printing the drug category identification information in a printing area that surrounds the image, the printing area may be formed of a plurality of printing segments in a circumferential direction, and allow different kinds of drug category identification information to be printed in each of the plurality of printing segments, a priority of printing may be defined for each drug category, and the drug packaging device may be configured to print, on condition that a plurality of drug categories are defined for the drug to be packaged, the drug category identification information in the plurality of printing segments in descending order of the priority of the drug category.

According to the above-mentioned configuration, when the drug to be packaged belongs to a plurality of drug categories, the drug category that requires a particular caution can be printed on the packaging paper preferentially. With this configuration, it is possible to issue a caution more efficiently.

When the drug is to be packaged and the printing is to be performed on the packaging paper through use of the drug packaging device, it is expected, that the packaging operation needs to be temporarily stopped due to waiting for manual distribution of the drug or stockout of the drug, or the like. When the packaging operation is temporarily stopped for a certain reason, the printing control unit is expected to perform such control as to temporarily stop the printing operation as well.

When the above-mentioned control is executed, the printing operation has been temporarily stopped and the restart of the packaging operation is waited for during a period after the stopping of the packaging operation until the restart of the packaging operation. During this period, heat is continuously applied to the packaging paper, which is in contact with a heater roller, from the heater rotor, the packaging paper is shrunk little by little due to this heat, and the packaging paper positioned adjacent to the printing unit is pulled toward the heater roller. In such a state, when the packaging operation is restarted and the printing operation is restarted, a blank gap (print gap) having a fixed width and involving no printing within the printing area occurs by a length pulled by the shrunk packaging paper. As the period during which the printing operation has been stopped becomes longer, the distance by which, the packaging paper is shrunk by the heat of the heater roller also becomes longer to cause a large print gap.

In the drug packaging device according to the one embodiment of the present invention, it is expected that optical identification information, for example, a two-dimensional bar code, which enables predetermined information to be read by an optical reading apparatus, may be selected as the subject to be printed and may be printed on the packaging paper. When those pieces of optical identification information are printed on the packaging paper, and the above-mentioned print gap is caused, the reading of the information may fail depending on the width of the print gap and the number of print gaps.

As a result of an extensive review, the inventors of the present invention have reached findings that, even, when the above-mentioned print gap exists in the optical identification information printed on the packaging paper, the reading can be performed by the optical reading apparatus with a few (one to three) print gaps each having a predetermined width or smaller.

The drug packaging device according to the one embodiment of the present invention, which is provided based on such findings, further includes a printing control unit configured to control the printing unit. Further, the printing control unit is configured to perform control for stopping a printing operation on condition that a packaging operation has been stopped, and the drug packaging device is configured to execute interim printing for performing printing after performing sheet feeding by a predetermined distance within a conveyance distance of the packaging paper corresponding to one package, one time or two or more times on condition that the packaging operation is not restarted after stopping of the packaging operation before a predetermined timing.

According to the above-mentioned configuration, one large print gap expected when the packaging operation and the printing operation have been stopped for a fixed time period or longer can be replaced by a few small print gaps. In other words, assuming that, a print gap formed by stopping the packaging operation and the printing operation for a predetermined time period t is set as a gap x, a large print gap corresponding to the gap x is formed unless the interim printing is performed. In contrast, when the interim printing is performed as in the one embodiment of the present invention, even in a case where a total time period during which the packaging operation and the printing operation have been stopped is equal so the predetermined time period t, although a plurality of print gaps are formed, the size of each of the print gaps is smaller than the above-mentioned gap x. Therefore, by performing the interim printing as in the one embodiment of the present invention, it is possible to suppress the print gap (width) to a minimum. With this configuration, it is possible to inhibit the two-dimensional bar code or other such optical identification information that cannot be read from being printed, and to contribute to the inhibition of losses of the packaging paper and the drug and maintenance of quality of the packaging bag.

In the drug packaging device according to the one embodiment of the present invention, the packaging paper corresponding to one package, which has been subjected to the execution of the interim printing, may be processed as an empty package on condition that the interim printing is executed a preset number of times and that, the packaging operation is not restarted at a timing at which a predetermined time period has elapsed since completion of the interim printing.

According to the above-mentioned configuration, when the packaging operation is not started even after a time period expected in advance as the stopped period of the packaging operation has elapsed, it is possible to prevent print gaps having the number and the size that exceed the readable range for the optical identification information from occurring and the optical identification information that cannot be read resultantly from being printed. That is, by processing the packaging paper feared to become unable to be read as an empty package, it is possible to prevent the drug from being packaged into the packaging paper that may cause a reading failure and the packaging bag having insufficient quality from being provided, and to alleviate the loss of the drug through reduction in amount of drug packaged in such a packaging paper. As a result, it is possible to suppress unnecessary packaging, and to reduce redundancy in time and labor for, for example, printing the two-dimensional bar code again due to a printing failure.

A period after the stopping of the packaging operation until a timing (predetermined timing) at which the first interim printing is started is desirably set to a time period after the stopping of the packaging operation until the start of the first interim printing so that the width of the print gap caused during the period after the stopping of the packaging operation until the start of the first interim printing is equal to or smaller than a predetermined size. That is, it is desired to set the optical identification information readable by a predetermined optical reading apparatus when the print gap occurs in the optical identification information printed on the packaging paper.

According to the above-mentioned configuration, it is possible to inhibit the optical identification information printed on the packaging paper from becoming unable to be read. The time period after the stopping of the packaging operation until the start of the first interim printing can be set in various manners based on the temperature of the heater roller, the property of the packaging paper, the conveyance speed of the packaging paper, and the like.

In the drug packaging device according to the one embodiment of the present invention, the interim printing may be executed a plurality of times on condition that a stopped period of the packaging operation is equal to or longer than a predetermined time period.

According to the above-mentioned configuration, even when the packaging operation has been stopped for a certain time period, the readable two-dimensional bar code can be printed on the packaging paper.

Advantageous Effects of Invention

According to the present invention, it is possible to provide the drug packaging device including the printing unit configured to perform printing by jetting ink and being capable of performing the printing on the packaging paper with high printing quality without including a support base or the like for the packaging paper.

BRIEF DESCRIPTION OF DRAWINGS

FIG. 19 are diagrams for comparison between control based on a PWM method and control based on an analog output method in regard to control of the roll setting unit, in which: FIG. 19(*a*) is an illustration of a control waveform of a CPU and the paper roll resistance of the roll setting unit in a case where the PWM method is employed; and FIG. 19(*b*) is an illustration of a control waveform of the CPU and the paper roll resistance of the roll setting unit in a case where the analog output method is employed.

FIG. 26 are each an illustration of a bitmap image and a histogram of the bitmap image, in which; FIG. 26(*a*) relates to a case in which a large amount of the same color is not used; and FIG. 26(*b*) relates to a case in which a large amount of the same color is used.

FIG. 27 are illustrations of drug category identification information and the printing area, in which: FIG. 27(*a*) is an illustration, of the printing area and four printing segments; and FIG. 27(*b*) is an illustration of an example in which, the drug category identification information is printed in the printing area.

FIG. 28 are illustrations of examples of performing the printing when the drug belongs to a plurality of drug categories in the example of printing the drug category identification information of FIG. 27, in which: FIG. 28(*a*) is an illustration of an example of performing the printing when the drug belongs to four drug categories; FIG. 28(*b*) is an illustration of an example of performing the printing when the drug belongs to two drug categories; and FIG. 28(*c*) is an illustration of an example of performing the printing when the drug belongs to three drug categories.

DESCRIPTION OF EMBODIMENTS

Now, a drug packaging device 10 according to one embodiment of the present invention is described with reference to the accompanying drawings. First, an outline of an entire configuration of the drug packaging device 10 is described, and then configurations of a packaging paper conveying unit 40 and a printing unit 60, which are feature parts, and operation control of the packaging paper conveying unit 40 and the printing unit 60, which is carried out by a control device 70, are described in more detail.

<<Regarding Schematic Configuration of Drug Packaging Device 10>>

Figure 1:
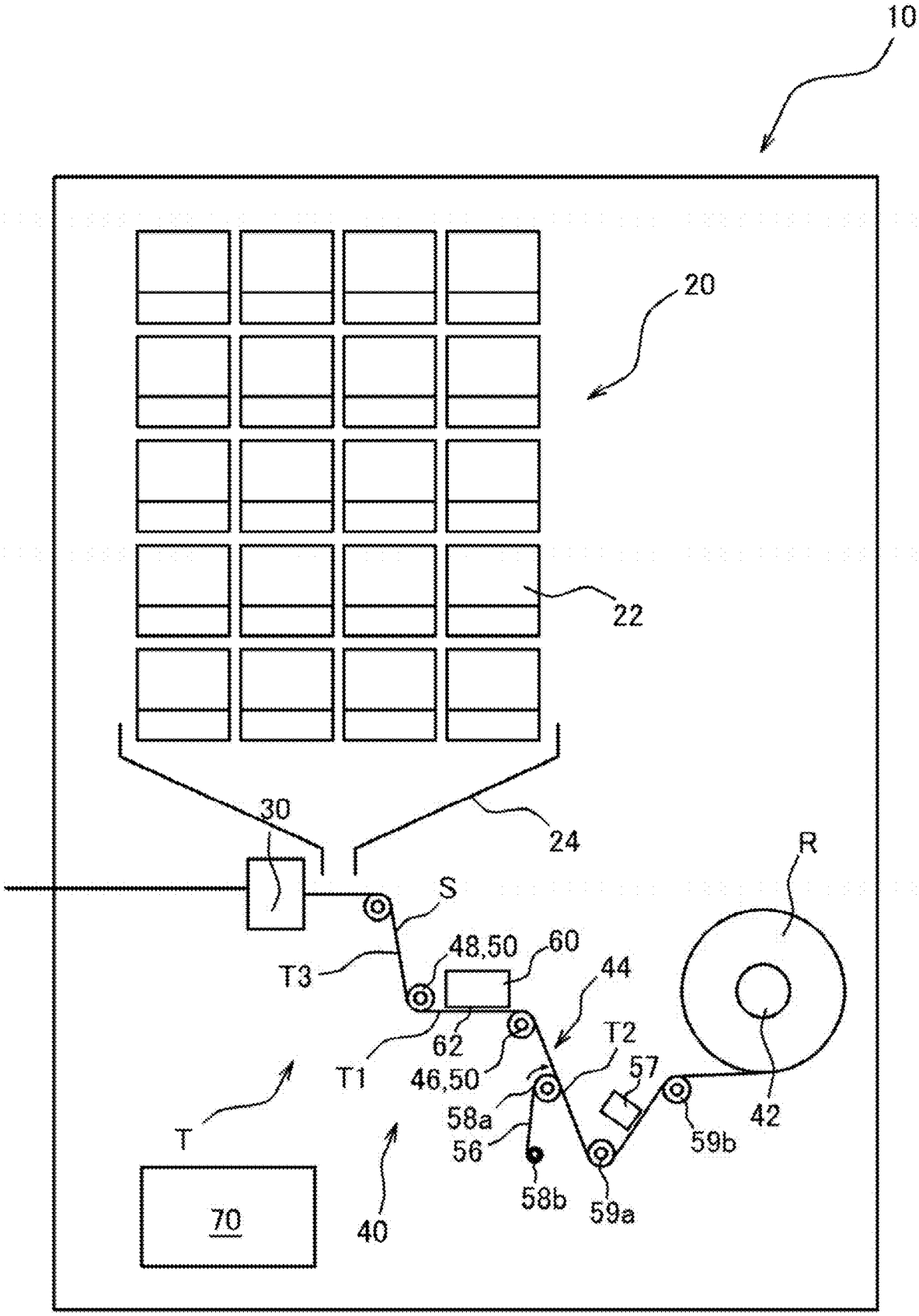
FIG. 1 is an explanatory diagram for illustrating a schematic configuration of a drug packaging device according to one embodiment of the present invention.
Figure 2:
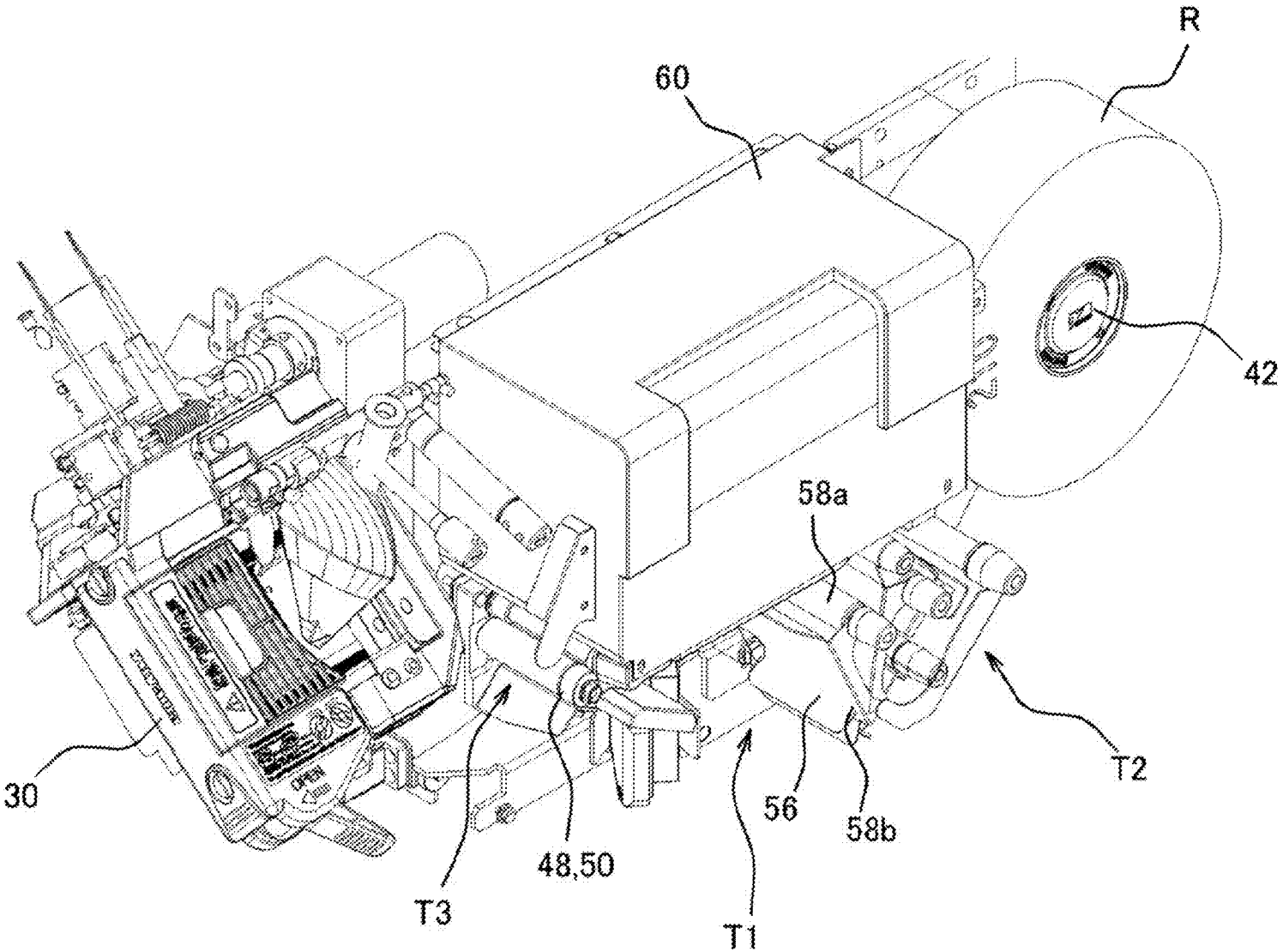
FIG. 2 is a perspective view for illustrating a vicinity of a printing unit of the drug packaging device of FIG. 1.

As illustrated in FIG. 1, the drug packaging device 10 includes a drug supply unit 20, a packaging unit 30, the packaging paper conveying unit 40, the printing unit 60, and the control device 70. The drug packaging device 10 is capable of packaging a drug, which has been supplied from the drug supply unit 20 on prescription, through use of a packaging paper, which has been supplied from the packaging paper conveying unit 40 to the packaging unit 30, based on prescription data input from the outside. The drug packaging device 10 is further capable of printing, for example, a name of a patient and predetermined information including a time of administration, a type, and a quantity of the packaged drug on the packaging paper based on the prescription data by the printing unit 60.

The drug supply unit 20 includes a large number of cassettes 22 containing drugs different in type, and is capable of supplying (dispensing) a drug from each of the cassettes 22 based on the prescription data. The drug supplied from each of the cassettes 22 is guided to the packaging unit 30 through a hopper 24.

The packaging unit 30 is configured to package the drug supplied from the drug supply unit 20 through use of a packaging paper S supplied from the packaging paper conveying unit 40 described later. The packaging paper S is supplied to the packaging unit 30 while being folded in two in its longitudinal direction, and the drug supplied from the drug supply unit 20 is supplied into the packaging paper S folded in two. The packaging unit 30 includes a heater roller (not shown), and is capable of sealing the packaging paper S folded in two. Therefore, in the packaging unit 30, one dose of a drug is inserted into the packaging paper S folded into two, and then the packaging paper S is sealed by the heater roller, to thereby be able to obtain a packaging bag P formed by packaging the drug supplied from the drug supply unit 20 on a dose-by-dose basis.

The packaging paper conveying unit 40 includes a roll setting unit 42 and a conveying mechanism 44. The roll, setting unit 42 is provided in order to set the packaging paper S formed to have a roll shape (paper roll R). The conveying mechanism 44 is a mechanism for conveying the packaging paper S from the roll setting unit 42 to the packaging unit 30 along a predetermined conveyance path T.

The printing unit 60 is provided midway through the conveyance path T for the packaging paper S in the packaging paper conveying unit 40. That is, the printing unit 60 is arranged on upstream of the packaging unit 30 in the conveyance direction of the packaging paper S.

The printing unit 60 is also provided at a position on upstream of a second conveyance direction switching section 48, which is described later in detail, in the conveyance direction and adjacent to the packaging unit 30. In the conveying mechanism 44, the packaging paper S is fed within a section from the roll setting unit 42 to the packaging unit 30. In the packaging paper S positioned between the roll setting unit 42 and the packaging unit 30 at a time point to start packaging into packaging paper S, a part of the packaging paper S positioned between the printing unit 60 and the packaging unit 30 passes through the packaging unit 30 without being subjected to the printing, and therefore generally become a loss without being used for the packaging. Therefore, the printing unit 60 is provided at the position adjacent to the packaging unit 30 as much as possible, to thereby be able to reduce the loss of the packaging paper S. The printing unit 60 is capable of printing various kinds of information on the drug packaged in each packaging bag P, which include the time of administration, the type, the quantity, the name of the patient, and a photograph of a face of the patient, on the packaging paper S being conveyed along the conveyance path T.

Figure 4:
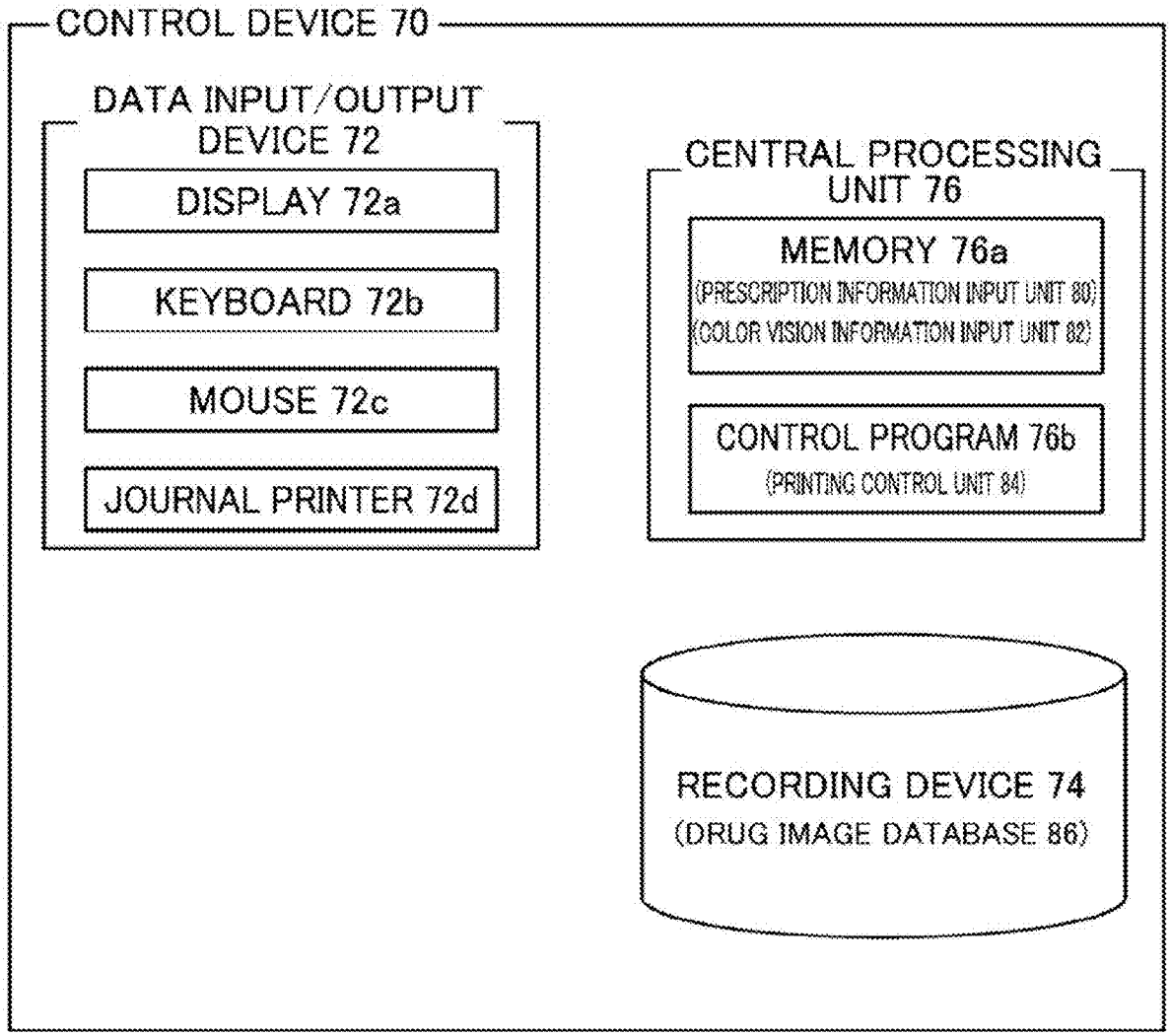
FIG. 4 is a block diagram for illustrating a configuration of a control device included, in the drug packaging device illustrated in FIG. 1.

The control device 70 is configured to control the operations of the respective units that form the drug packaging device 10, and is formed of, for example, a personal computer. As illustrated in FIG. 4, the control device 70 includes a data input/output device 72, a recording device 74, for example, a hard disk drive provided for storing a data file, and a processing device 76 (CPU). The data input/output device 72 includes a display 72*a*, a keyboard 72*b*, a mouse 72*c*, and a journal printer 72*d*. The processing device 76 includes a built-in memory 76*a* (RAM) configured to store various kinds of data. The memory 76*a* is used as, for example, a prescription data memory configured to store the prescription data. The processing device 76 further includes a built-in control program 76*b* (ROM) configured to control an entirety of the drug packaging device 10. The control device 70 is configured to receive the prescription data from a host computer (not shown), and to execute the control program 76*b* based on the prescription data, to thereby execute operation control of the drug supply unit 20, the packaging unit 30, the packaging paper conveying unit 40, and the printing unit 60.

<<Regarding Specific Configuration of Packaging Paper Sheet Conveying Unit 40 and Printing Unit 60>>

Next, the configuration of the packaging paper conveying unit 40 is described in more detail. As described above, the packaging paper conveying unit 40 includes the roll setting unit 42 for setting the paper roll K of the packaging paper S and the conveying mechanism 44 for conveying the packaging paper S along the predetermined conveyance path T. The conveyance path T is roughly classified into an intersecting-direction conveyance section T1, an upstream section T2, and a downstream section T3. The intersecting-direction conveyance section T1 is a section in which the packaging paper S is conveyed with a paper surf ace being kept substantially horizontal. The upstream section T2 is located on upstream (on the roll setting unit 42 side) of the intersecting-direction conveyance section T1 in the conveyance direction of the packaging paper S, and is a section in which the packaging paper S is conveyed from a lower position to an upper position with a predetermined slope. The downstream section T3 is located on downstream (on the packaging unit 30 side) of the intersecting-direction conveyance section T1 in the conveyance direction of the packaging paper S, and is a section in which the packaging paper S is conveyed from a lower position to an upper position with a predetermined slope.

The conveying mechanism 44 includes a first conveyance direction switching section 46 on upstream of the intersecting-direction conveyance section T1 and the second conveyance direction switching section 48 on downstream of the intersecting-direction conveyance section T1. The conveying mechanism 44 conveys the packaging paper S while switching the conveyance direction of the packaging paper S by those switching sections 46 and 48. The first conveyance direction switching section 46 is provided at a boundary between the intersecting-direction conveyance section T1 and the upstream section T2 described above. In the first conveyance direction switching section 46, the conveyance direction of the packaging paper S, which has been conveyed from the lower position to the upper position in the upstream section T2, is switched to a substantially horizontal direction. In the same manner, in the second conveyance direction switching section 48, the conveyance direction of the packaging paper S, which has been conveyed along the substantially horizontal direction, in the intersecting-direction conveyance section T1, is switched to a vertical direction.

Figure 5A:
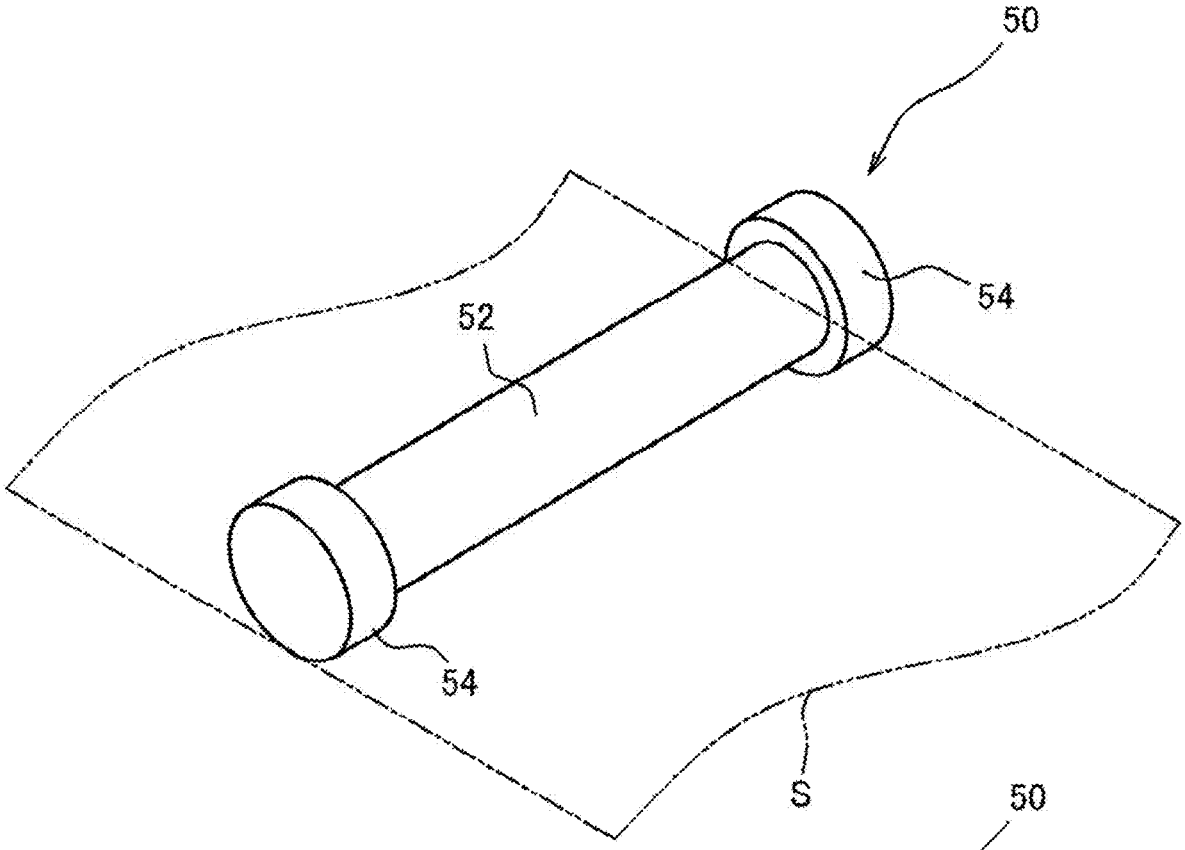
FIG. 5(*a*) is a perspective view for illustrating a conveying roller, and FIG. 5(*b*) is an explanatory diagram for illustrating a relationship between the conveying roller and a packaging paper.
Figure 5B:
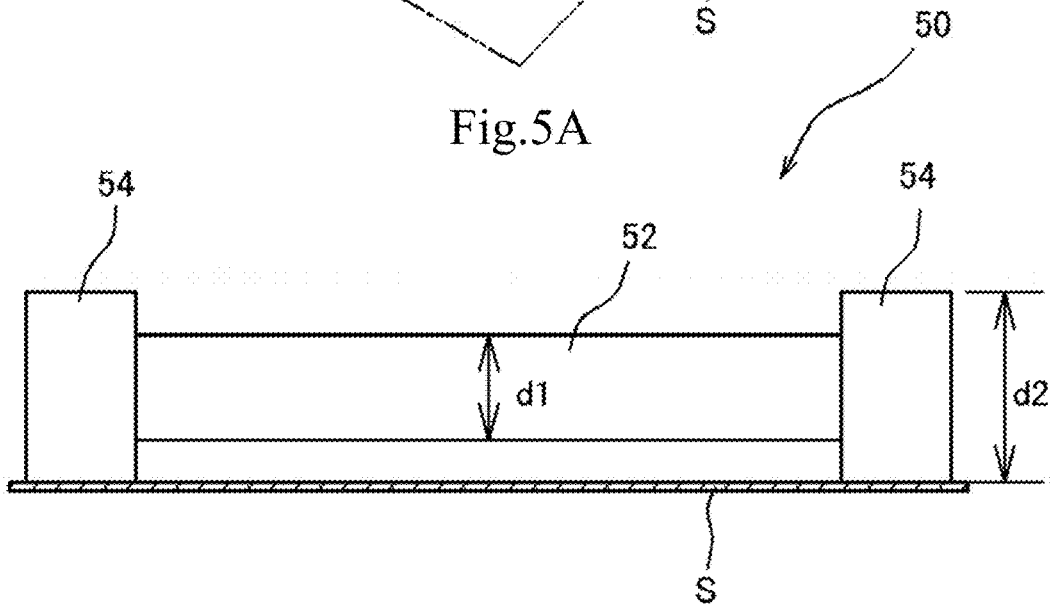

The first conveyance direction switching section 46 and the second conveyance direction switching section 48 each include such a conveying roller 50 as illustrated in FIG. 5. The conveying roller 50 is a roller brought into abutment against the packaging paper S passing through the conveyance path T, and is arranged so as to have an axial direction intersecting the conveyance direction of the packaging paper S. As illustrated in FIG. 5(*b*), in the conveying roller 50, an outer diameter d1 of an intermediate portion 52 in the axial direction is smaller than an outer diameter d2 of both end portions 54 and 54. Therefore, the conveying roller 50 is brought into abutment against the packaging paper S passing through the conveyance path T in both the end portions 54 and 54, but is not brought into contact with the packaging paper S in the intermediate portion 52.

Figure 3:
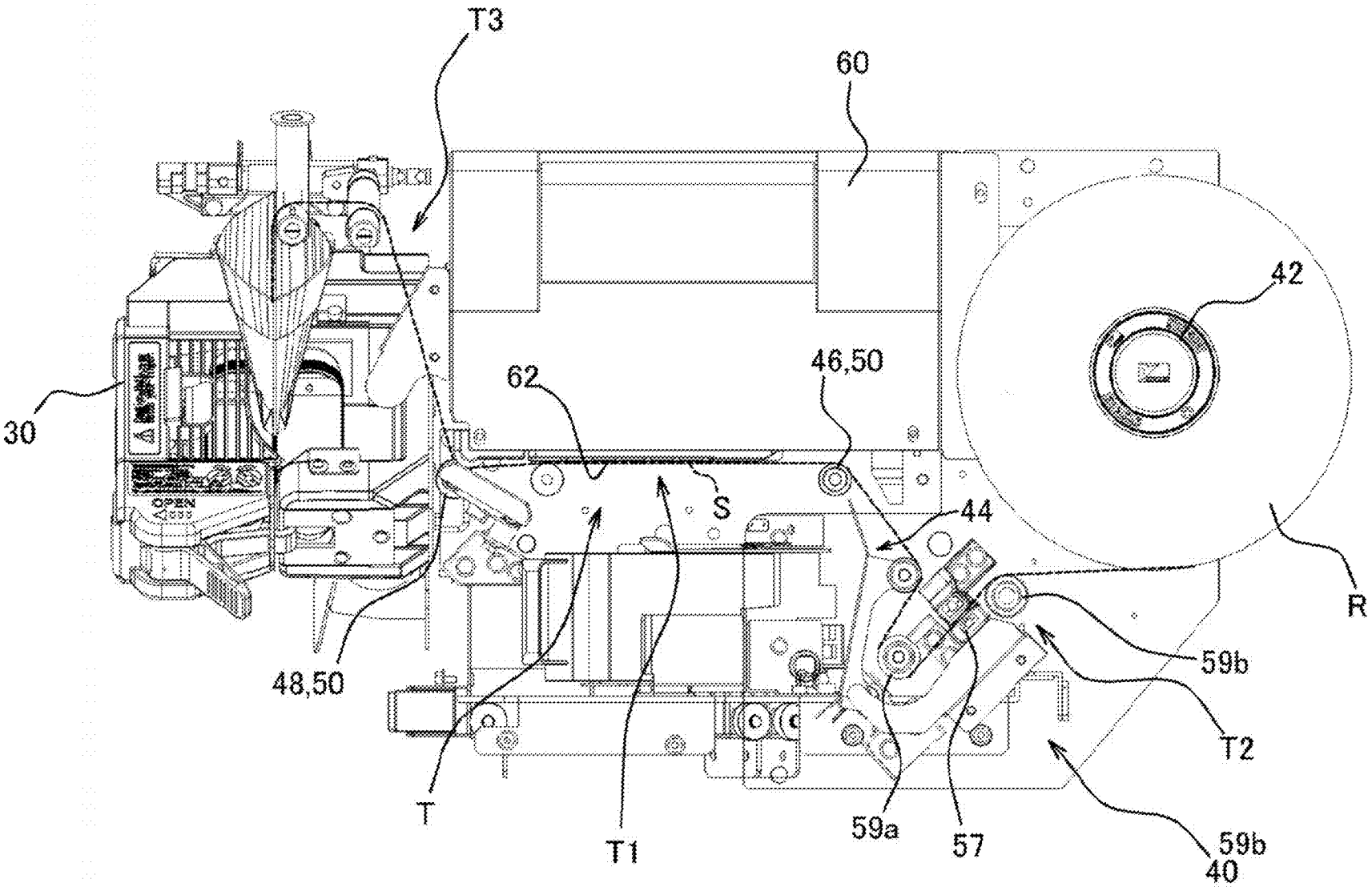
FIG. 3 is a side view for illustrating the vicinity of the printing unit of the drug packaging device of FIG. 1.

Further, as illustrated in FIG. 1 and FIG. 3, guide rollers 59*a* and 59*b* configured to guide the packaging paper S sent from the paper roll R are provided on upstream of an urging unit 56. Therefore, the packaging paper S is guided by the guide rollers 59*a* and 59*b*, and passes through an urging roller 58*a* to be sent to the first conveyance direction switching section 46. An out-of-paper sensor 57 is provided between the guide rollers 59*a* and 59*b*. The out-of-paper sensor 57 is capable of detecting an out-of-paper state by detecting presence or absence of the packaging paper S passing between the guide rollers 59*a* and 59*b*.

The conveying mechanism 44 is capable of conveying the packaging paper S from the roll setting unit 42 side toward the packaging unit 30 while exerting a fixed tensile force on the packaging paper S. In this embodiment, as illustrated in FIG. 1, the urging unit 56 configured to further exert the urging force on the packaging paper S is provided in order to suppress an occurrence of slack in the packaging paper S in the intersecting-direction conveyance section T1. Specifically, the urging unit 56 includes the urging roller 58*a* at a position on upstream of the first conveyance direction switching section 46 in the conveyance direction. As indicated by the arrow in FIG. 1, the urging roller 58*a* is urged, by urging means 58*b*, for example, a spring. The urging roller 58*a* is brought into abutment against the packaging paper S at a position on upstream of the first conveyance direction switching section 46. With this configuration, a tensile force is exerted on the packaging paper S in a direction from the intersecting-direction conveyance section T1 side toward the upstream side, and hence slack is hard to occur in the packaging paper S in the intersecting-direction conveyance section T1.

The printing unit 60 is configured to print the name of the patient and the predetermined information including the time of administration, the type, and the quantity of the packaged drug on the packaging paper S. The printing unit 60 employs a so-called ink-jet printer, and is capable of performing the printing by ejecting ink, which has been supplied from a built-in ink tank (not shown), from an ink ejection unit 62.

Figure 6:
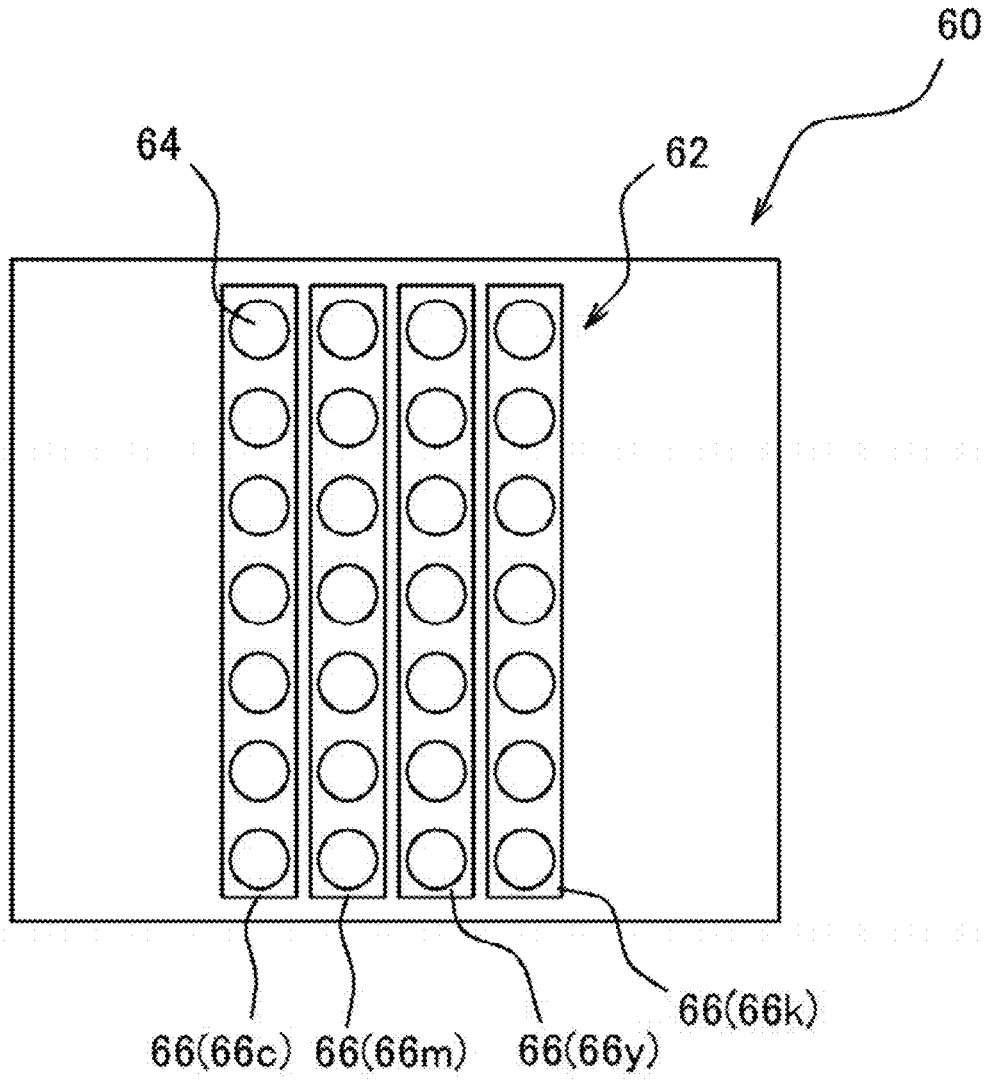
FIG. 6 is a bottom view for illustrating a state in which the printing unit is viewed from an ink ejection unit side.

As illustrated in FIG. 6 the ink ejection unit 62 includes a linear nozzle array 66 formed of a plurality of nozzles 64 arranged in a direction intersecting the conveyance direction of the packaging paper S used by the packaging paper conveying unit 40. In this embodiment, a plurality of linear nozzle arrays 66 are provided in the ink ejection unit 62. Specifically, in order to eject inks of four colors of cyan (C), magenta (M), yellow (Y), and black (K), the ink ejection unit 62 includes the linear nozzle arrays 66*c*, 66*m*, 66*y*, and 66*k* for the respective colors.

The ink ejection unit 62 is arranged at a position spaced apart upward from the above-mentioned intersecting-direction conveyance section T1 by a predetermined distance, and is capable of ejecting ink downward from the respective linear nozzle arrays 66*c*, 66*m*, 66*y*, and 66*k*. Therefore, it is possible to subject the packaging paper S to color printing without moving the ink ejection unit 62 by ejecting ink toward the packaging paper S from the respective linear nozzle arrays 66*c*, 66*m*, 66*y*, and 66*k* while moving the packaging paper S in the conveyance direction in the intersecting-direction conveyance section T1.

As illustrated in FIG. 4, the control device 70 includes a prescription information input unit 80, a color vision information input unit 82, a printing control unit 84, and a drug image database 86. The prescription information input unit 80 is configured to receive input of the prescription data from the host computer (not shown). The color vision information input unit 82 is configured to receive input of color vision information relating to whether or not a patient has color vision deficiency. In this embodiment, the memory 76*a* of the processing device 76 functions as the prescription information input unit 80 and the color vision information input unit 82. The printing control unit 84 is configured to control the printing unit 60. In this embodiment, the control program 76*b* functions as the printing control unit 84. The drug image database 86 is obtained by collecting images for showing external appearances of drugs as a database. In this embodiment, the drug image database 86 is built on the recording device 74.

The control device 70 is configured to perform printing on the packaging paper S under control of the printing control unit 84. Specifically f the control device 70 causes the printing unit 60 to print the name of the patient and the predetermined information including the time of administration, the type, and the quantity of the packaged drug on the packaging paper S based on the prescription information received by the prescription information input unit 80. In addition, the control device 70 selects the image of a drug to be packaged from the drug image database 86, and causes the printing unit 60 to print the selected image of the drug on the packaging paper S together with the above-mentioned information including the name of the patient.

The control device 70 determines whether or not the drug to be packaged is prescribed for a patient having color vision deficiency based on the color vision information input to the color vision information input unit 82. As a result, when determining that the drug to be packaged is prescribed for a patient not having color vision deficiency, the control device 70 controls the printing unit 60 to subject the packaging paper S to the color printing. Meanwhile, when determining that the drug to be packaged is prescribed for the patient having color vision deficiency, the control device 70 controls the printing unit 60 to perform the printing on the packaging paper S through use of colors excluding a color that is difficult for the patient to identify. Specifically, in regard to the prescription for the patient having color vision deficiency, the control device 70 controls the printing unit 60 to perform the printing in black and white or in gray scale.

As described above, in the drug packaging device 10, the intersecting-direction conveyance section T1 in which the packaging paper S is conveyed in a direction (substantially horizontal direction) intersecting an ejection direction of the ink is provided midway through the conveyance path T of the packaging paper S used by the packaging paper conveying unit 40. The ink ejection unit 62 of the printing unit 60 is provided above the intersecting-direction conveyance section T1. The conveyance path T for the packaging paper S is formed so that the conveyance direction is changed at the first conveyance direction switching section 46 on upstream of the intersecting-direction conveyance section T1 and at the second conveyance direction switching section 48 on downstream of the intersecting-direction conveyance section T1. In the conveyance path T, the first conveyance direction switching section 46 and the second conveyance direction switching section 48 each function as a fulcrum for supporting the packaging paper S. Therefore, the intersecting-direction conveyance section T1 has a state in which a fixed tensile force is exerted on the packaging paper S. This enables the drug packaging device 10 to perform the printing on the packaging paper S with high printing quality without providing a base or the like for supporting the packaging paper S in the intersecting-direction conveyance section T1.

Further, as described above, the printing unit 60 is provided at a position adjacent to the packaging unit 30. With this configuration, it is possible to suppress an interval between the printing unit 60 and the packaging unit 30 to a minimum, and to suppress a loss of the packaging paper S to a minimum.

The drug packaging device 10 further includes the urging unit 56, and the urging force is exerted so that a tensile force is exerted on the packaging paper S in the intersecting-direction conveyance section T1. With this configuration, the S is brought to a sufficiently stretched state in the intersecting-direction conveyance section T1, and it is possible to finely perform the printing by ejecting ink onto the packaging paper S.

This embodiment is described by taking an example of providing the urging unit 56 so that the packaging paper S is brought to a sufficiently stretched state in the intersecting-direction conveyance section T1, but the present invention is not limited thereto, and the urging unit 56 does not need to be provided. This embodiment is also described by taking an example of arranging the urging unit 56 on upstream of the intersecting-direction conveyance section T1, but instead, a unit having the same function as that of the urging unit 56 may be arranged on downstream of the intersecting-direction conveyance section T1 to urge the packaging paper S in a direction away from the intersecting-direction conveyance section T1. In another case, units each corresponding to the urging unit 56 may be arranged on both upstream and downstream of the intersecting-direction conveyance section T1.

In the above-mentioned drug packaging device 10, a conveying roller having the outer diameter d1 of the intermediate portion 52 smaller than the outer diameter d2 of both the end portions 54 and 54 is employed as each of the conveying rollers 50 that form the first conveyance direction switching section 46 and the second conveyance direction switching section 48. Therefore; as illustrated in FIG. 5(*b*), the conveying roller 50 is brought into contact with the packaging paper S in both the end portions 54 in a direction (width direction) intersecting the conveyance direction of the packaging paper S, which can prevent the conveying roller 50 and the packaging paper S from being contact with each other in the intermediate portion 52 in the width direction. As a result, in the second conveyance direction switching section 48, it is possible to prevent the printing performed on an intermediate portion of the packaging paper S in the width direction from deteriorating in quality due to the contact with the conveying roller 50. Specifically, when the packaging paper S immediately after the printing passes through the second conveyance direction switching section 48, both the end portions 54 and 54 of the conveying roller 50 are brought into contact with the packaging paper S, while a printed part of the packaging paper S is not brought into contact with the second conveyance direction switching section 48. Therefore, undried ink ejected onto the packaging paper is not brought into contact with the conveying roller 50, and the ink does not spread or smudge. In the first conveyance direction switching section 46, it is possible to inhibit a wrinkle or the like that causes deterioration in printing quality from being formed in a printing area of the packaging paper S due to the contact with the conveying roller 50. With this configuration, it is possible to further improve the printing quality for the packaging paper S.

This embodiment is described by taking an example in which the first conveyance direction switching section 46 and the second conveyance direction switching section 48 are formed of the conveying rollers 50, but the conveying roller 50 may be also employed as another roller arranged in the conveying mechanism 44. Any one or both of the first conveyance direction switching section 46 and the second conveyance direction switching section 48 may be formed of a normal roller different from the conveying roller 50.

In the drug packaging device 10 according to this embodiment, a so-called linear-nozzle-type ink-jet printer in which the ink ejection unit 62 includes the linear nozzle array 66 is employed as the printing unit 60. Therefore, when the printing is performed on the packaging paper S, it is not necessary for the ink ejection unit 62 to perform reciprocation or other such operation. With this configuration, it is possible to further speed up the printing for the packaging paper S while suppressing an installation area of the printing unit 60 to a minimum.

This embodiment is described by taking an example of employing the linear-nozzle-type ink-jet printer as the printing unit 60, but the present invention is not limited thereto. That is, the printing unit 60 may employ another printing method as long as the printing can be performed by ejecting ink from the ink ejection unit 62.

As described above, in the drug packaging device 10 according to this embodiment, the image of the drug to be packaged is selected from the drug image database 86 based on the prescription information, and the selected image of the drug is printed on the packaging paper S. Therefore, according to the drug packaging device 10, after the drug is packaged, a pharmacist or the like can confirm whether or not a drug has been packaged on prescription through visual observation by comparing the image of a drug printed on the packaging paper S with a drug actually packaged in the packaging paper S. This embodiment is described by taking an example of printing the outer appearance image of the drug on the packaging paper S, but the present invention is not limited thereto, and the outer appearance image of the drug does not need, to be printed.

Further, in the case of the prescription for the patient having color vision deficiency, the drug packaging device 10 according to this embodiment can perform the printing on the packaging paper S through use of colors excluding a color that is difficult for the patient to identify. Therefore, it is possible even for the patient having color vision deficiency to easily identify information printed on the packaging paper S. This embodiment is described by taking an example in which even the patient having color vision deficiency can be handled, but the present invention is not limited thereto, and such a function does not need to be provided.

This embodiment is described by taking an example in which various kinds of information including the time of administration, the type, and the quantity of a drug, the name of a patient, and the photograph of the face of the patient are printed by the printing unit 60, but the present invention is not limited thereto, and other such various kinds of information may be printed. Specifically, a bar code or a color code indicating the prescription data or the like may be printed on the packaging paper S. In another case, the printing may be performed on the respective packaging bags P in different colors depending on the day of the week, the time of administration, or other such classification, to thereby allow the pharmacist, the patient, or the like to classify the packaging bags P with ease.

Figure 7:
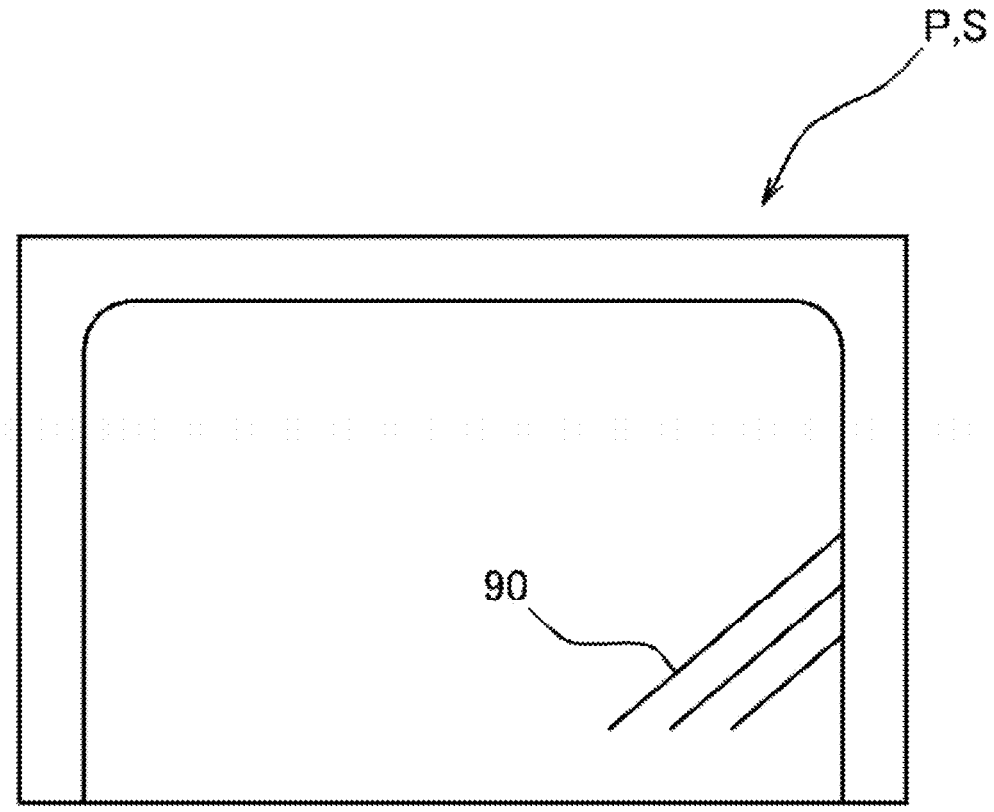
FIG. 7 is a front view for illustrating an example of providing scale divisions to a packaging bag.

The drug packaging device 10 is not limited to a drug packaging device used for packaging a solid drug, but may be a drug packaging device used for packaging a powdered drug. In the case of packaging the powdered drug, it is preferred to print such scale divisions 90 as illustrated in FIG. 7 on the packaging bag P so that it is possible to confirm through visual observation whether or not an approximately predetermined amount of a drug has been packaged in the packaging bag P. With the scale divisions 90 being provided, it is possible to confirm whether or not an approximately predetermined amount of a powdered drug has been packaged by examining whether or not the powdered drug is contained up to a position indicated by the scale division 90 while tilting the packaging bag P so that a corner provided with the scale divisions 90 becomes the bottom. In another case, when the scale divisions 90 are subjected to color printing, it is possible to perform an inspection through visual observation with ease while preventing the scale divisions 90 from becoming difficult to be distinguished from the powdered drug unlike in a case in which the scale divisions 90 are printed in black. In addition, it is possible to prevent the packaged drug from being packed into a wrong drug envelope by, for example, matching a color of a drug envelope with a print color of the scale divisions 90.

<<Regarding Example of Operating Drug Packaging Device 10>>

As described above, the control device 70 is configured to control the operations of the respective units that form the drug packaging device 10. The control device 70 receives the prescription data from the host computer (not shown) to execute the control program **76*b* based on the prescription data. With this configuration, the operation control of the drug supply unit 20, the packaging unit 30, the packaging paper conveying unit 40, and the printing unit 60** is executed. As the print items to be printed on the packaging paper S, a wide variety of information including a name of a drug, a drug image, a name of a patient, and a date/time of administration can be printed based on prescription data. Those pieces or information are desired to be managed in linkage with databases used at a hospital, a pharmacy, or other such medical institution.

Specifically, it is possible to record and use various databases including the patient master for registering patient information, the ward master for registering ward information, the user master for registering user information, the facility master for registering facility information, and the facility-with-time-of-administration master, which are used at a medical institution or the like. When the above-mentioned different kinds of masters are used to set the print items, it is desired that an instruction regarding which color is to be used for the printing for each of items to be printed on the packaging paper S be registered in advance for each of the masters. An example of a print setting and the like for each master is described below.

<<Regarding Ward Master>>

The ward master is a database for registering a pharmacist in charge who is responsible for inpatient pharmaceutical services at a medical institution, a name of a ward, a ward code, and the like. In the ward master, it is possible to perform, for example, such setting as to change the print color to be used on the packaging paper S for each floor of the ward. When the packaging print color used for the printing on the packaging bag P is different for each floor of the ward, it is easy for the pharmacist or the like to sort the packaging bags P by, for example, the ward through use of the print color as a sorting criterion, and thus it is expected to effectively reduce erroneous administration.

<<Regarding Facility Master>>

The facility master includes a name of a facility, a facility code, or other such information. In the facility master, the print color to be used on the packaging bag P can be set for each facility and for each day of the week. With this configuration, print color setting corresponding to the day of the week can be printed in response to a request from the facility.

<<Regarding Facility-with-Time-of-Administration Master>>

The facility-with-time-of-administration master includes the name of the facility, the facility code, the time of administration of a drug, for example, after breakfast or after supper, or other such information. The drug packaging device 10 is capable of changing a print style in response to a demand from the facility by utilizing the facility-with-time-of-administration master. Specifically, it is possible to meet a request set for each facility by, for example, performing the printing in blue for a drag to be administered after breakfast and in green for a drug to be administered after lunch.

<<Regarding Patient Master>>

Figure 10:
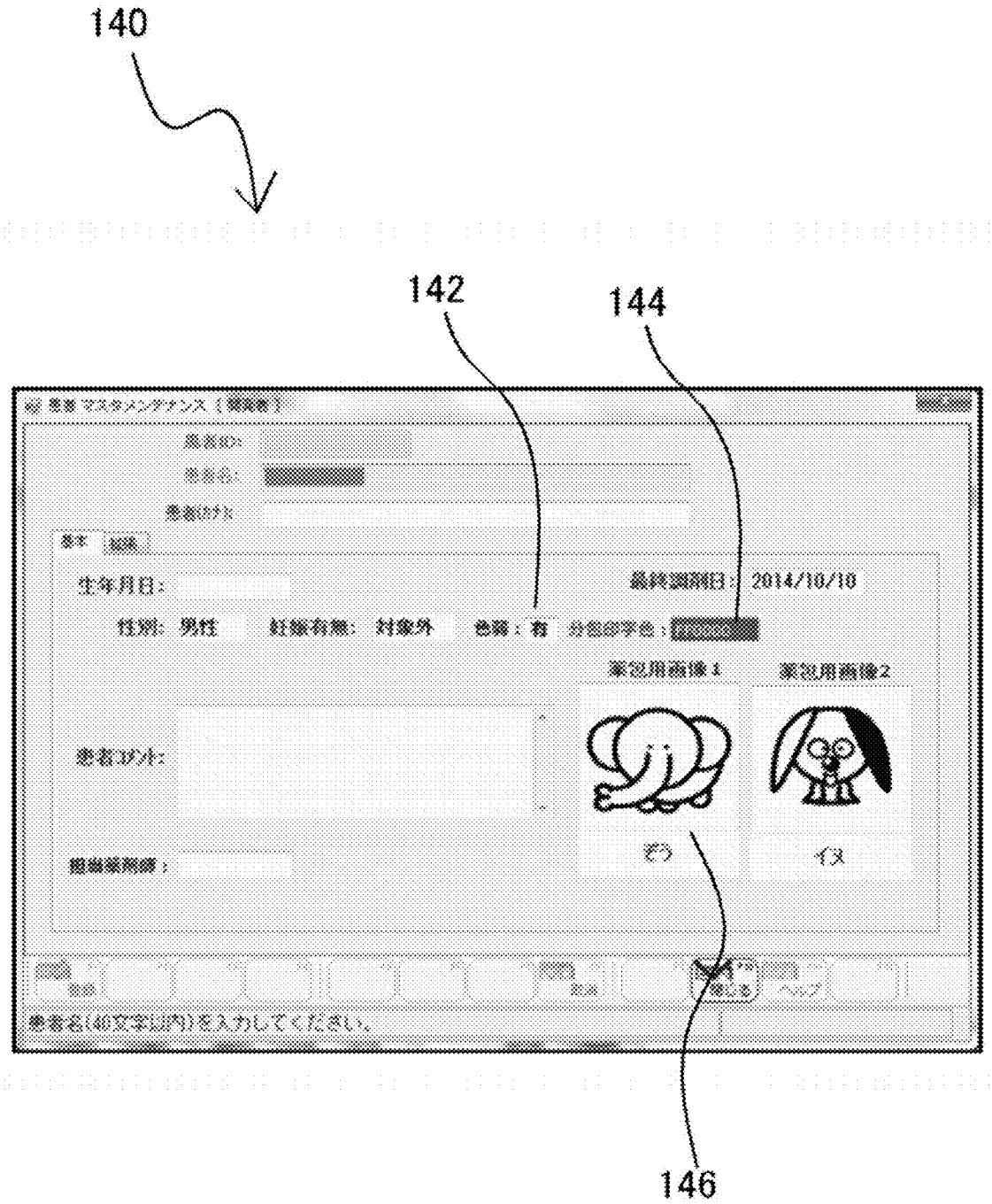
FIG. 10 is an illustration of a patient master maintenance detail screen for managing patient information.

The patient master includes the name of a patient, an ID of the patient, with or without color vision deficiency, his/her birth date, and other such information. FIG. 10 is an illustration of a patient master maintenance detail screen 140, which is an example of an operation screen for managing and registering the information in the patient master. The patient master maintenance detail screen 140 is provided with a color vision defect display field 142 for displaying the presence or absence of color vision deficiency, a packaging print color display field 144, a drug package image display field 146, and the like.

The respective masters described above may be used as separate databases, or may be managed by associating a plurality of databases with one another. For example, the patient master and the facility master may be managed by being linked with each other. When the patient master and the facility master are linked with each other, it is desired to set so that a print color set in advance is automatically selected in the facility master only by selecting a patient for which a drug to be packaged is prescribed. This setting eliminates time and labor for performing individual setting while referring to different kinds of materials for the print colors requested by the facilities each time the drug is packaged for a plurality of patients of which the respective facilities are in charge, and the printing is controlled so as to achieve the print color corresponding to a print setting color for each facility only through selection of the patient.

The above-mentioned different, kinds of masters may be built on the recording device 74 of the control device 70, or may be built on another host computer (not shown) or the like. The print setting using the drug packaging device 10, which is registered in the above-mentioned different kinds of masters, can be selected by a print format setting screen 160 described, later in detail. The setting of an image for printing to be selected in each master, the registration of a print image, and the like are performed through input on different kinds of operation screens including an image selection screen 100 and an image management screen 120, which are operation screens.

<<Regarding Image Selection Screen and Image Management Screen>>

Figure 8:
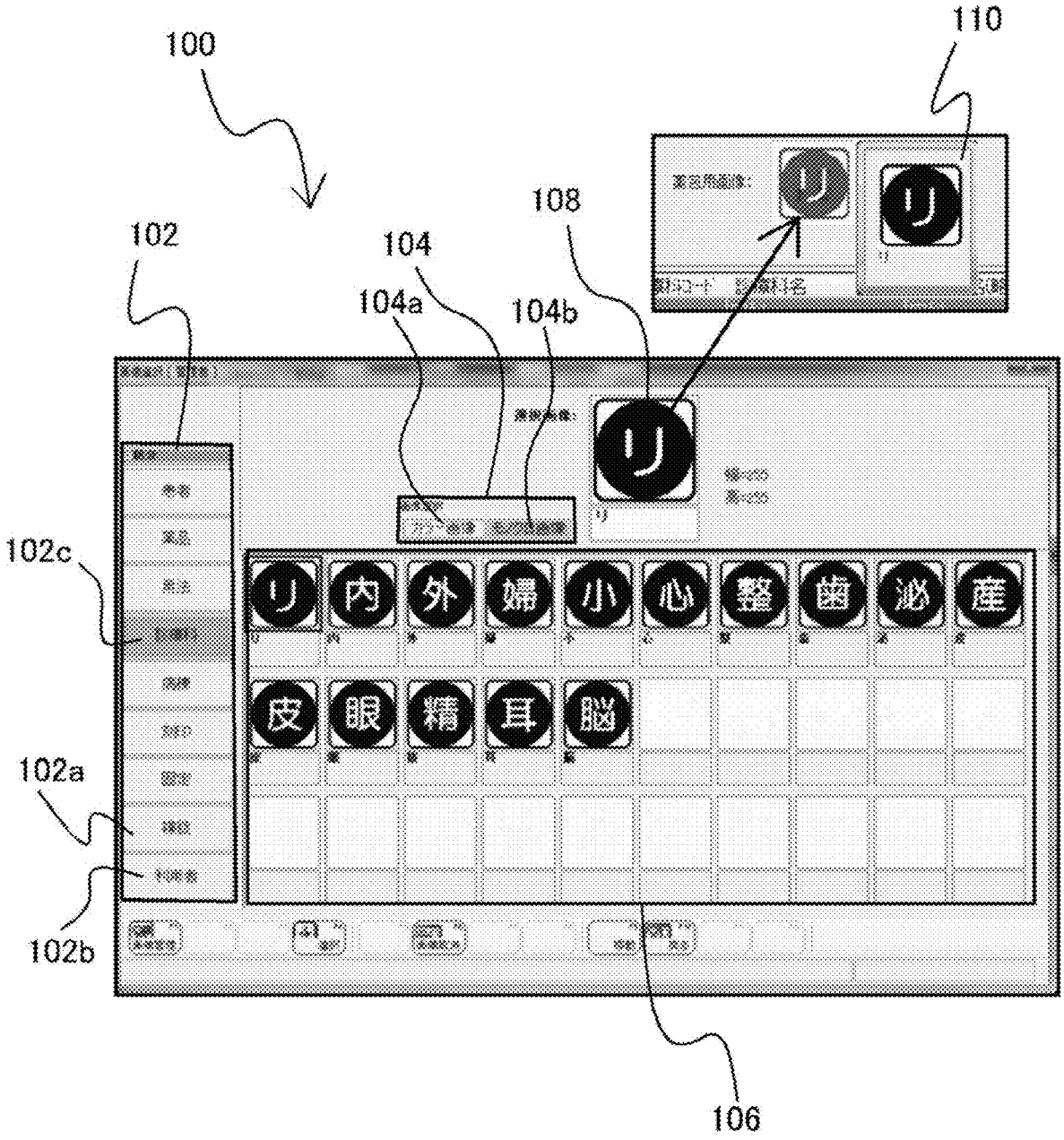
FIG. 8 is an image selection screen for selecting and registering an image or the like for printing on the packaging paper.

The image selection screen 100 is described with reference to the accompanying drawing. FIG. 8 is an illustration of an example of the image selection screen 100. The image selection screen 100 is an operation screen for selecting an image to be actually used for printing in advance from a large number of images registered as candidates to be printed on the packaging bag P. As illustrated in FIG. 8, the image selection screen 100 is provided with a category area 102. The category area 102 is provided with different kinds of category buttons including an uncoated tablet button 102*a*, a user button 102*b*, and a clinical department button 102*c*. The image selection, screen 100 is further provided with as color/monochrome selection area 104, an image list display area 106, and a selected image display area 108. When any one of the different kinds of category buttons provided in the category area 102 is selected, a list of images registered for each category is displayed in the image list display area 106 based on the selected category button. When the image displayed in the image list display area 106 is then selected, the selected image is enlarged to be displayed in the selected image display area 108.

In the example of FIG. 8, the clinical department button 102*c* is selected, and a list of marks indicating clinical departments are displayed in the image list display area 106. In the image selection screen 100 of FIG. 8, the mark of a clinical department expected to be used for printing by a user of the drug packaging device 10 can be selected in advance. Specifically, as a conceivable application, it is possible that, at a hospital having, for example, three clinical departments of internal medicine, ophthalmology, and otolaryngology, the marks indicating those clinical departments are registered in advance for later use.

The color/monochrome selection area 104 is provided with a color image selection button 104*a* and a monochrome image selection button 104*b*. The color image selection button 104*a* and the monochrome image selection button 104*b* are each a button for selecting and registering whether to print the print items in color or in monochrome.

Figure 9:
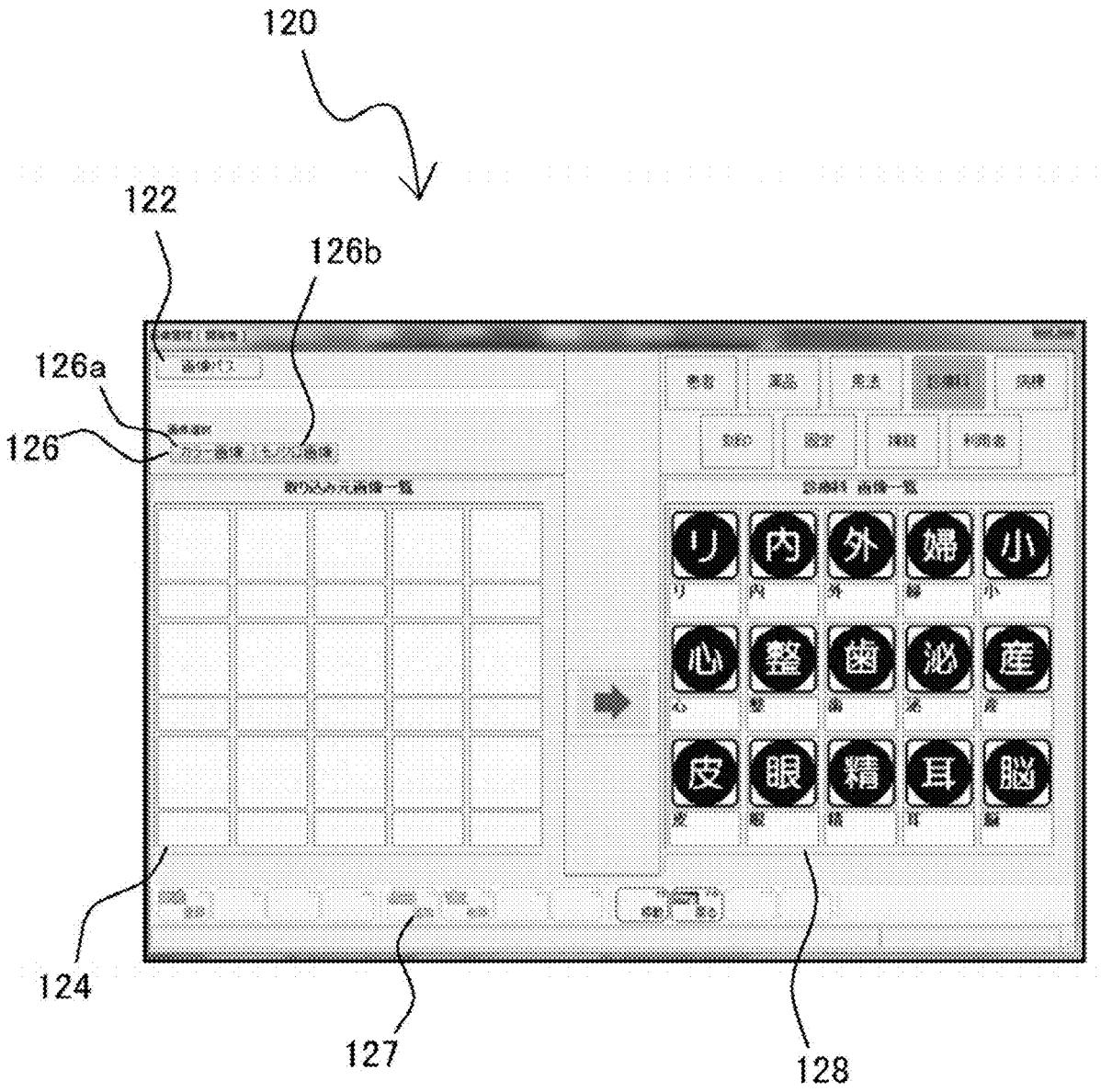
FIG. 9 is an illustration of a management screen for managing the image or the like for printing on the packaging paper.

FIG. 9 is an illustration of an example of the image selection screen 120. The image management screen 120 is an operation screen displayed, when image information to be used for printing is managed. For example, when registering the outer appearance image of a new drug, it is possible to designate a location (path) of image data by selecting an image path designation button 122 provided on the image management screen 120. A list of images existing at the location designated by the image path designation button 122 is displayed in an imported image list area 124. On the image management screen 120, it is possible to select, from the displayed list of images, an image wished to be registered as an image to be used for printing.

The image management screen 120 is further provided with a color/monochrome selection area 126. The color/monochrome selection area 126 is provided with a color image selection button 126*a* and a monochrome image selection button 126*b*. Through selection of any one of the color image selection button 126*a* and the monochrome image selection button 126*b* on the image management screen 120, it is possible to select whether the image selected as the image wished to be registered for printing on the image management screen 120 is to be registered, as a color image or to be registered as a monochrome image.

The image management screen 120 is provided with a registered image list area 128. The registered image list area 128 is an area for displaying a list of images that have been already registered as the images to be used for printing.

On the image management screen 120, it is possible to register the image to be used for printing by causing a list of registration candidate images existing at the path designated through use of the image path designation button 122 to be displayed in the imported image list area 124, selecting the image wished to be registered from the list, designating whether to import the image in color or in monochrome by the color/monochrome selection area 126, and then selecting an add button 127. The image that has been registered is moved from the imported image list area 124 to the registered image list area 128. In this manner, through use of the image management screen 120, it is possible to easily and intuitively perform work of newly adding the image to be used for printing.

<<Regarding Monochrome Image Viewing Function>>

The above-mentioned image selection screen 100 is provided with the color/monochrome selection area 104 as described above. When the color image selection button 104*a* is selected, different kinds of images are displayed in color on the display 72*a*, and when the monochrome image selection button 104*b* is selected, the different kinds of images are displayed in monochrome. In a case where the images are displayed in color by selecting the color image selection, button 104*a*, when a cursor is placed on the color image being displayed on the selected image display area 108, a picture box 110 for a monochrome image is displayed adjacent to the color image being displayed, and an image obtained by replacing the color image by the monochrome image is displayed. With this configuration, it is possible to easily confirm a print preview indicating how the color image appears after being switched to the monochrome image. In contrast to this, when, the cursor is placed on the monochrome image being displayed on the selected image display area 108 under a state in which the monochrome image selection button 104*b* is selected, the picture box 110 for a color image is displayed adjacent to the monochrome image being displayed, and an image obtained by replacing the monochrome image by the color image is displayed. With this configuration, it is possible to easily confirm a print preview indicating how the monochrome image appears after being switched to the color image.

<<Regarding Print Format>>

Figure 11:
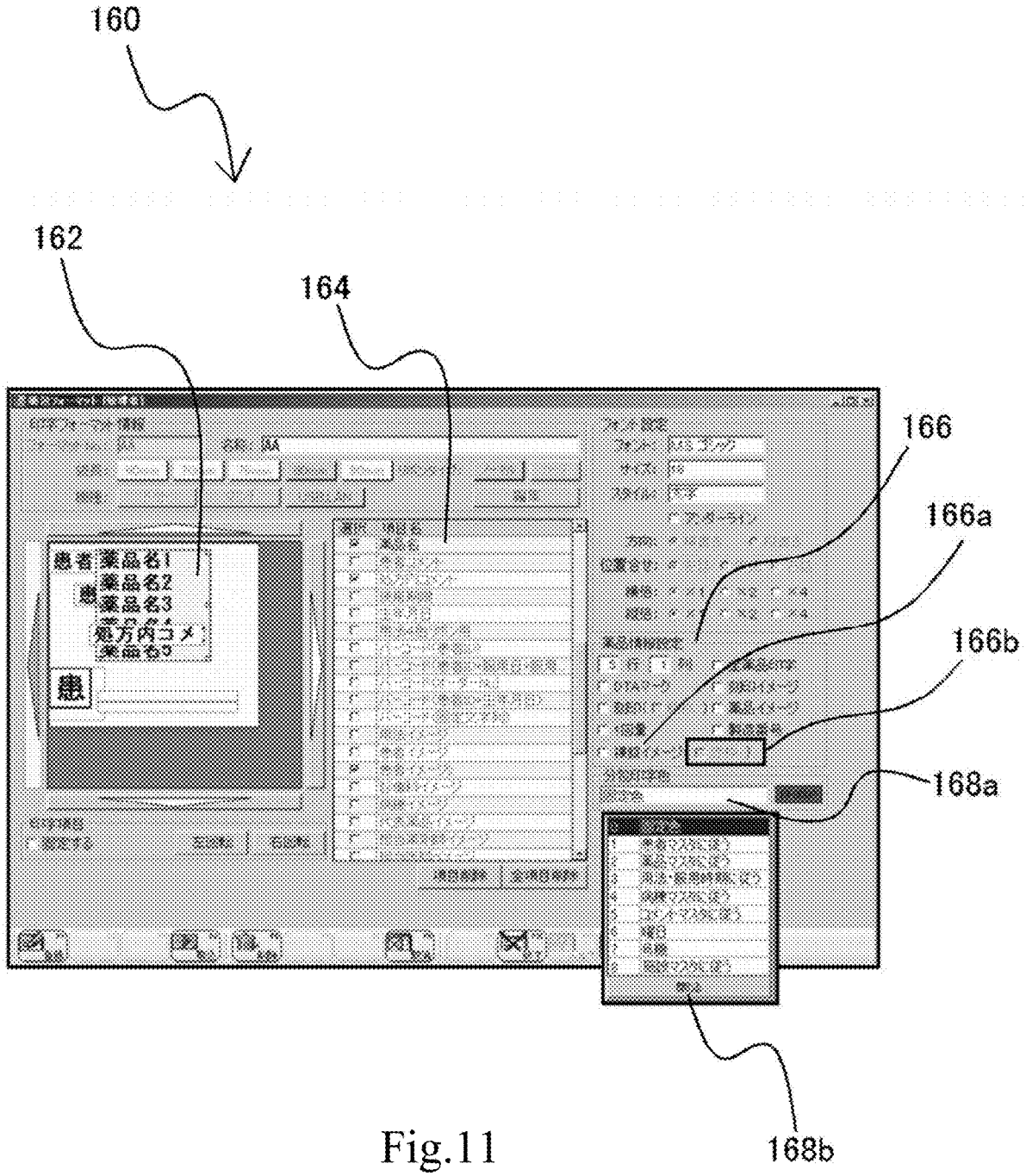
FIG. 11 is an illustration of a print format setting screen for performing printing on the packaging paper.

As described above, it is possible to set the print format for the packaging paper S by, for example, setting the print items in linkage with the databases including the different kinds of masters on the control device 70. FIG. 11 is an illustration of the print format setting screen 160 for determining a print layout or the like for the packaging paper S. The print format setting screen 160 is provided with a print layout setting part 162, an item list part 164, a drug information setting area 166, and a packaging print color setting part 168*a*. The drug information setting area 166 is provided with an uncoated tablet image checkbox 166*a* and a frame line setting checkbox 166*b*. As illustrated in FIG. 11, as the print items within the printing area on the packaging paper S, the name of the patient, a name of a drug, the pharmacist in charge, the time of administration, a photograph of the drug, and the like can be selected from the item list part 164 as the need arises. In order to print the drug image in the printing area on the packaging paper S, the uncoated tablet image checkbox 166*a* is selected. In order to further provide a frame line to the selected drug image, the frame line setting checkbox 166*b* is selected. The print format enables free layout setting suitable for drug package printing, test drug printing, or other such purpose of printing. In addition, the above-mentioned print color setting for each master can be selected by a master selection field 168*b* displayed below the packaging print color setting part 168*a*. The description of this embodiment is directed to a print format, screen relating to the drug package printing, but a print format for a test drug package or the like can be set appropriately.

<<Specific Operation Regarding Printing on Drug Package>>

Figure 12:
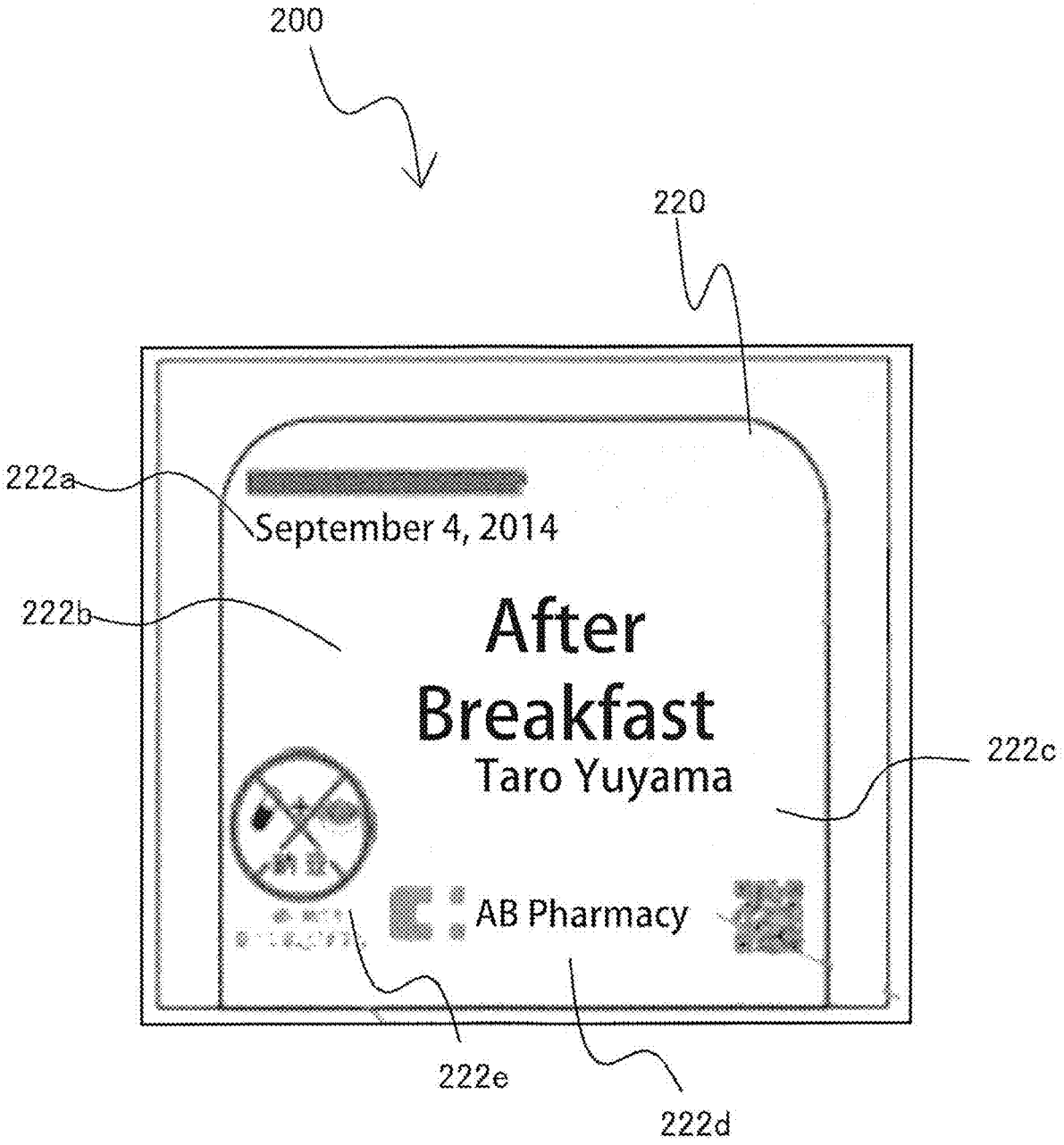
FIG. 12 is a front view for illustrating an example in which the printing is performed on a drug package envelope.

Next, a specific operation for using the drug packaging device 10 for the drug package printing is described with reference to the accompanying drawing. FIG. 12 is an illustration of one mode of a packaging bag 200 (packaging bag P) subjected to the printing through use of the drug packaging device 10. The drug prescribed by a doctor is packaged in the packaging bag 200. A date of administration 222*a*, a time of administration 222*b*, a name 222*c* of the patient, a name 222*d* of a pharmacy, an image 222*e*, a bar code 222*f*, and the like are printed in a drug package printing area 220 of the packaging bag 200.

The above-mentioned print items are printed on the packaging bag 200 in accordance with the setting including the print color registered in the different kinds of masters built on the recording device 74 or the like based on the prescription data transmitted from the host computer (not shown). Specifically; the date of administration 222*a*, the time of administration 222*b*, the name 222*c* of the patient, and the like are printed through use of the print items and the print, color that are registered in the master recorded on the recording device 74, for example, a facility-with-date/time-of-administration master, in advance through the print format setting screen 160.

It is possible to set, for the date of administration 222*a*, a color corresponding to the facility and the date/time (day of the week) to use the drug to be packaged. As described above, the print color for the day of the week set for each facility is set in advance in the facility-with-date/time-of-administration master. In addition, the print color is set based on the facility-with-time-of-administration master in the master selection field 168*b* on the print format setting screen 160. This can eliminate time and labor for, for example, referring to other materials each time a pharmacy or the like is to set the print color in response to a demand from the facility. In addition, when the packaged drug with the print color being changed for each date/time of administration is to be administered to the patient in the facility, identification by color is enabled, and it is expected to reduce erroneous administration of the drug with a wrong date/time.

In the example illustrated, in FIG. 12, the image 222*e* is displayed to issue a caution for the drug packaged in the packaging bag P against simultaneous administration of another specific drug, food, drink, or the like. In the example or FIG. 12, the caution is displayed by a so-called pictogram, to thereby allow the patient to intuitively grasp a matter warned in the caution. The image 222*e* may be, for example, a photograph of a face of the pharmacist in charge or a doctor in charge.

The drug packaging device 10 according to the present invention is capable of the color printing, and hence the bar code 222*f* can be printed not only by a one-dimensional or two-dimensional bar code printed in one color but also by a so-called three-dimensional bar code (multiplex multi-layer high-density three-dimensional code; color bar code). The capability of printing the three-dimensional bar code enables a large volume of data storage. With this configuration, in addition to the information printed on the packaging bag P as visually recognizable information, it is possible to add a wide variety of information including photograph information on the patient, the pharmacist, the doctor in charge, a nurse in charge, or the like.

As described above, when the drug image is to be printed in the printing area on the packaging bag P, it is possible to provide the frame line to the drug image by selecting the frame line setting checkbox 166*b*. With this configuration, it is possible to prevent the drug image printed on the packaging bag P from being confused with a real drug packaged in actuality. In particular, it is possible to suppress erroneous inspection through confirmation of distinction from an actual drug during the inspection after the packaging. The frame line may be printed on the packaging bag P in any color, but it is preferred to issue a caution by, for example, using a red color or other such color, a broken line, or the like.

<<Specific Operation Regarding Printing on Test Drug Package>>

Figure 13:
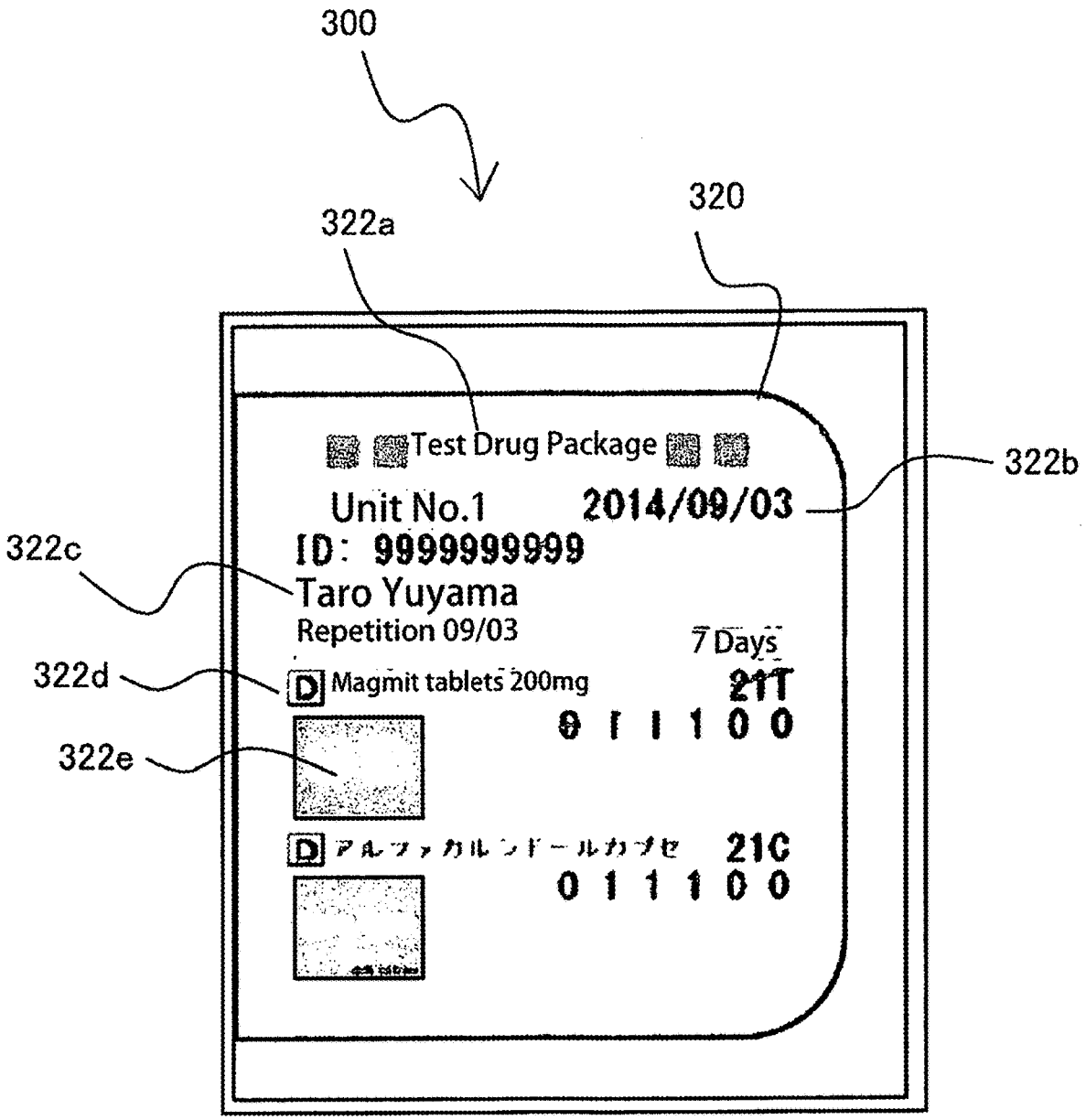
FIG. 13 is a front view for illustrating an example in which the printing is performed on a test drug package.

Next, an embodiment for using the drug packaging device 10 for a test drug package is specifically described with reference to the accompanying drawing. FIG. 13 is an illustration of one embodiment of a test drug package 300 obtained by performing the printing on the packaging paper S through use of the drug packaging device 10. The test drug package 300 is subjected to the printing in order to confirm whether or not the drug is contained as prescribed in each packaging bag P packaged by the drug packaging device 10. The test drug package 300 may be formed at any position in a continuous body for packaging bags, which is formed of a plurality of packaging bags P to have a band shape, but is generally formed at the first part or the last part of the continuous body for packaging bags. As illustrated in FIG. 13, a title 322*a* for indicating that the packaging bag is the test drug package 300, a prescribed date 322*b*, a name 322*c* of the patient, a name 322*d* of a drug, an image 322*e* of the drug, and the like are printed in a printing area 320 of the test drug package 300.

<<Example of Print Color Setting Based on Expiration Date of Drug>>

In addition to the above-mentioned setting of the print color to be used on the packaging bag P, the print color can be set based on an expiration date of the drug to be packaged when the information including the name of the drug is to be printed on the packaging bag P. For example, it is possible to perform various kinds of setting, for example, to print the information including the name of the drug in red when the expiration date of the drug is within 7 days since a prescribed date, in yellow when the expiration date is 14 days or more ahead, and in blue when the expiration date is 15 days or more ahead.

As described above, the drug packaging device 10 according to the present invention enables the printing of a freely selected layout or image relating to the print items on the packaging bag P, the selection of the print color for each of the print items, and the like, which cannot be achieved by printing performed on the packaging paper S by the related-art thermal transfer printer using an ink ribbon. Therefore, the print items and the print color can be set for each medical institution, and it is expected to effectively avoid erroneous distribution of the prescribed drug or erroneous administration with a wrong time of administration, <<Regarding Control of Ink>>

The drug packaging device 10 according to the present invention, employs the printing performed, by an ink-jet printer as described above. In ink-jet printing, black is generally used frequently, and hence only a black ink tends to be reduced faster. Therefore, the drug packaging device 10 according to the present invention may be controlled by the control program 76*b* to monitor a usage ratio among inks other than the black ink and to display black by mixing the inks other than the black ink with one another when the printing for displaying black is performed. Specifically, the drug packaging device 10 is controlled to periodically store or examine remaining amounts of the respective inks and to perform the black printing by multiplying three colors of cyan, magenta, and yellow other than black when it is predicted that there may be no great change in the remaining amounts of the inks other than black within a predetermined period.

<<Printing Switching Processing for Using Up Inks within Predetermined Period>>

As described above, in regard to the inks for the ink-jet printer, the usage ratio of black is generally high, and the black ink is liable to be used up faster than, the other inks. Further, in regard to the inks for the ink-jet printer, when left unused for a predetermined period or longer, the ink is separated into a component including a pigment and a component including a solvent, which raises the need, for stirring the ink. In addition, when the user of the drug packaging device 10 uses almost only black, a situation in which the inks other than the black ink are kept unused for a predetermined period or longer highly possibly occurs. Therefore, in performing the black printing, the drug packaging device 10 according to the present invention carries out a printing method (hereinafter also referred, to as "multi-color black printing") for performing the black printing by multiplying the colors other than black as described above to positively use the inks other than the black ink, which prevents the inks from being left, unused for a predetermined period or longer. That is, in a printing method (hereinafter also referred to as "normal printing") using only the black ink, the usage ratio among the respective colors is set to C:M:Y:K=0:0:0:1. Meanwhile, the usage ratio among the respective colors to be used, for performing the multi-color black printing is set to, for example, C:M:Y:K=17:17:11:4, and the inks other than the black ink are used more heavily.

Figure 14:
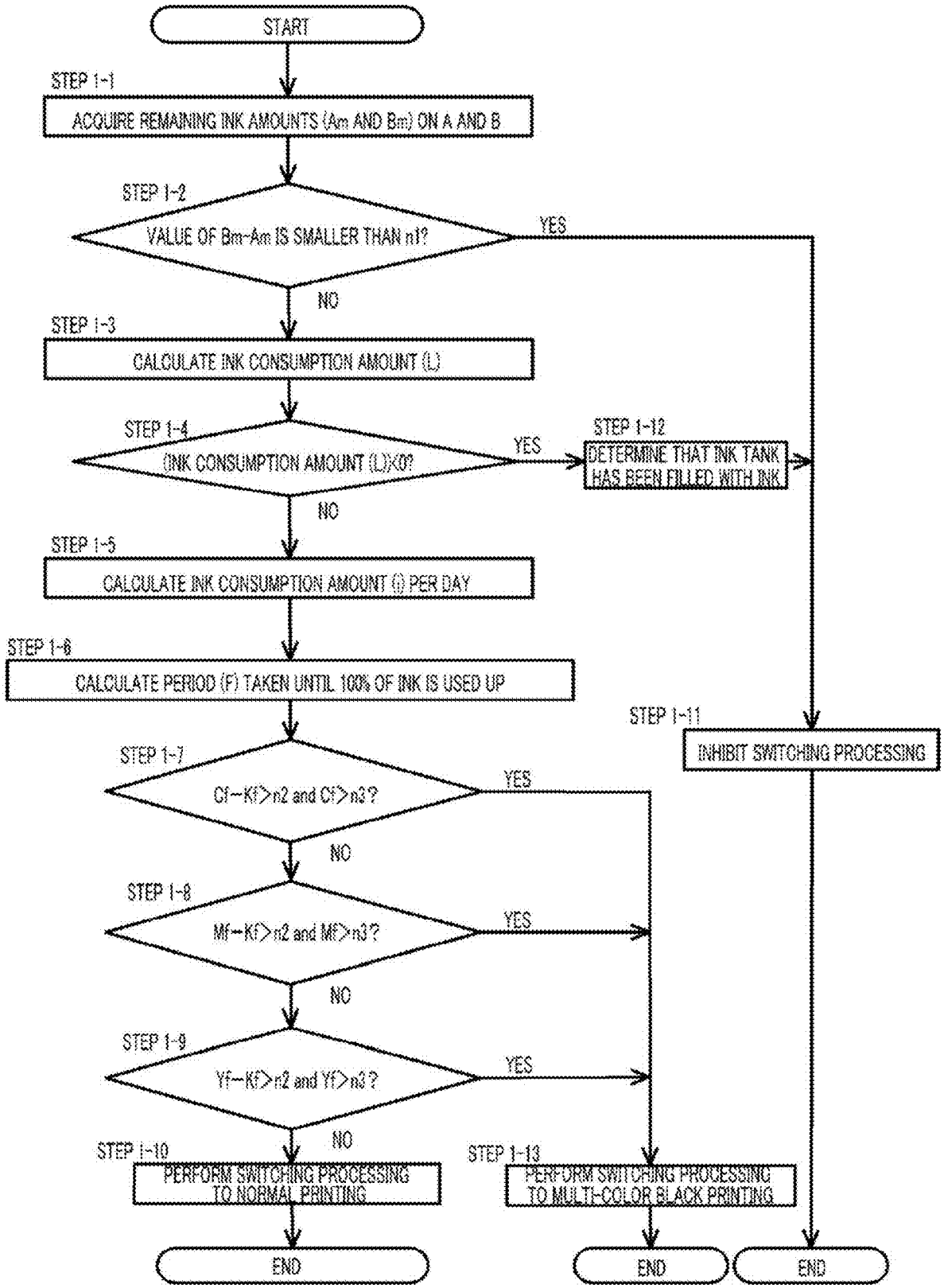
FIG. 14 is a flowchart relating to switching processing between normal printing and multi-color black printing.

The switching processing between, the normal printing and the multi-color black printing described above is performed based on, for example, a flow illustrated in FIG. 14. An operation relating to the above-mentioned series of switching processing to the multi-color black printing is described below in detail with reference to FIG. 14.

(Step 1-1)

In the control flow of FIG. 14, first, in Step 1-1, a selected year/month/day (reference year/month/day A) is freely set as a comparison target for a remaining ink amount, and a remaining ink amount (Am) of each of colors (CMYK) on the reference year/month/day A and a remaining ink amount (Bm) of each of the colors on a current year/month/day (current year/month/day B) are acquired. As a numerical value of the remaining ink amount, an actually remaining volume can be used, but a numerical value (remaining ratio) indicating a ratio of the remaining ink to 100 may also be used assuming that the remaining ink amount is 100 when the ink tank is full.

(Step 1-2)

In Step 1-2, a difference (Bm−Am) between the remaining ink amount (Bm) of each color on the current year/month/day B and the remaining ink amount (Am) on the reference year/month/day A is calculated to determine whether or not the difference (Bm−Am) is smaller than a predetermined value (n1) set in advance. The predetermined value n1 can be freely set. When the difference (Bm−Am) is equal to or larger than the predetermined value (n1), the control flow is advanced to Step 1-3 described later, and when the difference (Bm−Am) is smaller than the predetermined value (n1), the control flow is advanced to Step 1-11 described later.

(Step 1-3)

In Step 1-3, an ink consumption amount L is calculated from the difference between the remaining ink amounts on the reference year/month/day A and the current year/month/day B, that is, the value of [Bm−Am]. A numerical value of the ink consumption amount L may be an actual usage amount, or may be a numerical value indicating a ratio of the ink that has been consumed to 100 assuming that the remaining ink amount is 100 when the ink tank is full.

(Step 1-4)

In Step 1-4, it is determined whether or not the ink consumption amount L has a value smaller than 0. When the ink consumption amount L has a value smaller than 0, it is determined that the ink tank has been filled with ink, and the control flow is advanced to Step 1-11. Meanwhile, when it is determined that the ink consumption amount L has a positive value, the control flow is advanced to Step 1-5.

(Step 1-5)

In Step 1-5, an ink consumption amount i per day is calculated. A numerical value of the ink consumption amount i is not limited to the actual ink usage amount, and may be the numerical value indicating a ratio of the ink that has been consumed to 100 assuming that the remaining ink amount is 100 when the ink tank is full. The ink consumption amount i per day can be calculated by [(ink consumption amount L)/((current year/month/day B)−(reference year/month/day A))]. After that, the control flow is advanced to Step 1-6.

(Step 1-6)

In Step 1-6, in Step 1-6, a period (ink remaining period F) taken until 100% of ink is used up is calculated based on the ink consumption amount i per day. The ink remaining period F can be calculated by [100/(ink consumption amount i per day)]. After that, the control flow is advanced to Step 1-7 to Step 1-9 described later in detail, and a relationship between ink remaining periods of black (K) and each of the other colors (CMY) is determined.

(Step 1-7)

In Step 1-7, it is determined whether or not a value obtained, by subtracting an ink remaining period (Kf) of black from an ink remaining period (Cf) of cyan is equal to or larger than a predetermined period n2 set in advance for the remaining period of the black ink and the remaining period of a cyan, ink is equal to or larger than a predetermined period n3 set in advance. When those conditions are not satisfied, the control flow is advanced to Step 1-8, and when the conditions are satisfied, the control flow is advanced to Step 1-13.

(Step 1-8)

In the same manner, in Step 1-8, it is determined whether or not a e obtained by subtracting the ink remaining period (Kf) of black from an ink remaining period (Mf) of magenta is equal to or larger than the predetermined period n2 and the remaining period of a magenta ink is equal to or larger than the predetermined period n3 set in advance. When those conditions are not satisfied, the control flow is advanced to Step 1-9, and when the conditions are satisfied, the control flow is advanced to Step 1-13.

(Step 1-9)

Further, in Step 1-9, it is determined whether or not a value obtained by subtracting the ink remaining period (Kf) of black from an ink remaining period (Yf) of yellow is equal to or larger than the predetermined period n2 and the remaining period of a yellow ink is equal to or larger than the predetermined period n3 set in advance. When those conditions are not satisfied, the control flow is advanced to Step 1-10, and when the conditions are satisfied, the control flow is advanced to Step 1-13.

(Step 1-10)

A case in which the control flow is advanced to Step 1-10 is a case in which a difference between the remaining period of the ink of each color other than black and the remaining period of the black ink is smaller than the predetermined period n2 and the remaining period of the ink of each color is smaller than the predetermined period n3 set in advance (case of NO in each of Step 1-7 to Step 1-9). In this case, the inks other than the black ink do not need to be positively used, and hence the switching processing to the normal printing is performed. With this operation, the series of flow is brought to an end.

(Step 1-11)

A case in which the control flow is advanced to Step 1-11 is a case in which it is determined in Step 1-2 that the difference (Bm−Am) between the remaining ink amount (Bm) of each color on the current year/month/day B and the remaining ink amount (Am) on the reference year/month/day A is smaller than the predetermined value (n1; (YES in Step 1-2) or in which it is determined that the ink consumption amount L has a value smaller than 0 and that a cartridge is replaced by a new one (YES in Step 1-4). In this case, the series of control flow is completed without the printing method being switched.

(Step 1-12)

A case in which the control flow is advanced to Step 1-12 is a case in which a difference between, the remaining period of the ink of each color other than black and the remaining period of the black ink is equal to or larger than the predetermined period n2 or in which the remaining period of the ink of each color is equal to or larger than the predetermined, period n3 set in advance (YES in any one of Step 1-7 to Step 1-9). In this case, the remaining amount of the ink other than the black ink is large, and it is preferred to positively use the inks other than the black ink. In view of this, in Step 1-12, the switching processing to the multi-color black printing is performed. With this operation, the series of flow is brought to an end.

In the above-mentioned control flow, the relationships between the ink remaining periods of black (K) and the other respective colors (CMY) are sequentially determined, for the respective colors in the stated order in Step 1-7 to Step 1-9, but the present invention is not limited thereto. That is, the order of determining the relationships between the ink remaining periods of black (K) and the other respective colors (CMY) may be changed appropriately. In another case, the determination of the relationships between the ink remaining periods of black (K) and the other respective colors (CMY) may be performed, collectively in a single step instead of being carried out separately in three steps.

Figure 15:
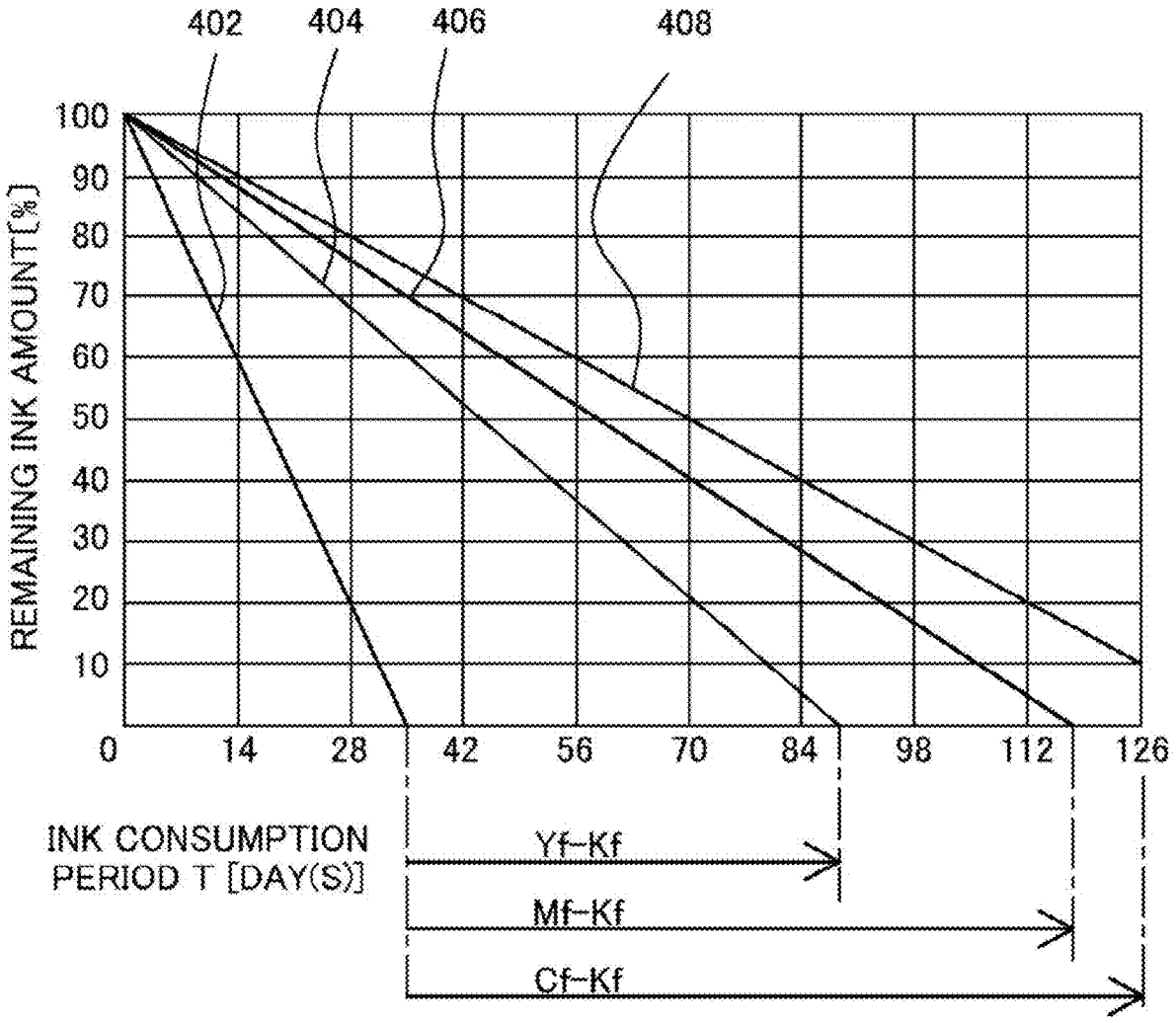
FIG. 15 is a graph for showing a relationship between a remaining ink amount and an ink remaining period.

FIG. 15 is a graph for showing the relationship between the remaining ink amount and the ink remaining period. The vertical axis represents the remaining ink amount in percentage (%), and the horizontal axis represents the ink remaining period. In FIG. 15, reference numeral 402, reference numeral 404, reference numeral 406, and reference numeral 408 denote decrease tendencies of the inks of black (K), yellow (Y), magenta (M), and cyan (C), respectively. In the example shown in FIG. 15, the black ink remaining period (Kf) is about 35 days, while the yellow ink remaining period (Yf) is about 90 days, the magenta ink remaining period (Mf) is about 119 days, and the cyan ink remaining period (Cf) is about 126 days or longer. For example, when the predetermined, period n2 and the predetermined period n3 described above are set to 0 and 60 days, respectively, the case shown in FIG. 15 satisfies the respective conditions in Step 1-7, Step 1-8, and Step 1-9 of the flowchart of FIG. 14. Therefore, in the case of FIG. 15, the switching processing to the multi-color black printing is performed.

The above-mentioned switching processing to the multi-color black printing that uses a print format that rarely uses black enables the inks other than the black ink to be used up within a predetermined period when the printing is repeatedly performed on the S. In addition, the situation in which the ink is kept unused for a predetermined period or longer is avoided, to thereby be able to inhibit a constituent including an ink pigment and a constituent including a solvent from being separated from each other.

<<Method of Calculating Quantity that can be Packaged Based on Remaining Ink Amount>>

When a quantity that can be packaged can be calculated from the remaining ink amount with high precision, it is possible to use up the ink to the last as much as possible. In addition; such calculation contributes to reduction in the number of times that the user at work changes the ink and also reduction of a loss of ink. Therefore, the drug packaging device 10 is desired to predict the quantity that can be packaged with the current remaining ink amount.

In view of this, in a case of the related-art thermal transfer printing using an ink ribbon, the remaining amount of the ink ribbon can be calculated from a packaging size, and hence it is possible to calculate a remaining quantity that can be packaged from the remaining amount of the ink ribbon. However, the drug packaging device 10 performs the ink-jet printing, and hence the print format set by the user has a wide variety of contents, which means that an ink usage amount per package differs depending on the user. Therefore, it is difficult to predict how many packages can be subjected to the packaging only from the remaining amount of the ink. In view of this, the drug packaging device 10 is configured to constantly monitor a quantity of packages subjected to the packaging in actuality and a decrease amount of the ink, and when the remaining amount of the ink decreases to reach a fixed value, predict a remaining number of packages that can be subjected to the packaging by a theoretical value.

Figure 16:
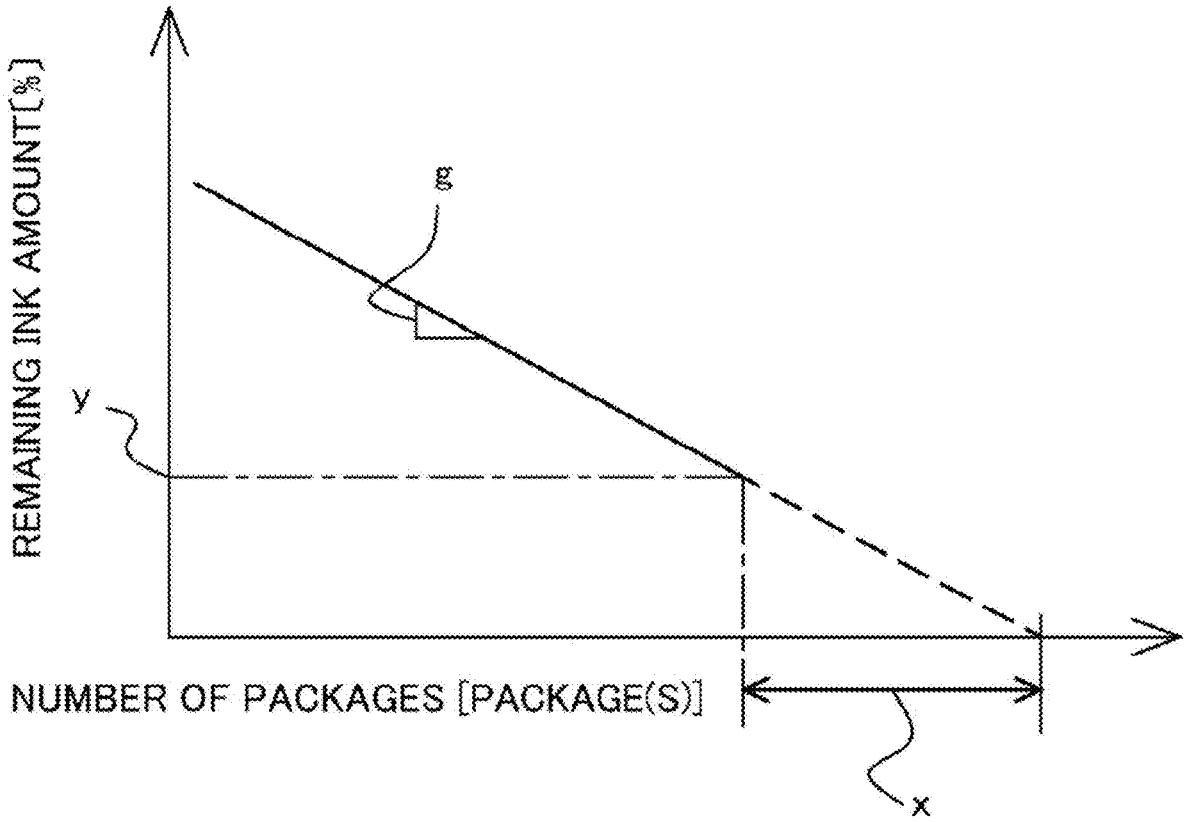
FIG. 16 is a graph for showing a relationship between the remaining ink amount and a quantity of packages.

Specifically, as shown in FIG. 16, am inclination, g (decrease tendency index) indicating a decrease tendency of the ink is calculated from a relationship between the remaining ink amount and the quantity of packages. When the remaining ink amount becomes a predetermined value y, the number x of packages that can be subjected to the printing with the current remaining ink amount is calculated based on the inclination g. The inclination g differs depending on a size of the packaging paper S or the print format. Therefore, even when the ink usage amount per package differs depending on the user, the inclination g corresponding thereto can be used to calculate the number x of packages that can be subjected to the printing with the remaining ink. When the user continuously performs printing on the packaging paper S through use of the same format, the same color is used frequently. In another case, when several kinds of print formats are repeatedly printed, specific colors are repeatedly used as in "red, blue, yellow, red, blue, and yellow". A usage pattern of those specific colors that differs depending on the user can also be predicted in advance. Therefore, the inclination g is calculated in consideration of a pattern of a frequency of usage of colors, which differs depending on the user, and the number x of packages that can be subjected to the packaging is predicted from the current remaining ink amount with high precision. As a result, the ink can be used up to the last as much as possible, which suppresses a loss of ink to a minimum, and it is also possible to suppress the number of times that the user at work changes the ink to a minimum.

In addition to the above-mentioned effect, it is possible to suppress exhaustion of ink by applying so-called outline setting to the printing method. The outline setting is print setting for performing printing so that a printing density for an area surrounded by a contour line becomes lower than a printing density of the contour line that forms print information including a character or a symbol to be printed. More specifically, the outline setting is print setting for performing printing by minute dots or hatching instead of performing solid printing in the case of performing the ink-jet printing. With this configuration, the ink usage amount can be saved.

<<Timing for Head Cleaning>>

As the printing unit 60 of the drug packaging device 10, an ink-jet printer is employed as described above. The ink-jet printer is configured to perform head cleaning or other such maintenance operation at a predetermined timing in order to prevent, for example, insufficient ink ejection due to dirt on the nozzle 64. The head cleaning may be performed at any timing, but the printing unit 60 is desired to be controlled so as to perform the head cleaning through use of a timing between prescriptions, that is, a timing at which the packaging is not performed. By performing such control, it is possible to suppress a time loss in the head cleaning, and to effectively use an empty package part, which is formed between the last package formed in preceding packaging processing and the first package formed in succeeding packaging processing, for the head, cleaning.

<<Drying Suppression Operation>>

When the drug is continuously packaged by the drug packaging device 10 according to this embodiment, the drug to be packaged is supplied from the cassette 22 as described above. Therefore, the nozzle 64 does not eject ink during a predetermined time period after one package of the drug starts being supplied until the drug finishes being supplied. When the nozzle 64 dries, clogging occurs therein to cause, for example, the insufficient ink ejection. Therefore, the drug packaging device 10 according to the present invention is desired to be provided with a drying prevention member, for example, a cap (not shown) attachable to the ink election unit 62 and to be controlled so as to perform an operation (hereinafter also referred to as "drying suppression operation") for protecting the nozzle 64 against the drying at a timing when the nozzle 64 does not eject ink through use of the drying prevention member when the drug does not finish being supplied from the cassette 22 within a predetermined time period after the printing is carried out. The predetermined time period taken after the printing is carried our until capping is executed differs depending on device characteristics of the printing unit 60, a viscosity of the ink, an indoor environment, and the like, and is desired to be set within 3 seconds to 10 seconds. When a large number of drug tablets are supplied from the cassette 22 for one package, an interval between the preceding printing and the succeeding printing is long, and hence the printing unit 60 is desired to be controlled so as to perform the drying suppression operation on the ink ejection unit 62 immediately after the printing on the packaging paper S is finished.

<<Improvement in Paper Roll Resistance Control>>

Figure 17:
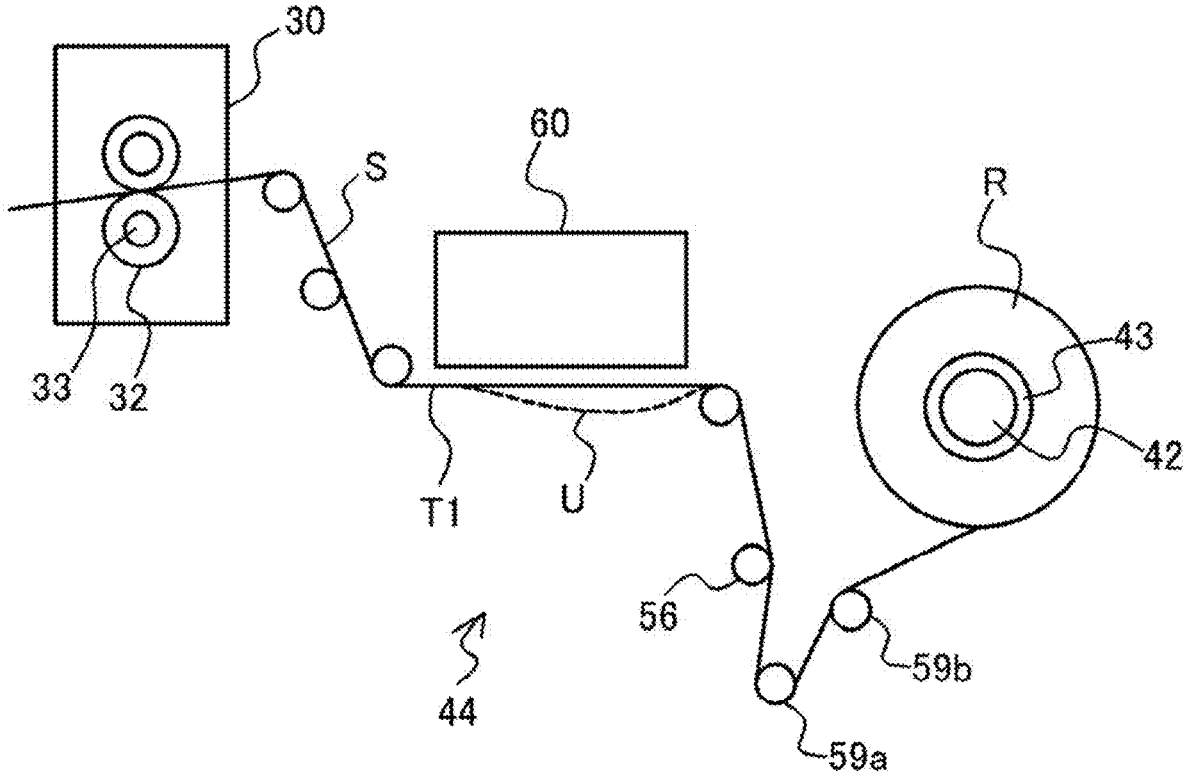
FIG. 17 is a schematic diagram for illustrating a flow of the packaging paper in the drug packaging device.

Next, paper roll resistance control of the roll setting unit 42 is described with reference to the accompanying drawings. FIG. 17 is a schematic diagram for illustrating a flow of the packaging paper S in the drug packaging device 10. As illustrated in FIG. 17, the paper roll R formed of the packaging paper S having a roll shape is set in the roll setting unit 42.

The roll setting unit 42 includes a motor 43 (braking unit) configured to apply a braking force to the paper roll R. It is possible to adjust a level of the braking force (paper roll resistance) exerted on the paper roll R by adjusting output from the motor 43. Specifically, an applied voltage to be exerted on the motor 43 is changed to adjust the braking force (paper roll resistance) based on an analog output signal output from the control device 70 to be used for the paper roll resistance control.

The packaging unit 30 includes a pair of heater rollers 32 and 32 and motors 33 and 33 (drive unit). The packaging unit 30 uses the motor 33 to rotate each of the heater rollers 32 and 32 to pass the packaging paper S folded in two between the heater rollers 32 and 32, and can thereby seal the packaging paper S to form a packaging bag. While sheet feeding of the packaging paper S is in execution, an operation for sealing the packaging paper S is performed by the heater rollers 32 and 32. Meanwhile, while the sheet feeding of the packaging paper S is stopped, the printing on the packaging paper S is carried out by the printing unit 60. While the packaging paper S is being pulled and conveyed by the heater rollers 32 and 32, a paper roll resistance is applied to the packaging paper S by the motor 43 of the roll setting unit 42, to thereby be able to exert a fixed tensile force on the packaging paper S.

Figure 18:
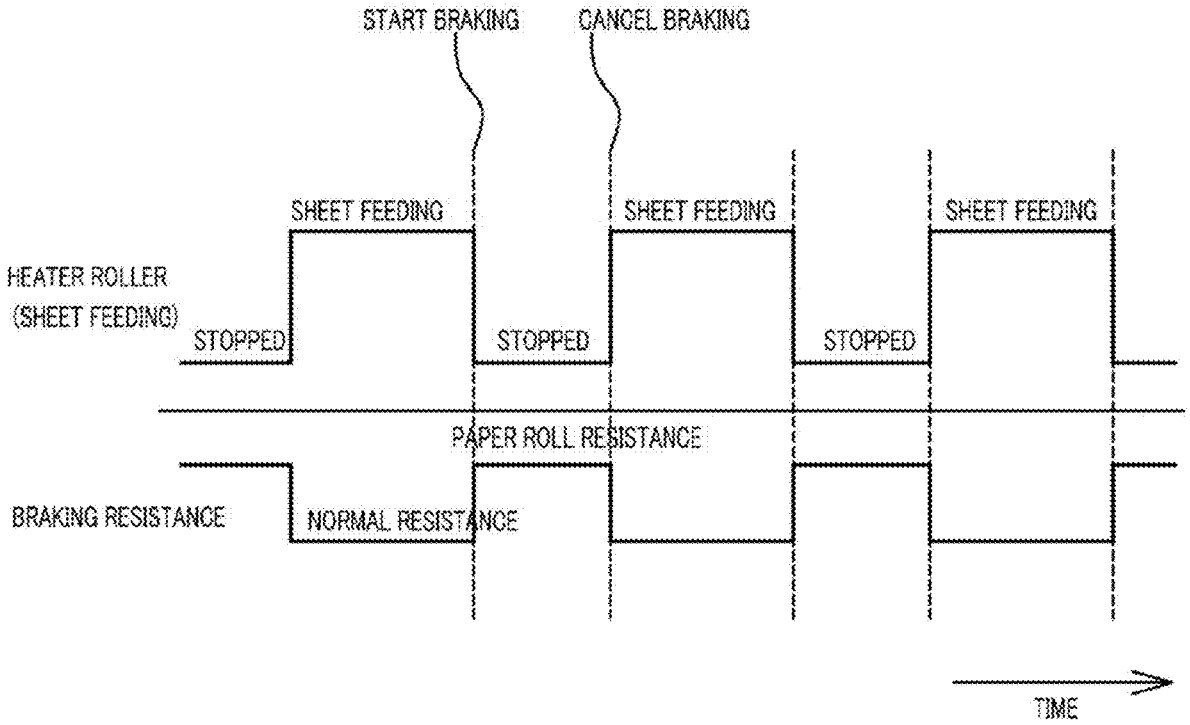
FIG. 18 is an illustration of timings of sheet feeding at a heater roller and a paper roll resistance of a roll setting unit.

In FIG. 18, a relationship between the timing for the sheet feeding of the heater rollers 32 and the paper roll resistance exerted on the roll setting unit 42 is illustrated in time series. As illustrated in FIG. 18, the paper roll resistance of the roll setting unit 42 is controlled so as to become a normal resistance at the same time when the sheet feeding of the packaging paper S starts. With this configuration, at a time of packaging, the packaging paper S is conveyed with a relatively low tensile force. Meanwhile, the paper roll resistance of the roll setting unit 42 is controlled so as to be raised to increase the braking force at the same time when the sheet feeding is stopped. Therefore, when the printing is performed on the packaging paper S, a sufficient tensile force can be applied to the packaging paper S.

As described above, the paper roll resistance is controlled based, on an analog output method. Therefore, compared with control based on the PWM method, it is possible to suppress such a time lag in a breaking stopping signal as exhibited in the case of employing the PWM method. It is also possible to handle a steep change in voltage for raising the paper roll resistance.

Figure 19A:
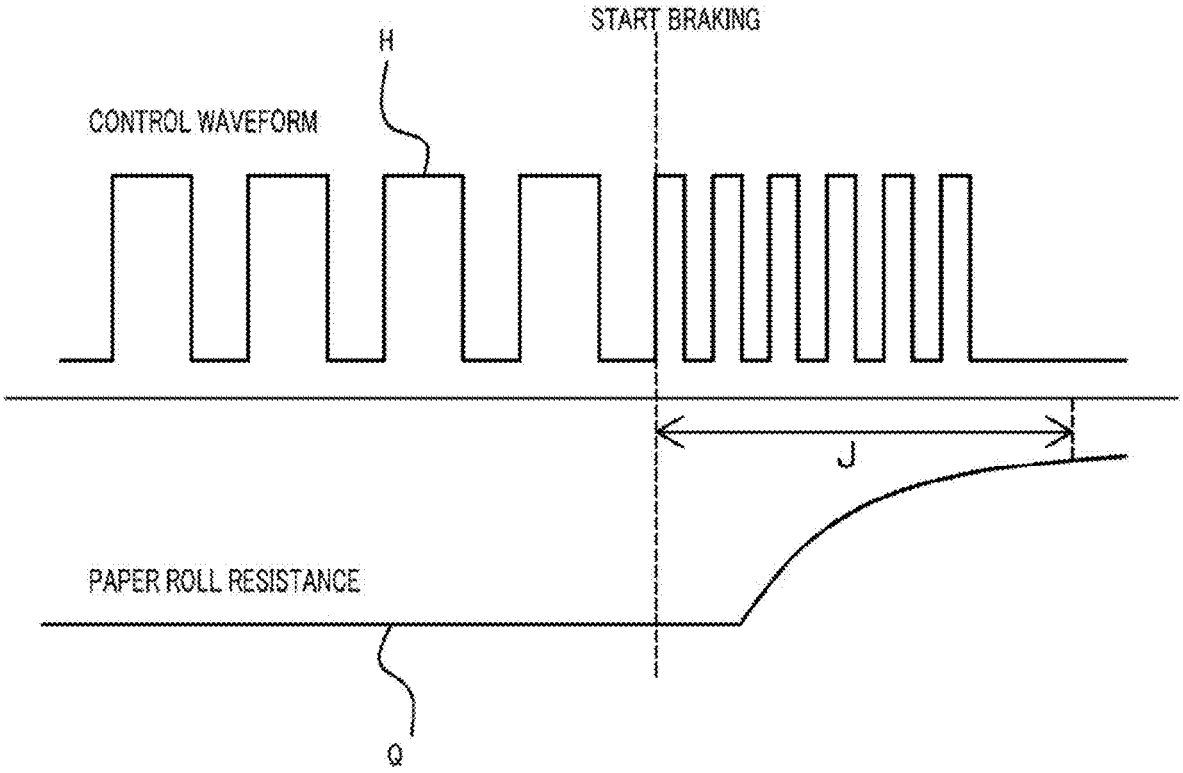
Figure 19B:
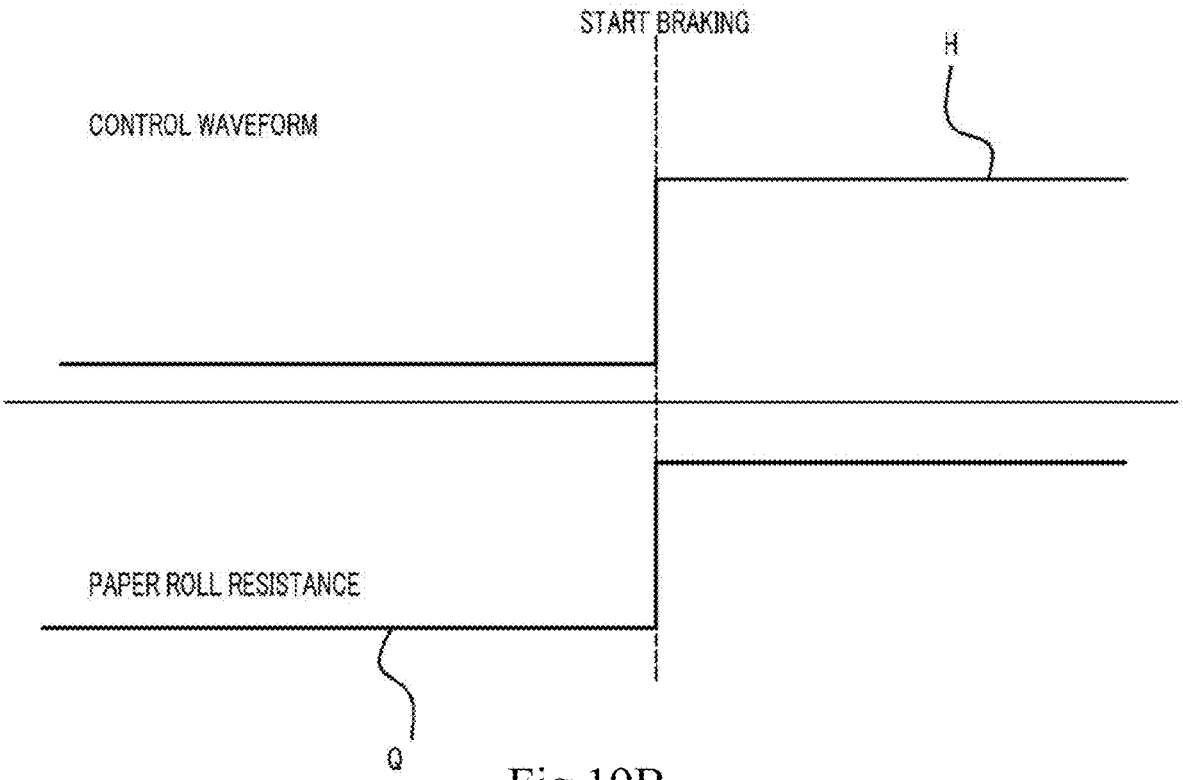
Figure 20A:
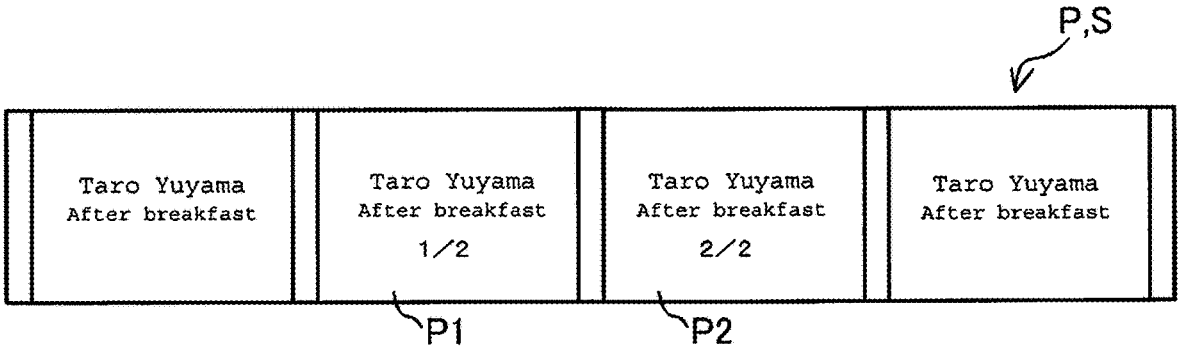
FIG. 20(*a*) is an illustration of an example of performing the printing on packaging bags relating to a related-art divided drug package, FIG. 20(*b*) is an illustration of an example in which a divided drug package identification line is printed on the packaging bags relating to the divided drug package, and FIG. 20(*c*), FIG. 20(*d*), and FIG. 20(*e*) are each an illustration of a modification example of FIG. 20(*b*).
Figure 20B:
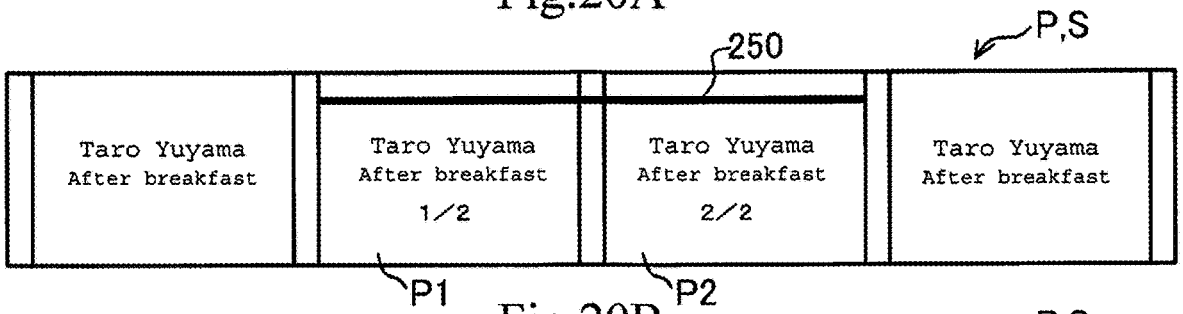
Figure 20C:
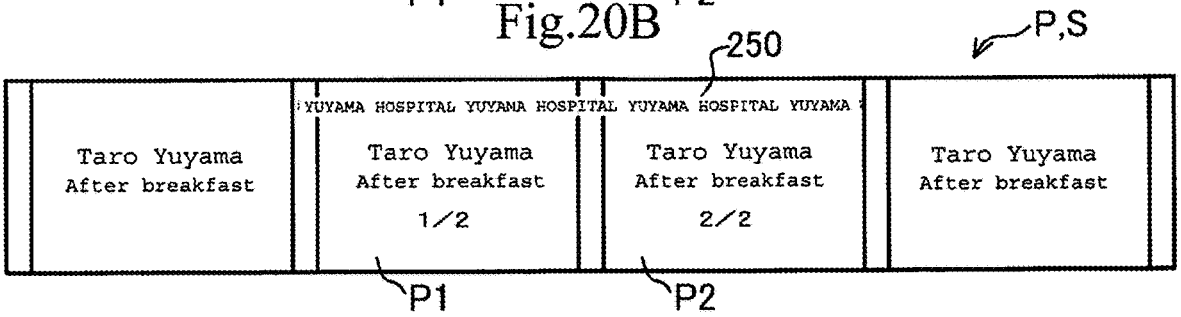
Figure 20D:
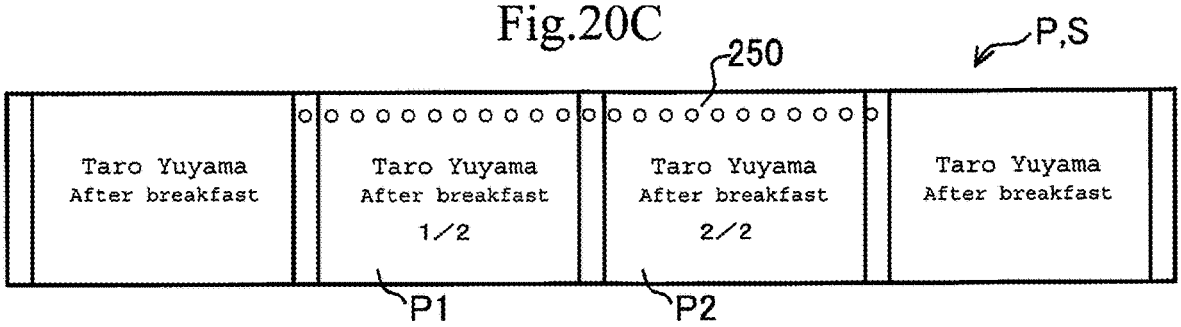
Figure 20E:
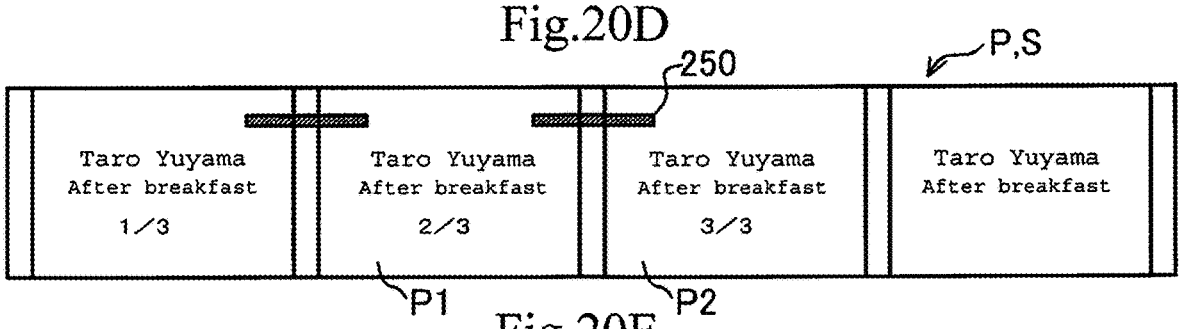

When the control based on the PWM method and the control based on the analog output method that are described above are compared with each other for consideration, the following results are obtained. FIG. 19(*a*) is an illustration of a control waveform output from the control device 70 and the paper roll resistance of the roll setting unit 42 when the PWM method is employed. H represents a waveform, of a pulse signal output from the control device 70, and Q represents a voltage of the paper roll resistance. As illustrated in FIG. 19(*a*), when a control method based on the PWM method is employed, a predetermined time period J is required until a desired pulse width is obtained and the paper roll resistance becomes a braking resistance (until the breaking is completed). The paper roll R rotates under inertia while the predetermined time period J elapses until the breaking of the roll setting unit 42 is completed. Therefore, as indicated by the broken line in FIG. 17, the packaging paper S supplied while the time period J elapses exhibits slack U in the intersecting-direction conveyance section T1.

Meanwhile, FIG. 19(*b*) is an illustration of a control waveform output from the control device 70 and the paper roll resistance of the roll setting unit 42 when the control based on the analog output method is employed. After an output signal is received from the control device 70, there is almost no time lag until the paper roll resistance reaches a level required for stopping the rotation of the paper roll R. Therefore, by employing the control based on the analog output method, it is possible to suppress the time lag corresponding to the time period J, which occurs when the PWM method is employed.

By thus controlling the motor 43 of the roll setting unit 42 by the analog output method, it is possible to perform the control in real time while suppressing the time lag with respect to the operation of the heater rollers 32. Therefore, it is possible to inhibit the paper roll R from rotating under inertia after a sheet feeding operation is stopped and causing an excess part of the packaging paper S to be supplied and to exhibit slack in the intersecting-direction conveyance section T1, which can contribute to high print quality. Meanwhile, during execution of the sheet feeding (during the packaging), the paper roll resistance of the roll setting unit 42 can be reduced, which can avoid a problem that the packaging paper S is wrinkled or shrunk in size. That is, high quality can be achieved for both the packaging quality and the print quality when the packaging paper S is sealed.

<<Prevention of Fluttering of Packaging Paper Sheet at Time of Printing>>

As described above, the drug packaging device 10 ensures a sufficient tensile force for the packaging paper S in the intersecting-direction conveyance section T1 in order to obtain stable printing quality for the packaging paper S. In order to ensure the printing quality for the packaging paper S, it is possible not only to apply a tensile force to the packaging paper S in this manner but also to suck and hold the packaging paper S by a suction device. Specifically, the suction device may be provided so as to be located near a back surface of a printing surface of the packaging paper S positioned below the printing unit 60 in the intersecting-direction conveyance section T1. The suction device is configured to suck the packaging paper S from the back surface of the printing surface of the packaging paper S while the printing is performed on the packaging paper S. With this configuration, the packaging paper S is positioned in the intersecting-direction conveyance section T1 while being stably held, at the time of the printing, and it is possible to suppress bending, slack, and fluttering of the packaging paper S when the printing is performed and to perform the printing with stability.

<<Utilization Regarding Printing of Drug Information>>

In general, a pharmacy or the like provides printed matters obtained by printing the information relating to the prescribed drug, for example, the information including the name of the drug and the photograph of the drug, by a printer or the like to a patient together with a prescription for dispensing a drug for the patient. Even when the drug prescribed for the patient is only the packaged drug, it is assumed that those kinds of drug information on the prescription are separately printed, by the printer or the like to be provided to the patient. In such a case, the pharmacist or the like needs to compare the drug to be packaged with those printed matters to examine, for example, whether or not the drug has been prescribed for the relevant patient.

As described above, the drug packaging device 10 according to one embodiment of the present invention employs an ink-jet printing method. Therefore, a photographic image of the drug or the like can be printed on the packaging paper S. According to the drug packaging device 10, it is possible to print the information on the drug to be packaged on one or a plurality of empty packages of the packaging paper S in which no drug is packaged, and to provide the patient with the empty package of the packaging paper S on which those pieces of drug information are printed instead of the drug information printed by the printer or the like. With this configuration, the work for separately preparing the above-mentioned printed matters obtained by the printer or the like is alleviated. In addition, a workload imposed on the pharmacist or the like for performing comparison as to, for example, whether or not the drug information printed on those printed matters matches the drug to be packaged and whether or not the drug has been prescribed for the relevant patient is alleviated.

When the photographic image of the drug to be packaged is allowed to be printed on the empty package as described above, the print style is desired to be selectable appropriately. Specifically, a layout to be used when the photographic images of drugs are printed may be allowed to be changed by the user setting the number of columns and the number of rows. When a dosage of the prescribed drug differs depending on the time of administration (in a case of an irregular dosage), the photographic image of the drug may be printed by being distinguished for each time of administration. When the dosage is the same irrespective of the time of administration (in a case of a regular dosage), the photographic image of the drug may be printed without being distinguished for each time of administration. Specifically, in a case where the drugs are to be administered three times around breakfast time, lunch time, and supper time, when the dosage differs among the three times around breakfast time, lunch time, and supper time, the photographic image of the drug to be administered around breakfast time, the photographic image of the drug to be administered around lunch time, and the photographic image of the drug to be administered around supper time may be printed by being distinguished from one another. Meanwhile, when the dosage is the same among the three times around breakfast time, lunch time, and supper time, the photographic image of the drug to be administered at each time of administration may be printed without being distinguished among breakfast time, lunch time, and supper time. In addition, in the case of the irregular dosage, the photographic image of the drug may be printed for each time of administration in ascending order of the time of administration.

As the print style used for printing the photographic image of the drug, it is possible to employ various kinds of methods other than the above-mentioned method. Specifically, the printing may be enabled in the print style, for example, a method of printing the photographic image after the printing of character information (hereinafter also referred to as "drug character information") including the name of each drug or a method of collectively printing the photographic images of the respective drugs after collectively printing the drug character information on the respective packaged drugs. In the method of collectively printing the photographic images of the respective drugs, it is possible to employ a method of collectively printing the photographic images of the respective drugs irrespective of the time of administration, a method of classifying the photographic images of the respective drugs by the time of administration before the printing, or other such methods. In addition, a display style for enabling the photographic image of the drug and the real packaged drug to be easily distinguished from each other. Specifically, it may be possible to employ the print style for enabling the photographic image and the real drug to be easily distinguished from each other by, for example, surrounding the photographic image of the drug with the frame line. By enabling those print styles to be selected or combined appropriately, it is possible to perform the printing in the print style suitable for the user's purpose or intention, which improves usability.

The packaging paper S to be used in the above-mentioned drug packaging device 10 may be formed of any material, but it is desired to select an optimal material in consideration, of deposition of ink, color development, and the like because the ink-jet printer is employed as the printing unit 60. Specifically, the packaging paper S is desired to be provided with a receiving layer suitable for receiving ink on a surface of a film made of a resin, a paper sheet, or other such sheet material used as a base material. More specifically, the receiving layer is preferred to contain at least one kind of cationic water-soluble polymer within an ink-receiving layer provided within the base material or on the base material. More specifically, a compound of a cationic polymer and a polyallylamine derivative or the like can be suitably used as the receiving layer.

<<Printing of Line on Drug Package in Relation to Drug Package Dividing Processing>>

Next, processing (drug package dividing processing) for packaging drugs to be administered simultaneously by dividing the drugs into a plurality of continuous packaging bags and an operation based, on the drug package dividing processing are described. When the drugs are packaged, by being divided into a plurality of packaging bags by the drug package dividing processing, it is desired to add identification information indicative of division numbers to the packaging bags in order to prevent a patient from forgetting to take the drug or from other such viewpoint. Specifically, it is desired that, when the drug package dividing processing is performed for, for example, two packages, "1/2" and "2/2" be printed on the respective packaging bags to enable the packaging bags to be identified as a series of packaging bags relating to the drug package dividing processing (see FIG. 20(*a*)).

In addition to or instead of the above-mentioned description of the division numbers in the form of characters or the like, a line or other such identification information (divided drug package identification information) may be added across the packaging bags relating to the drug package dividing processing. Specifically, as illustrated in FIG. 20(*b*), on packaging bags P1 and P2 relating to the drug package dividing processing, a divided drug package identification line 250 (divided drug package identification information) to be printed across the packaging bags P1 and P2 may be printed simultaneously with the printing of the division numbers (for example, 1/2 and 2/2).

As illustrated in FIG. 20(*b*), the divided drug package identification line 250 (divided drug package identification information) is set as a line extending in the conveyance direction of the packaging paper S. FIG. 20(*b*) is an illustration of an example of the packaging bags P having the divided drug package identification line 250 printed on the two packaging bags P1 and P2 relating to the drug package dividing processing. As illustrated in FIG. 20(*a*) and FIG. 20(*b*) for comparison, the packaging bags P1 and P2 on which the divided drug package identification line 250 is printed are easier to visually recognize as being a series of drug packages than the packaging bag P on which only character strings (1/2 and 1/2) of the division numbers are printed.

In this manner, the drug packaging device 10 is configured to allow the user to intuitively recognize the packaging bags P1 and P2 as relating to the divided drug package by printing the divided drug package identification line 250 when the drug package dividing processing is performed. This allows an elderly patient or other such patient to relatively easily recognize a series of packaging bags P as relating to the divided drug package.

The example illustrated in FIG. 20(*b*) is an example in which the divided drug package identification line 250 is employed as the divided drug package identification information, but the present invention is not limited thereto. Specifically, as illustrated in FIG. 20(*c*) or FIG. 20(*d*), characters, a pattern, or other such identification information continuously printed across a plurality of packaging bags may be set as the divided drug package identification information. The divided drug package identification information including the divided drug package identification line 250 does not need to be printed over the entire drug package in the width direction as illustrated in FIG. 20(*b*), and may be printed in a boundary part between the drug packages across the continuous packaging bags as illustrated in FIG. 20(*e*), for example.

Figure 21A:
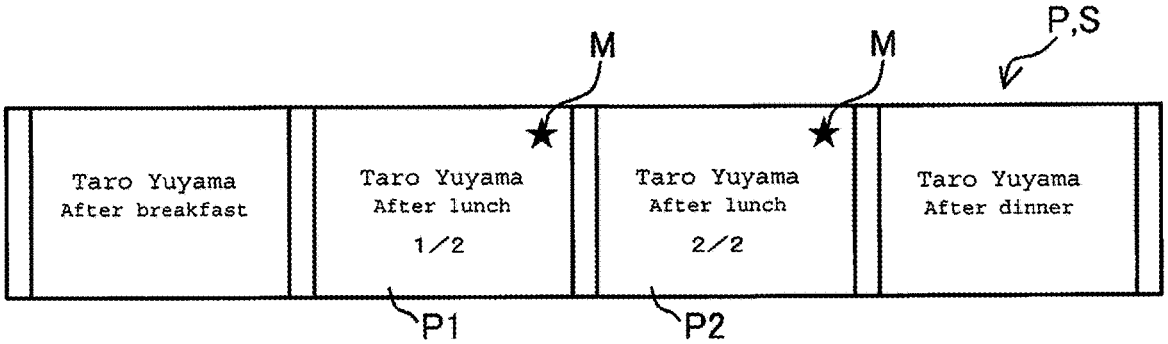
FIG. 21(*a*) and FIG. 21(*b*) are each an illustration of an example of printing divided drug package identification information on the packaging bags relating to the divided drug package.
Figure 21B:
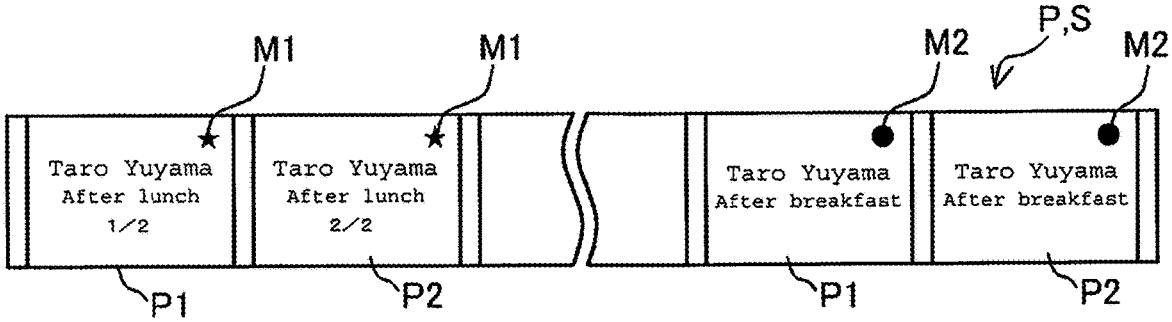

The example illustrated in FIG. 20 is an example in which the divided drug package identification line 250 or other such divided drug package identification information is provided across (so as to cover) the plurality of packaging bags formed by the drug package dividing processing, but the present invention is not limited thereto. Specifically, a character, a symbol, or other such information indicating that the packaging bag is one of the packaging bags relating to the drug package dividing processing may be printed, on each of the plurality of packaging bags formed by the drug package dividing processing. Specifically, divided drug package identification information M illustrated in FIG. 21(*a*) or other such symbol or character may be printed. With such a configuration, it is also possible to relatively easily recognize a series of packaging bags P as relating to the divided drug package.

Further, the above-mentioned divided drug package identification information can be printed in black or other such achromatic color, but can be printed in a chromatic color with further improved visibility or identity. When it is necessary to identify whether or not the divided drug package identification information is provided through image analysis as in a case of using an inspection device configured to automatically or semiautomatically perform inspection based on an image obtained by photographing the packaging bag in which the drug is packaged, it is possible to further improve identification precision and identification speed by printing the divided drug package identification information in a chromatic color.

Specifically, when the divided drug package identification information is printed by a chromatic color on the plurality of packaging bags formed by the drug package dividing processing, in the above-mentioned image analysis, discrimination between the divided drug package identification information and the drug, a foreign matter, or the like other than the divided drug package identification information can be performed in terms of three elements of lightness, saturation, and hue with ease and high precision. Therefore, by printing the divided drug package identification information in a chromatic color, it is possible to improve the precision and speed of the image analysis performed by the inspection device.

When the drug package dividing processing is performed a plurality of times, a plurality of packaging bag groups each formed of a plurality of packaging bags are formed. In such a case, in order to enable the identification of the packaging bag group, it is desired to cause a color, a shape, contents, or the like of the divided drug package identification information to differ for each of the packaging bag groups. Specifically, for example, it is desired to print the divided drug package identification information that differs for each packaging group, for example, divided drug package identification information pieces M1 and M2 illustrated in FIG. 21(*b*). With this configuration, it is possible to clearly distinguish between packaging bag groups, and to prevent a problem of, for example, erroneous administration of the drugs within the packaging bags that form different packaging groups.

The drug packaging device 10 is also preferred to execute the above-mentioned drug dividing processing when prescribed, drugs are defined to cause a change in property when drugs to be administered simultaneously are contained together in a single packaging bag P. In a case where powdered drugs are to be packaged, a combination of drugs prescribed as one dosage may possibly cause a change in property (incompatibility) of the drugs, for example, change of color, change in quality, or reduction in efficacy, when contained together in a single packaging bag P. Specifically, when, for example, an alkaline drug and an acid drug are prescribed as the drugs to be packaged, there is a fear that incompatibility may occur. Therefore, it is preferred to execute the above-mentioned drug dividing processing to change a method of processing the prescription for separate packaging, and to prevent the drugs feared to exhibit incompatibility from being packaged in the same package.

Even in such a case where the drug package dividing processing is executed due to the incompatibility and a plurality of types of drugs to be administered simultaneously are packaged into a plurality of packaging bags, when the divided drug package identification line 250 or the like is provided as the divided drug package identification information, it is possible for the patient or the like to easily recognize those packaging bags P. With this configuration, it is expected to prevent the patient from forgetting to take the drugs to be administered simultaneously.

<<Regarding Composite Image Forming Processing>>

Figure 22:
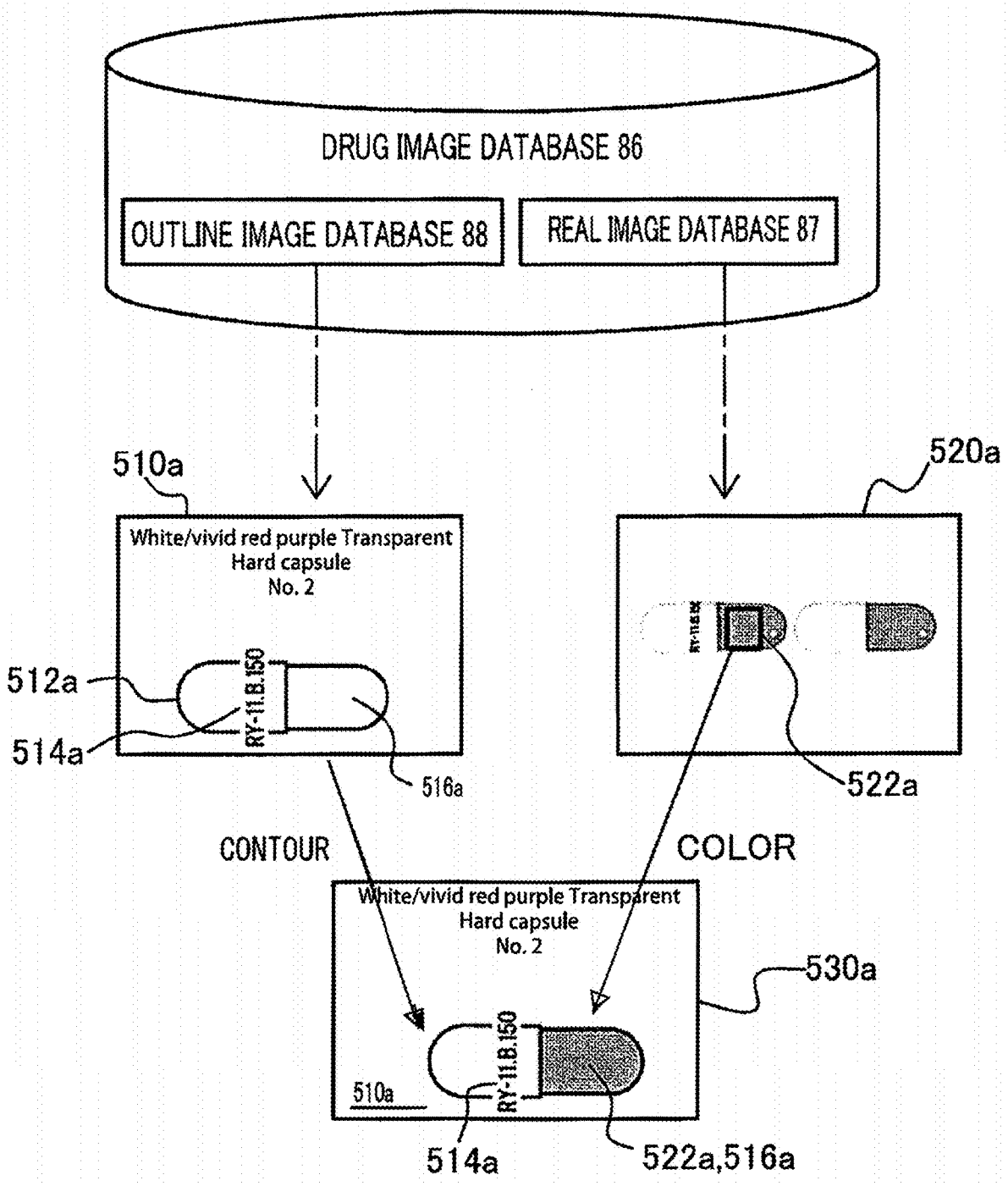
FIG. 22 is an illustration of a concept of processing for forming a composite image when an image to be printed is set as the composite image.

Next, composite image forming processing performed by the drug packaging device 10 according to the present invention is described with reference to FIG. 22 and FIG. 23. The drug packaging device 10 is capable of selecting a predetermined image from the drug image database 86 to form a composite image 530, and setting the composite image 530 as a subject to be printed on the packaging paper S. The composite image forming processing is specifically described below.

As described above, the drug image database 86 is obtained by collecting images for illustrating external appearances of drugs as a database. The drug image database 86 includes a real image database 87 and an outline image database 88.

The real image database 87 is obtained by collecting real images 520, each of which is a photographic image of an external appearance of a drug, as a database. The real image 520 is such an image as to allow an appearance color of the drug to be distinguishable.

The outline image database 88 is obtained by collecting outline images 510, each of which is obtained by reproducing the external appearance of the drug by a contour line or the like, as a database. The outline image 510 includes not only a contour line 512 for reproducing the external appearance of the drug by a contour line but also identification code information 514 for reproducing information relating to printed characters or an inscription provided to the drug as characters or a line drawing.

In the composite image forming processing, the outline image 510 and the real image 520 relating to the drug to be packaged are first selected from the outline image database 88 and the real image database 87, respectively. Subsequently, the composite image 530 is formed by causing a color of an area. 516 within the contour line 512 of the selected outline image 510 to match a color of an area within the real image 520 corresponding to the area 516.

Next, a specific example of the composite image forming processing is described with reference to the accompanying drawings. FIG. 22 is an illustration of a concept of formation of a composite image 530*a* obtained by executing the composite image forming processing for a drug being a capsule. In regard to the composite image 530*a*, first, an outline image 510*a* and a real image 520*a* of the drug to be packaged are first selected from the outline image database 88 and the real image database 87, respectively. Subsequently, as a color of an area 516*a* included in a contour line 512*a* of the outline image 510*a*, an appearance color 522*a* being a color of an area corresponding to the area 516*a* within the real image 520*a* is extracted. Then, the appearance color 522*a* is arranged in the area 516*a* within the outline image 510*a* to form the composite image 530*a*.

When the drug is a capsule, in the real image 520*a*, printed characters provided to the external appearance of the drug are partially missing on a side surface of the drug, and those printed characters cannot, be fully confirmed. Meanwhile, in the outline image 510*a*, the characters provided to the external appearance of the drug are reproduced, as the identification code information 514 by the character information, and can be visually recognized entirely as the character information. In the composite image 530*a*, the appearance color 522*a* is arranged in addition to those pieces of identification code information 514, to thereby achieve a composite image that is easy to view and realistic.

Figure 23:
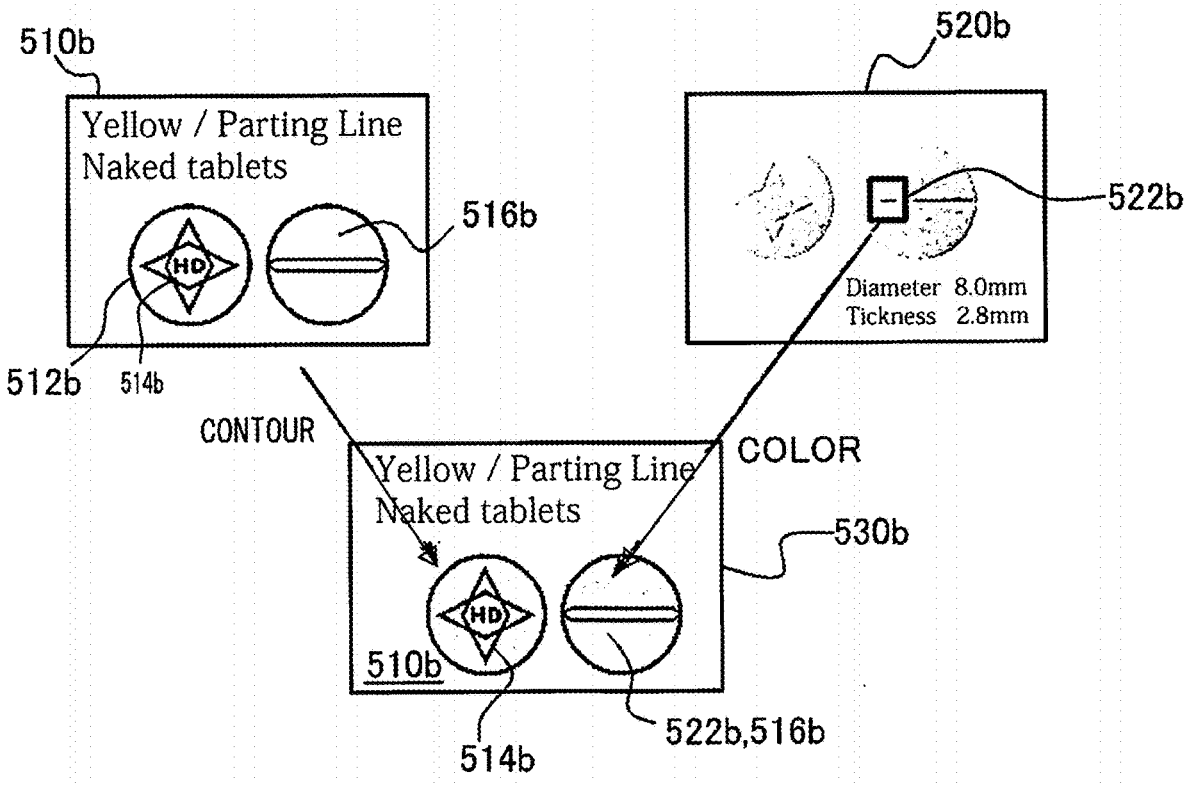
FIG. 23 is an illustration of a concept of composite image formation performed when a drug is an uncoated tablet.

FIG. 23 is an illustration of a concept of the composite image forming processing for a composite image 530*b* performed when the drug is an uncoated tablet. When a real image 520*b* is printed on the packaging paper S, an inscription provided to an external appearance of an uncoated tablet is reproduced as a photographic image, and hence it is difficult to identify contents of the inscription due to the contrast of shadows on the drug. Meanwhile, in the composite image 530*b* obtained through composition with an outline image 510*b*, the inscription expressed as a line drawing is clearly reproduced by identification code information 514*b*.

In this manner, the composite image 530 is set as an image to be printed, to thereby reproduce the appearance color, the contour, the identification code, and the like of the drug on the packaging paper S realistically. As a result, innovative improvement is expected for the inspection based on visual observation. As the image of the drug to be printed, any one of the real image 520 and the outline image 510 may be used instead of use of the composite image 530.

<<Switching of Conveyance Speed of Packaging Paper Sheet for Preventing Poor Drying of Ink>>

The drug packaging device 10 includes the printing unit 60 being a so-called ink-jet printer. Therefore, it is conceivable to require much time until ink dries in a case where, for example, an image to be printed or the like requires a large amount of ink when being printed. There is also a fear that various failures may be caused by sending the packaging paper to the subsequent stage in a state of poor drying in which the ink has not sufficiently dried. In order to inhibit an occurrence of a failure due to the poor drying of ink, the drug packaging device 10 is preferred to, for example, change a conveyance speed of the packaging paper S depending on the ink usage amount so that the ink dries after the printing is performed by the printing unit 60 before the subsequent stage is reached. Specifically, in a case of an image involving a fear that the packaging paper may reach the subsequent stage of the printing in the state of poor drying when the packaging paper S is conveyed at a normal conveyance speed, it is possible to switch the conveyance speed of the packaging paper S so as to lower the conveyance speed of the packaging paper.

It is determined whether or not the poor drying of ink is feared by determining whether or not the number of pixels of a predetermined image to be printed on the packaging paper S exceeds a predetermined threshold value.

In the drug packaging device 10 according to this embodiment, in regard to presence or absence of a fear of the poor drying of ink, a predetermined print image is first read as a predetermined bitmap file, and lightness and the number of pixels of the bitmap file are calculated as a histogram. When the number of pixels is equal to or larger than a freely-set threshold value at any one of lightness values in the calculated histogram, it is determined that a large amount of the same color is used to exhibit printed contents, and the poor drying of ink may thus be caused with high probability. When it is determined that the printed contents may cause the poor drying of ink with high probability, the printing control unit 84 performs control so as to lower the conveyance speed of the packaging paper S.

Figure 24:
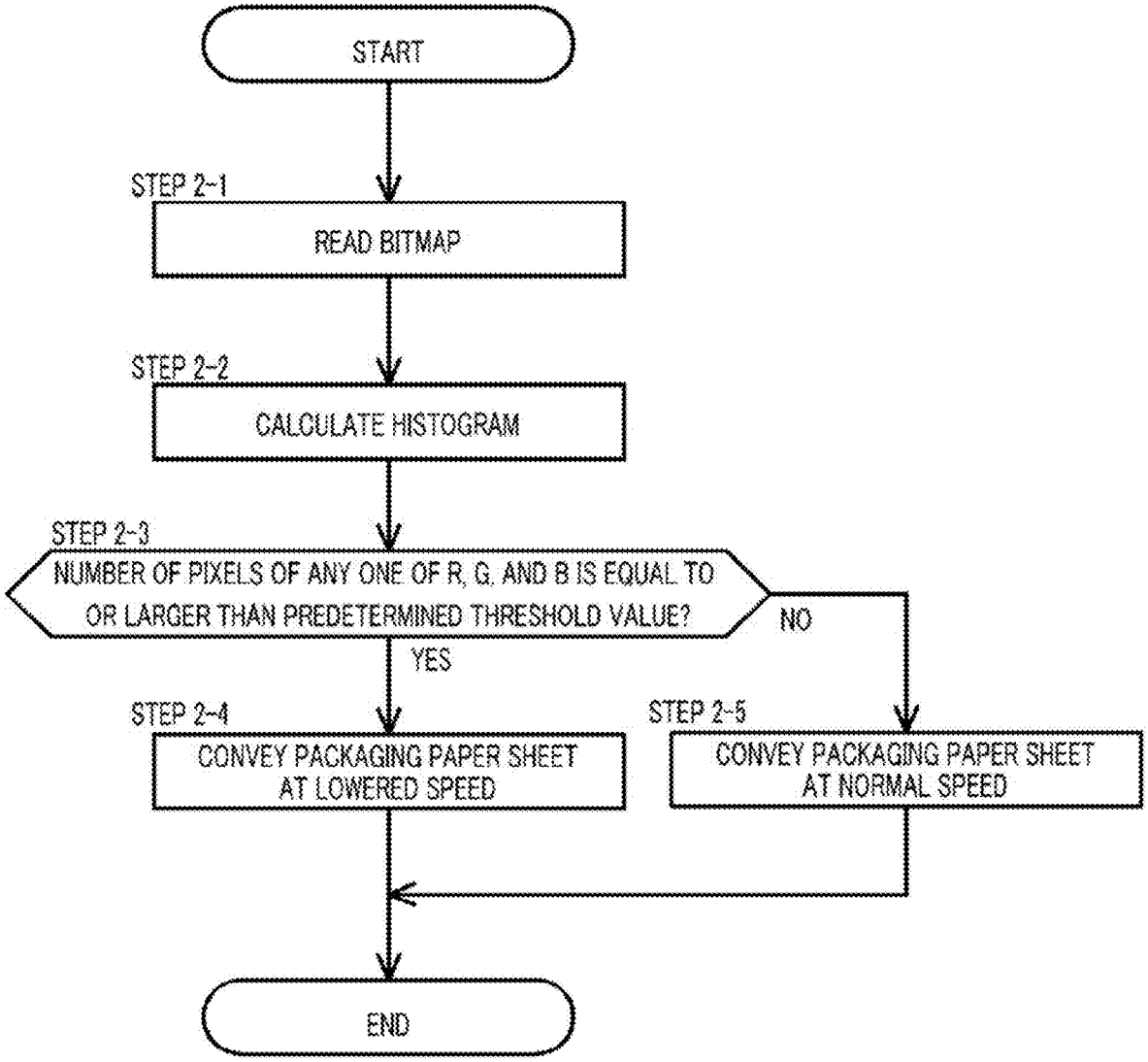
FIG. 24 is a flowchart of a procedure for switching a conveyance speed of the packaging paper.

The switching of the conveyance speed of the packaging paper S performed by the drug packaging device 10 is specifically described below with reference to the flowchart of FIG. 24.

(Step 2-1)

First, in Step 2-1, a predetermined image selected as the subject to be printed on the packaging paper S is read as a bitmap file. After that, the control flow is advanced to Step 2-2.

(Step 2-2)

Subsequently, in regard to the bitmap file read in Step 2-1, the number of pixels exhibiting each lightness within the bitmap file is calculated as a histogram. After that, the control flow is advanced to Step 2-3.

(Step 2-3)

It is evaluated whether or not the number of pixels exceeds a predetermined threshold value at any one of lightness values in the histogram calculated in Step 2-2. When it is evaluated that the number of pixels exceeds the threshold value at any one of the lightness values, it is determined that a large amount of the same color is used to exhibit a print image that may cause the poor drying of ink with high probability, and the control flow is advanced to Step 2-4. Meanwhile, when it is evaluated that the number of pixels is smaller than the threshold value at all the lightness values, it is determined that the poor drying of ink may be caused with low probability, and the control flow is advanced, to Step 2-5.

(Step 2-4)

In Step 2-4, the control is performed so as to convey the packaging paper S at a lowered conveyance speed, and the series of control flow is completed.

(Step 2-5)

In Step 2-5, the control is performed so as to set the conveyance speed of the packaging paper S to a normal conveyance speed, and the series of control flow is completed.

Figure 25A:
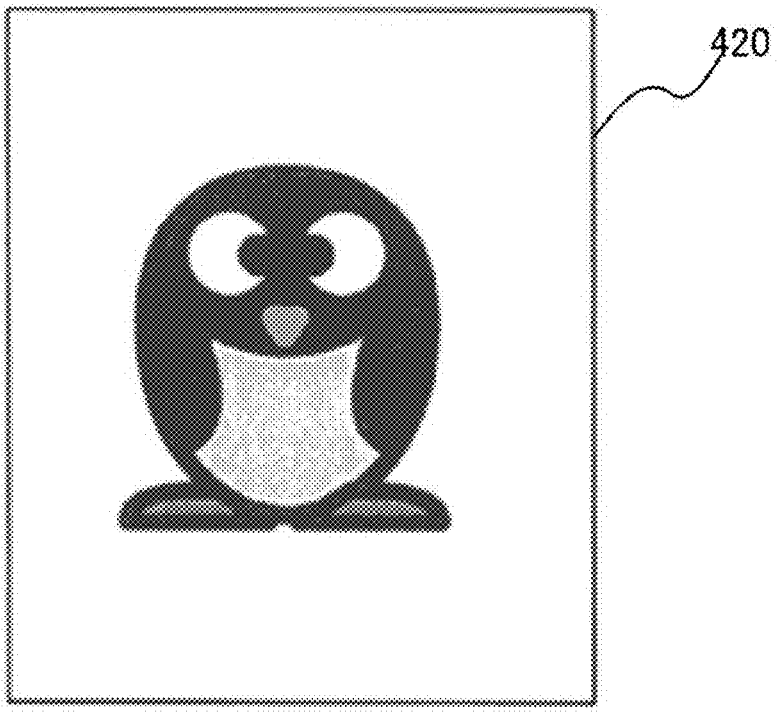
FIG. 25(*a*) is an illustration of a bitmap image picture in an entire printing area, and FIG. 25(*b*) is a graph obtained, by calculating lightness and the number of pixels of a bitmap image as a histogram.
Figure 25B:
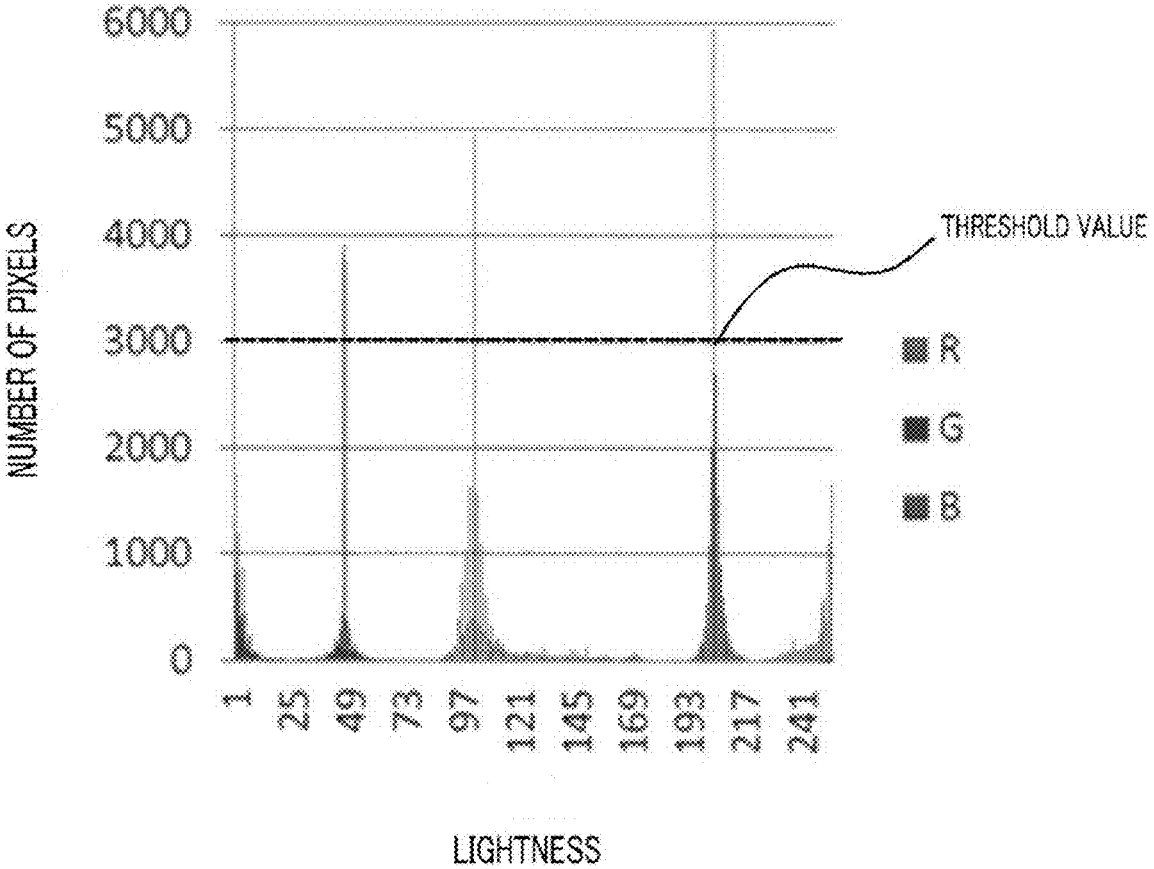

In FIG. 25, an image to be printed on the packaging paper S and a calculated histogram are shown. FIG. 25(*a*) is an illustration of a bitmap image 420 obtained by expressing the image to be printed as a bitmap, and FIG. 25(*b*) is a graph for showing a histogram calculated with the horizontal axis representing a lightness value of the bitmap image 420 and the vertical axis representing the number of pixels corresponding to the lightness value.

Figure 26A:
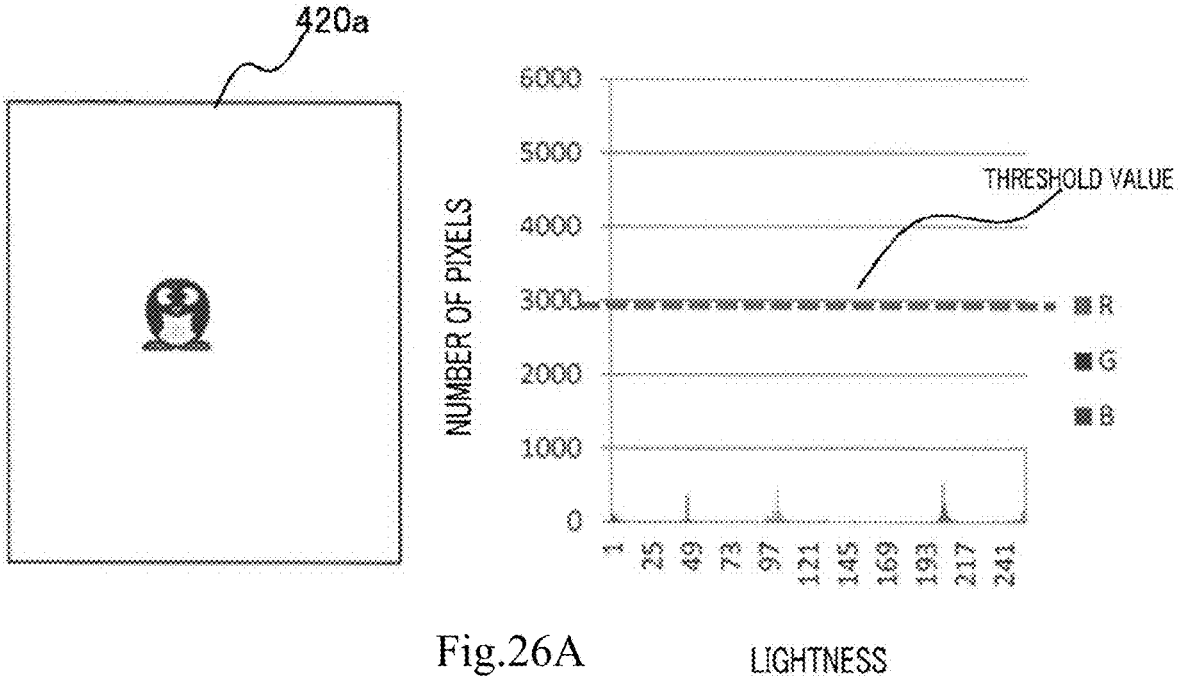
Figure 26B:
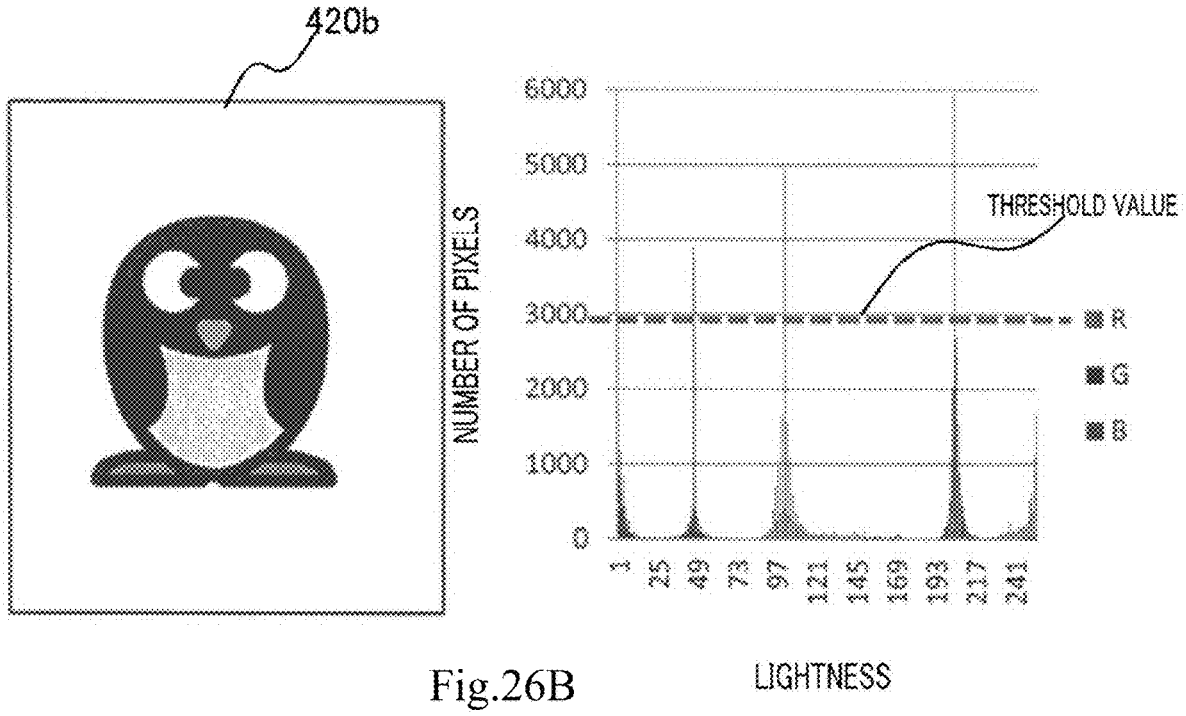

In FIG. 26, an image having a small, number of solid parts and an image having a large number of solid parts are illustrated with their respective histograms in comparison with each other. In a bitmap image 420*a* illustrated in FIG. 26(*a*), there are a small number of solid, areas with respect to the entire image to be printed, and a value exceeding the threshold value does not exist, at any one of the lightness values. In this case, it is determined that a large amount of the same color is not used, and hence the poor drying of ink may be caused with low probability, with the result that the packaging paper S is conveyed at a normal speed.

Meanwhile, in a bitmap image 420*b* illustrated in FIG. 26(*b*), a large number of solid areas exist with respect to the entire image to be printed, and there exist lightness values at each of which the number of pixels exceeds the threshold value. In this case, it is determined that a large amount of the same color is used in the image to be printed, and hence the poor drying of ink may be caused, with high probability, with the result that the packaging paper S is conveyed at a lowered, speed.

In this manner, the drug packaging device 10 is configured to calculate the lightness and the number of pixels of the image to be printed as a histogram, and to extract the image to be printed in which the ink takes time to dry and becomes sticky with high probability, based on whether or not the number of pixels is equal to or larger than a predetermined threshold value, to thereby be able to switch the conveyance speed of the packaging paper S. With this configuration, it is possible to change a printing speed depending on the contents of the image to be printed. As a result, when those images are printed, it is possible to suppress the poor drying of ink by creating a time period that allows the print to dry, and to achieve an efficient operation.

The above-mentioned threshold value can be set at will by the user. In another case, a threshold value that, differs for each color may be set. The image to be printed, which is read, as the predetermined bitmap file, may be set as a predetermined area within the packaging paper S corresponding to one package, or the entire packaging paper S corresponding to one package may be read as the bitmap file.

This embodiment is described by taking am example in which lightness information of HSL information on the image to be printed is used as an index to estimate the probability that the poor drying of ink may be caused, and adjust the conveyance speed of the packaging paper S, but the present invention is not limited thereto. Specifically, hue and saturation, which are the other components of the HSL information on the image to be printed, may be used as the index for estimating the probability that the poor drying of ink may be caused. Instead of the HSL information on the image to be printed, RGB information may be employed as the index for estimating the probability that the poor drying of ink may be caused, to thereby adjust the conveyance speed of the packaging paper S.

<<Regarding Printing of Drug Category Recognition Information>>

Next, a case of printing information for identifying a drug category on the packaging paper S is described. The drug packaging device 10 is capable of printing the information (drug category identification information) that enables recognition of a predetermined drug category on the packaging paper S on condition that a drug to be packaged belongs to a predetermined drug category.

The drug category is information defined by categorizing a drug based on an attribute of the drug, for example, a powerful drug, a poisonous drug, a narcotic drug, an antibiotic, an anticancer agent, a blood product, and a psychotropic drug. As the drug category, it is possible to use information accumulated in the drug database obtained by collecting information relating to the drug as a database. In the drug database, information relating to the drug category, that is, types of drug categories, a priority of each of those drug categories, and the like, are accumulated for each drug.

Figure 27A:
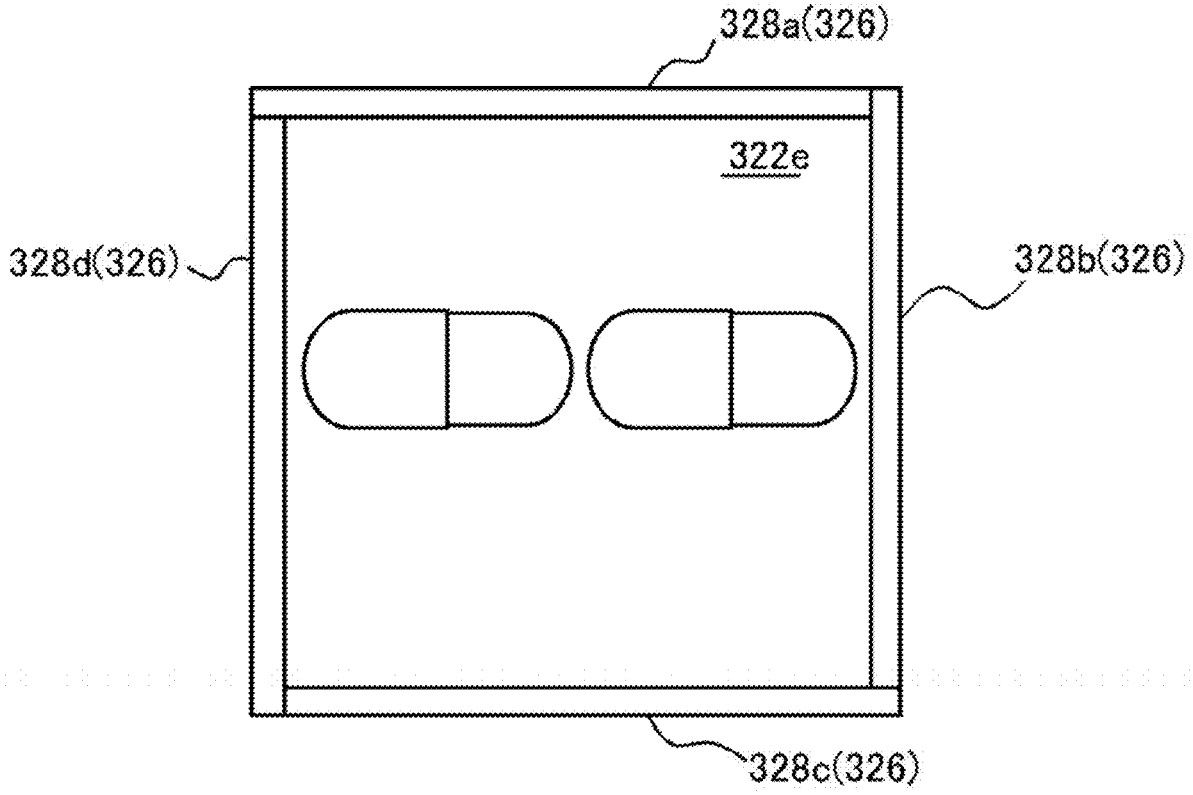
Figure 27B:
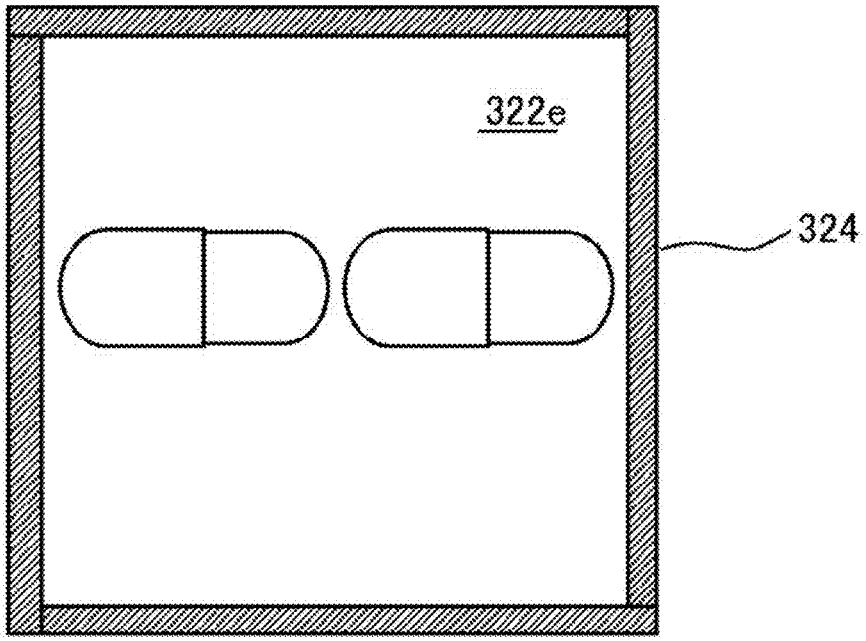

The information (drug category recognition information) for enabling the above-mentioned drug category to be recognized can be printed in a printing area 326 as illustrated in FIG. 27(*a*) and FIG. 27(*b*). Drug category recognition information 324 is printed in the printing area 326 to be visually recognizable.

The printing area 326 is provided as a rectangular frame line shape surrounding the image 322*e* of the drug. As illustrated in FIG. 27(*a*), the printing area 326 includes four printing segments in which the drug category recognition information 324 can be printed. That is, the printing area 326 includes four printing segments of a first printing segment 326*a*, a second printing segment 328*b*, a third printing segment 328*c*, and a fourth printing segment; 328*d* in a circumferential direction.

The drug category recognition information 324 is printed in the above-mentioned printing area 326. As illustrated in FIG. 27(*b*), the drug category recognition information 324 is printed on the packaging paper S so as to surround the image 322*e* of the drug. With this configuration, it is possible to intuitively recognize that the drug printed as the image 322*e* of the drug belongs to a predetermined drug category.

The drug category identification information 324 is also printed in a print color corresponding to the drug category, which is set in advance. With this configuration, it is possible to recognize the type of the drug category relating to the drug printed as the image 322*e* of the drug.

The print color corresponding to each of those drug categories may be set through an operation performed on the print format setting screen. 160 described above.

In the printing area 326, at most four different kinds of drug category identification information 324 can be printed in the above-mentioned four printing segments. That is, when one drug to be packaged belongs to a plurality of drug categories, those plurality of drug categories are respectively printed in the first printing segment 328*a*, the second printing segment 328*b*, the third printing segment 328*c*, and the fourth printing segment 328*d* in set colors corresponding to the drug categories.

Next, a method of printing the drug category recognition, information 324 based, on the priority of the drug category is described. As described above, the priority is set for the drug category based on the type in advance. When one drug to be packaged belongs to a plurality of drug categories, the drug packaging device 10 selects at most four kinds of drug categories having higher priorities of the drug categories. Those selected drug categories are printed in the printing area 326 in the print color corresponding to the drug category, which is set in advance, as the drug category recognition information 324.

When one drug to be packaged belongs to five or more drug categories, four drug categories are selected in descending order of the priority of the drug category. Four drug category identification information pieces 324*a*, 324*b*, 324*c*, and 324*d* corresponding to those four drug categories are printed, in the first printing segment 328*a*, the second printing segment 328*b*, the third printing segment 328*c*, and the fourth printing segment 328*d*, respectively, in their set print colors.

Figure 28A:
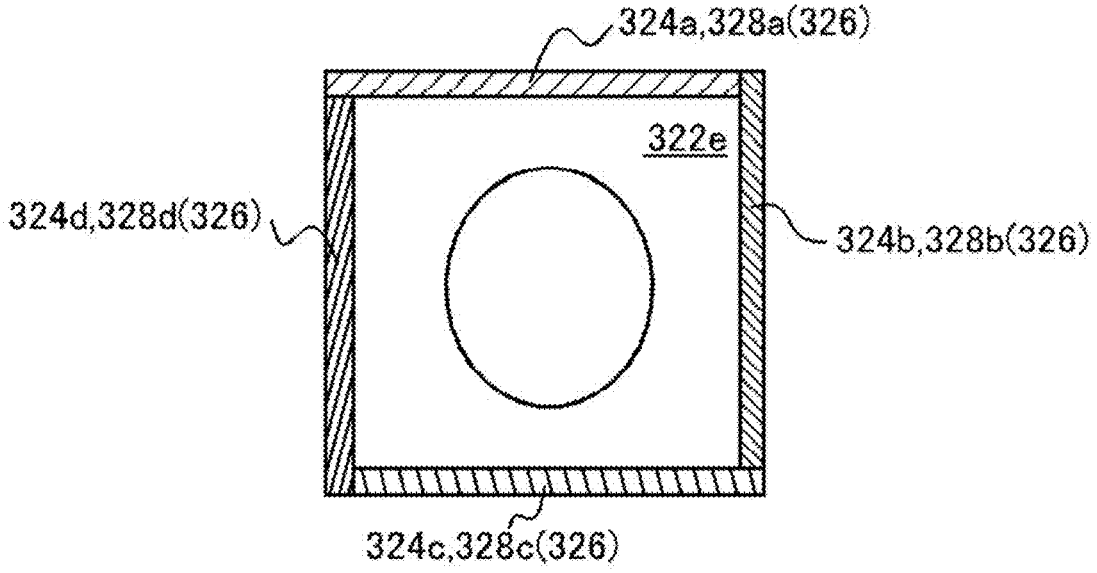
Figure 28B:
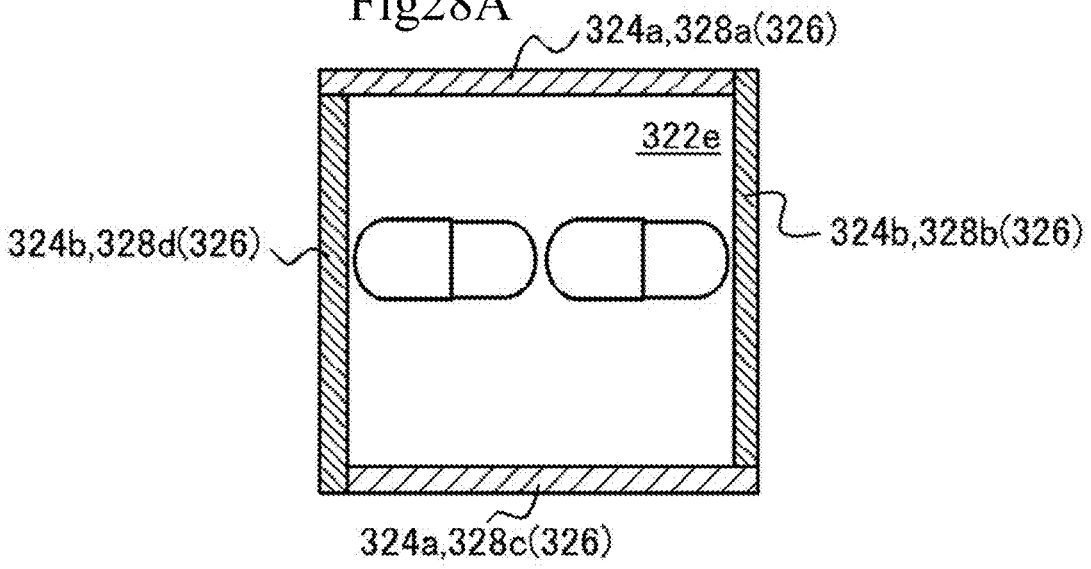
Figure 28C:
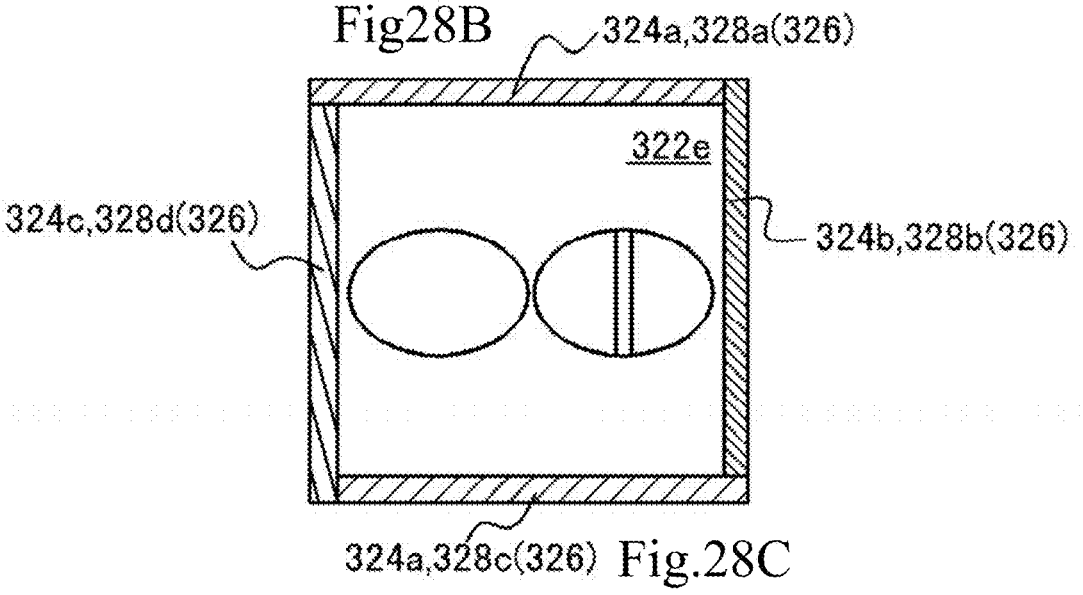

The printing of the drug category identification information 324 relating to the drug belonging to a plurality of drug categories is described with reference to the accompanying drawings. FIG. 28(*a*) is an example of printing the drug category recognition information 324 relating to the drug belonging to four drug categories. As illustrated in FIG. 28(*a*), the drug category identification information 324 is printed, as the drug category recognition information pieces 324*a*, 324*b*, 324*c*, and 324*d* in the print colors corresponding to the four drug categories. Those drug category recognition information pieces 324*a*, 324*b*, 324*c*, and 324*d* are printed in the first printing segment 328*a*, the second printing segment 328*b*, the third, printing segment 328*c*, and the fourth printing segment 328*d*. With this configuration, it is possible to identify four drug categories to which one drug belongs.

FIG. 28(*b*) is an example of printing the drug category recognition, information 324 when one drug to be packaged belongs to two drug categories. When the drug to be packaged belongs to two drug categories, the two drug category identification information pieces 324*a* and 324*b* are printed in the printing area 326. Specifically, the drug category identification information piece 324*a* is printed in the first printing segment 328*a* and the third printing segment 328*c*, and the drug category identification information piece 324*b* is printed in the second printing segment 328*b* and the fourth printing segment 328*d*. In this manner, the drug category identification information pieces 324*a* and 324*b* relating to the two drug categories are printed so as to surround the image 322*e* of the drug.

FIG. 28(*c*) is an example of printing the drug category recognition information 324 when one drug to be packaged belongs to three drug categories. The drug category identification information pieces 324*a*, 324*b*, and 324*c* relating to the three drug categories are printed, in the printing area 326. The drug categories relating to the drug category identification information pieces 324*a*, 324*b*, and 324*c* are selected to have a first priority, a second priority, and a third priority, respectively.

When the drug to be packaged belongs to three drug categories, the drug packaging device 10 selects the drug category identification information piece 324*a* relating to the drug category having the highest priority in two printing segments of the first printing segment 328*a* and the third, printing segment 328*c*. Then, the drug packaging device 10 prints the drug category identification information piece 324*b* relating to the drug category selected to have the second priority in the second printing segment 328*b*, and prints the drug category identification information piece 324*c* relating to the drug category selected to have the third priority in the fourth printing segment 328*d*. In this manner, the drug category recognition information 324 relating to the drug belonging to three drug categories is printed so as to surround the image 322*e* of the drug.

The drug packaging device 10 is thus capable of printing, in the printing area 326 partitioned into four, the drug category recognition information 324 that differs for each partition. With this configuration, when the drug to be packaged belongs to a plurality of drug categories, those drug categories can be recognized. This enables information relating to a plurality of drug categories to be visually recognized for the drug belonging to those drug categories, and enables cautions suitable for a plurality of drug categories to be issued to a person involved in use of the drug.

This embodiment is described by taking an example in which at most four kinds of drug category identification information 324 can be printed in the printing area 326, but five or more printing segments may be provided by setting the printing area 326 to have a circular or polygonal frame line shape.

<<Improvement of Print Gap at Stopping of Packaging>>

Next, improvement of a print gap expected when a packaging operation is stopped, in the drug packaging device 10 is described. The drug packaging device 10 performs a series of operations from the printing to the supply of the drug and the formation into the packaging bag P while conveying the packaging paper S. During this series of operations, in the packaging unit 30, the packaging paper S folded in two is sealed by the heater rollers 32 to be formed into the packaging bag P.

In this case, the drug packaging device 10 sometimes needs to temporarily stop the packaging operation due to waiting for work of manually distributing a drug, stockout of the drug, or the like during the above-mentioned series of operations from the printing on the packaging paper S to the formation of the packaging bag P. The drug packaging device 10 is controlled so as to stop a printing operation and a conveying operation for the packaging paper S when the packaging operation is stopped.

When the packaging operation and the printing operation for the packaging paper S are stopped, the packaging paper S is shrunk little by little at a position in contact with the heater rollers 32 due to an influence of heat of the heater rollers 32. Then, the packaging paper S positioned adjacent to the printing unit 60 is pulled toward the packaging unit 30. When the printing operation is restarted after a predetermined time period has elapsed with the packaging paper S being pulled toward the packaging unit 30, a gap of printing, that is, a gap (print gap) having a fixed width, in which the printing is not performed in the printing area, occurs between a part printed immediately before the printing is stopped and a part in which the printing is restarted in the printing area due to the shrink of the packaging paper S (see FIG. 31).

As the subject to be printed on the packaging paper S, a two-dimensional bar code or other such optical identification information is assumed to be selected. When the optical identification information is printed on the packaging paper S, the above-mentioned gap of printing ascribable to the shrink of the packaging paper S is preferred to be suppressed to such an extent that allows a bar code reader or other such reading device to read the information. In order to achieve such an object, the drug packaging device 10 is desired to be capable of executing printing control for suppressing the gap of printing ascribable to the shrink of the packaging paper S to such an extent that prevents trouble in reading the optical identification information and allows the reading.

In order to achieve the above-mentioned object, the printing (interim printing) on the packaging paper S may be executed by a minute length with respect to a total length of the packaging bag at a predetermined timing during an interim after the stopping of the packaging operation until its restart. With this configuration, it is possible to print a readable two-dimensional bar code even when the packaging operation is stopped during the printing of the two-dimensional bar code to cause a print gap in the two-dimensional bar code. A flow of the interim printing performed by the drug packaging device 10 is specifically described below.

Figure 30:
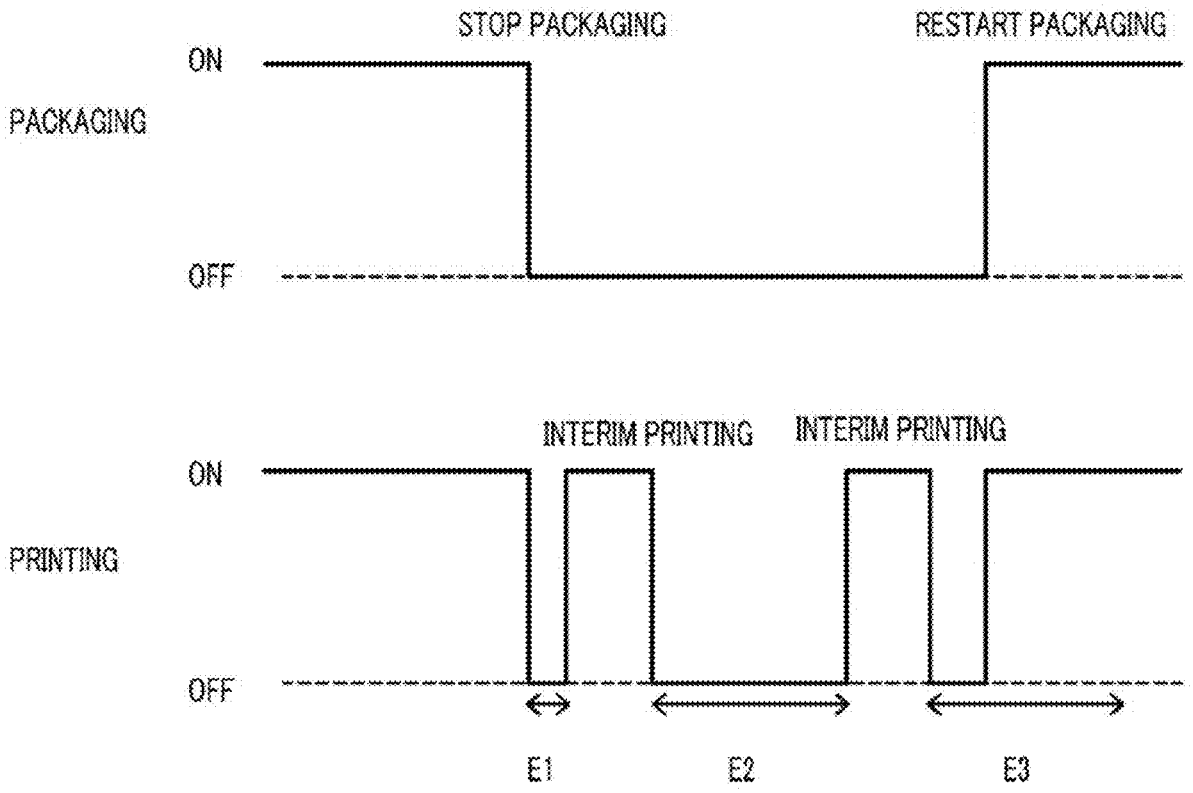
FIG. 30 is a timing chart for illustrating a case of executing the interim printing by the procedure of FIG. 29.

In the drug packaging device 10, as illustrated in the timing chart of FIG. 30, the interim printing is executed two times at predetermined timings during a period after the stopping of the packaging operation until its restart. In the drug packaging device 10, when the packaging operation is temporarily stopped, the printing operation is also temporarily stopped, and first interim printing is started at a timing at which a time period E1 has elapsed since the stopping of the packaging operation.

In the interim printing, the printing on the packaging paper S by a distance V (predetermined distance) is executed. When the packaging operation has not been restarted (the packaging is being stopped) at a timing at which a predetermined time period E2 has elapsed since completion of execution of the first interim printing, second interim printing is executed. In addition, when the packaging is being stopped at a timing at which a time period E3 has elapsed since completion of execution of the second interim printing, the packaging bag P to be formed from the packaging paper S subjected to the interim printing is formed as an empty package to which no drug is to be supplied.

Figure 31A:
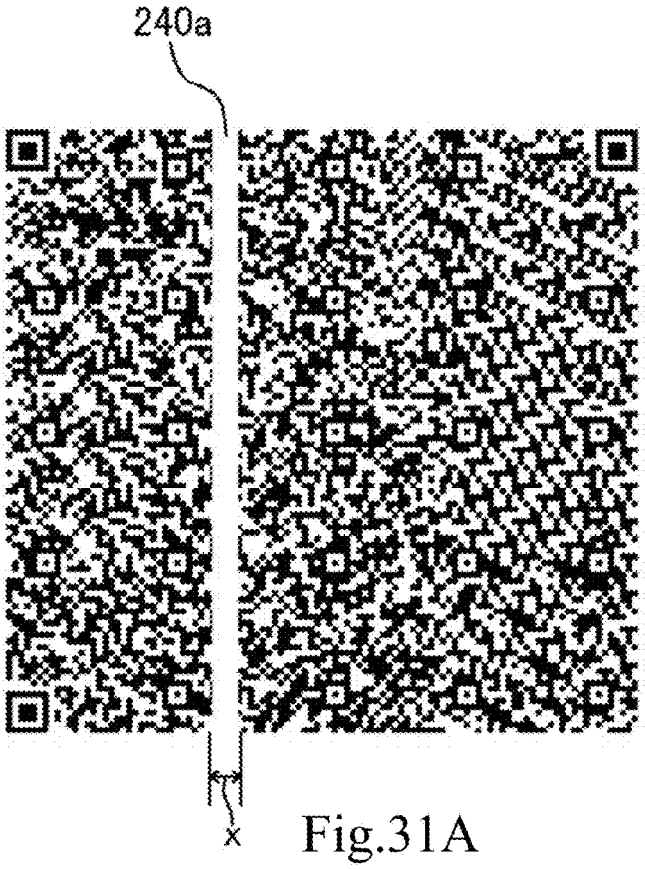
FIG. 31 are illustrations for comparison regarding a width of a print gap caused depending on presence or absence of the interim printing when a two-dimensional bar code is printed on the packaging paper.
Figure 31B:
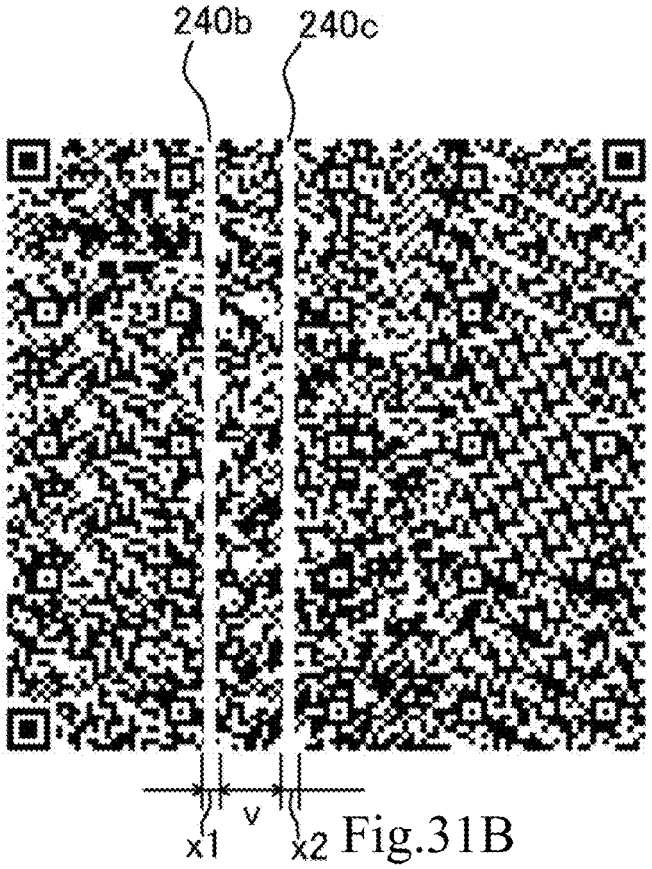

The above-mentioned time periods E1 and E2 can be set appropriately, but in the case of printing the two-dimensional bar code or other such optical identification information as illustrated in FIG. 31, it is possible to set the time periods E1 and E2 in consideration of reading precision for the optical identification information. Specifically, in a case where the optical identification information cannot be read when a gap having a width equal to or larger than a width x is formed as in a print gap 240*a* illustrated in FIG. 31(*a*), it is possible to set the time periods E1 and E2 by using, as an index, a time period expected to require for forming the print gap corresponding to the width x. In this embodiment, the time period E1 is set to 1 minute. Compared with a shrink amount of the packaging paper exhibited during the time period E1 after the stopping of the packaging operation until the first interim printing, a shrink amount of the packaging paper exhibited during the time period E2 until the next interim printing or the time period E3 is assumed, to be small on the ground that, for example, the neat of the heater rollers 32 is taken by forming the packaging bag along with the interim printing after the time period E1 has elapsed. When such a phenomenon is assumed, it is also possible to set the time period E2 or the time period E3 longer than the time period E1. In this embodiment, the time period E2 and the time period E3 are each set to 10 minutes based on the above-mentioned findings. The time periods E1 to E3 can be set appropriately in consideration of the above-mentioned phenomenon or other such phenomenon. The width (distance V) for performing the interim printing can also be set appropriately. In this embodiment; the distance V is set to 3 mm to 4 mm.

Figure 29:
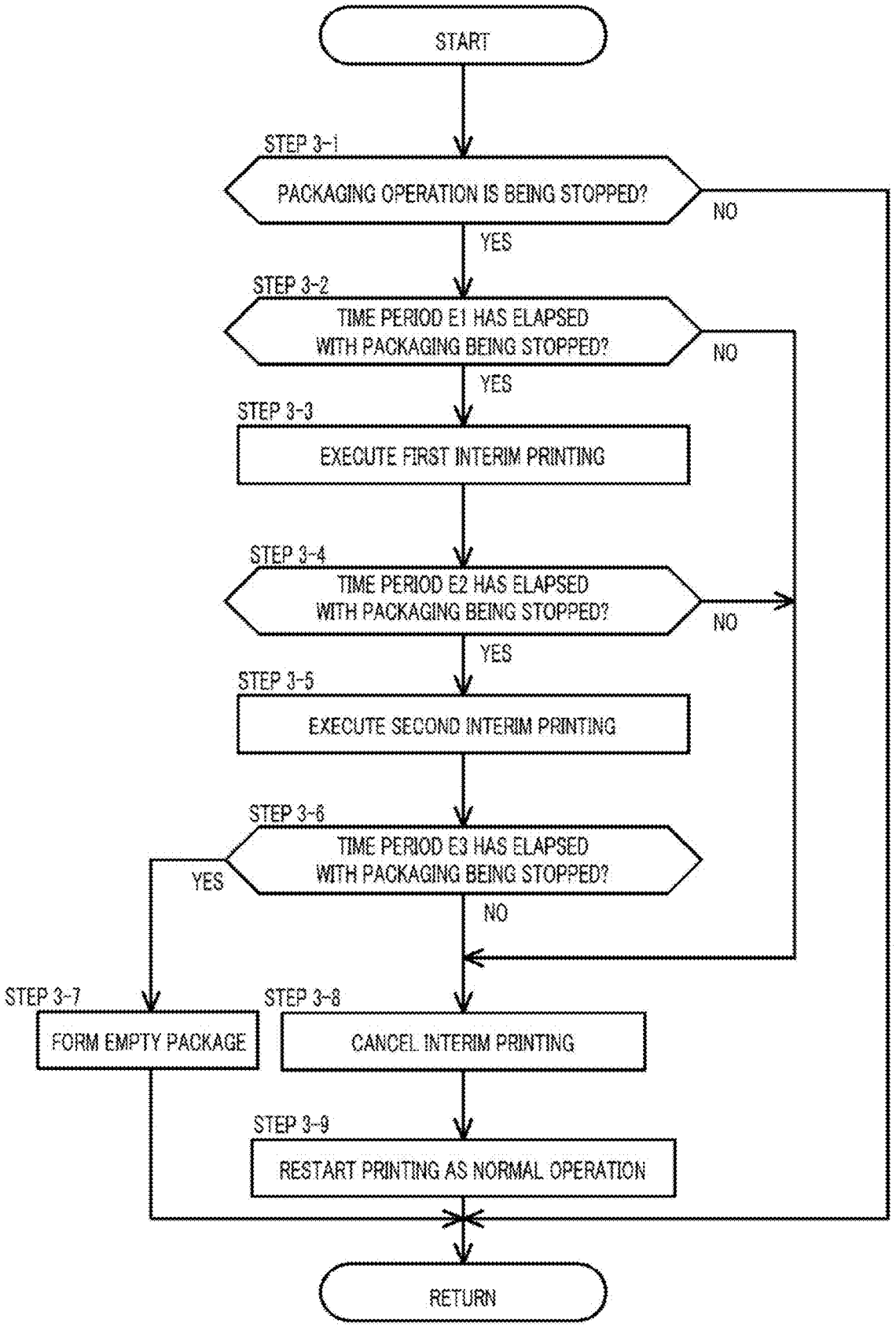
FIG. 29 is a flowchart for illustrating a procedure for causing the drug packaging device of FIG. 1 to execute interim printing.

The interim printing is described below in detail with reference to the accompanying drawing. FIG. 29 is a flowchart for illustrating a procedure for executing the interim printing. The interim printing is described below with reference to the flowchart.

(Step 3-1)

First, in Step 3-1, it is determined whether or not the packaging operation is being stopped. When it is determined that the packaging operation is being stopped, the control flow is advanced to Step 3-2. Meanwhile, when it is determined that the packaging operation is not being stopped, the series of control flow is completed.

(Step 3-2)

In Step 3-2, it is examined whether or not a predetermined timing has been reached after the packaging is stopped. Specifically, in Step 3-2, it is determined whether or not the time period E1 has elapsed since the stopping of the packaging operation. When it is determined that the time period E1 has elapsed since the packaging operation is temporarily stopped, the control flow is advanced to Step 3-3. Meanwhile, when the packaging operation is started before the time period E1 has elapsed, the control flow is advanced to Step 3-8.

(Step 3-3)

In Step 3-3, the first interim printing is executed on the packaging paper S. In the interim printing, the printing is performed while the packaging paper S is conveyed by the distance V. When the first interim printing is completed, the control flow is advanced to Step 3-4.

(Step 3-4)

In Step 3-4, it is determined whether or not the time period E2 has elapsed with the packaging operation being stopped (with the packaging being stopped). When it is determined that the time period E2 has elapsed with the packaging being stopped since the completion of the first interim printing, the control flow is advanced to Step 3-5. Meanwhile, when the packaging operation is restarted after the completion of the first interim printing before the time period E2 has elapsed, the control flow is advanced to Step 3-8.

(Step 3-5)

In Step 3-5, the second interim printing is executed. When the second interim printing on the packaging paper S is completed, the control flow is advanced to Step 3-6.

(Step 3-6)

In Step 3-6, it is determined whether or not the time period E3 has elapsed with the packaging being stopped. When it is determined that the time period E3 has elapsed with the packaging being stopped since the completion of the second interim printing, the control flow is advanced to Step 3-7. Meanwhile, when the packaging operation is restarted after the completion of the second interim printing before the time period E2 has elapsed, the control flow is advanced to Step 3-8.

(Step 3-7)

In Step 3-7, the packaging paper S subjected to the execution of the first and second interim printing in the procedure from Step 3-1 to Step 3-6 is formed, as an empty package, and the series of control flow is completed.

(Step 3-8)

In Step 3-8, the interim printing is canceled. When the interim printing is canceled, the control flow is advanced to Step 3-9.

(Step 3-9)

In Step 3-9, the stopped state of the packaging operation is canceled, and a normal printing operation is started. That is, the printing of the subject to be printed is restarted from a time point at which, the second interim printing is completed. Then, the series of control flow is completed.

Next, widths of print gaps caused depending on presence or absence of the interim printing are described with reference to the accompanying drawings. FIG. 31(*a*) and FIG. 31(*b*) are diagrams of images for comparing the widths of the print gaps caused depending on the presence or absence of the execution of the interim printing in a case where the two-dimensional bar code is printed on the packaging paper S.

The print gap 240*a* illustrated in FIG. 31(*a*) is formed when the packaging operation and the printing are started after 10 minutes has elapsed since the stopping of the packaging operation without the execution of the interim printing.

Print gaps 240*b* and 240*c* illustrated in FIG. 31(*b*) are formed when the interim printing is executed. The print gaps 240*b* and 240*c* are formed when the interim printing is executed assuming that the time period E1 is 1 minute, the distance V is 3 mm to 4 mm, and the time period E2 and the time period E3 are each 10 minutes. Widths x1 and x2 of the print gaps 240*b* and 240*c*, respectively, are each smaller than the width x of the print gap 240*a* described above ($x1, x2<x$).

The two-dimensional bar code in which the print gap 240*a* is formed has the width x being large, and cannot be read by a predetermined optical reading apparatus. Meanwhile, the bar code can be read in a case of the two-dimensional bar code in which two or three relatively thin gaps, which are represented by the print gaps 240*b* and 240*c*, are formed. That is, the interim printing is carried out while the timing is adjusted so that the widths x1 and x2 of the print gaps 240*b* and 240*c* each become smaller than a size of a predetermined gap set with reading precision of the bar code reader being used as a reference.

Through the execution of the interim printing described above, it is possible to perform the printing with at most three thin gaps obtained, by dividing the print gap 240 as illustrated in FIG. 31 even when the packaging operation is stopped. With this configuration, even when the subject to be printed includes the two-dimensional bar code or other such optical identification information, the two-dimensional bar code or other such optical identification information can be printed as a readable image.

When the packaging operation is not restarted after the completion, of the interim printing before a predetermined timing, an empty package is formed as described above. With this configuration, it is possible to prevent the execution of the interim printing from being repeated more frequently than required, and to print a readable two-dimensional bar code while waiting for the packaging operation to start.

In regard to the above-mentioned interim printing, in this embodiment, the interim printing is executed at most two times during a predetermined period so as to obtain at most three print gaps 240, but the drug packaging device 10 according to the present invention, is not limited thereto.

That is, the interim printing may be set to be executed only one time or to be executed three or more times. Further, the above-mentioned embodiment is described by taking an example in which the time period E1 is set to 1 minute and the time period E2 and the time period E3 are each set to 10 minutes, but the time period E1, the time period E2, and the time period E3 are not limited thereto. That is, the time periods E1, E2, and E3 can be selected in various manners, for example, can be set based on the conveyance speed of the packaging paper, the temperature of the heater rotors 32, the property of the packaging paper S, or the like. In addition, the distance V can be set freely. The drug packaging device 10 according to this embodiment is described by taking an example in which both of the interim printing and the formation of an empty package can be executed, but only the interim printing may be able to be executed, or none of the interim printing and the formation of an empty package may be set.

An exemplary embodiment of the present invention has been described above, but various design changes can be made within the scope of the technical spirit of the present invention described in claims, and are all included in the present invention.

INDUSTRIAL APPLICABILITY

The present invention can be generally used for a drug packaging device configured to package and dispense a drug in a preferred manner.

REFERENCE SIGNS LIST

10 drug packaging device
20 drug supply unit
30 packaging unit
32 heater roller
33 drive motor
40 packaging paper conveying unit
42 roll setting unit
43 motor (braking unit)
46 first conveyance direction switching section
48 second conveyance direction switching section
50 conveying roller
52 intermediate portion
54 end portions
56 urging unit
60 printing unit
62 ink ejection unit
64 nozzle
66 linear nozzle array
80 prescription information input unit
82 color vision information input unit
84 printing control unit
86 drug image database
87 real image database
88 outline image database
250 divided drug package identification line (divided drug package identification information)
324 drug category identification information
326 printing area
328*a* first printing segment
328*b* second printing segment
328*c* third printing segment
328*d* fourth printing segment
510 outline image
522 appearance color (appearance color information)
530 composite image
S packaging paper
T conveyance path
T1 intersecting-direction conveyance section

The invention claimed is:

1. A drug packaging device, comprising:
a drug supply unit capable of supplying a drug on prescription;
a packaging unit configured to package the drug supplied from the drug supply unit;
a packaging paper conveying unit configured to convey a packaging paper toward the packaging unit along a predetermined conveyance path;
a conveyor roller configured to be brought into abutment against the packaging paper in the packaging paper conveying unit; and
a printing unit capable of printing predetermined information on the packaging paper, wherein:
the printing unit comprises an ink ejection unit capable of ejecting ink;
the conveyance path comprises:
an intersecting-direction conveyance section for conveying the packaging paper in a direction intersecting an ejection direction of the ink;
a first conveyance direction switching section for changing a conveyance direction of the packaging paper on upstream of the intersecting-direction conveyance section in the conveyance direction of the packaging paper; and
a second conveyance direction switching section for changing the conveyance direction of the packaging paper on downstream of the intersecting-direction conveyance section in the conveyance direction of the packaging paper;
the ink ejection unit is arranged at a position spaced apart upward from the intersecting-direction conveyance section by a predetermined distance; and
the conveyor roller is located downstream of the intersecting-direction conveyance section and arranged so as to have an axial direction extending along a direction intersecting the conveyance direction of the packaging paper, and has an intermediate portion and two end portions, an outer diameter of the intermediate portion in the axial direction being smaller than an outer diameter of the two end portions, the conveying roller being configured to be brought into abutment against the packaging paper passing through the conveyance path at both of the two end portions, but the conveying roller is configured to not be brought into contact with the packaging paper at the intermediate portion.

2. A drug packaging device according to claim 1, further comprising an urging unit configured to urge the packaging paper so as to cause a tensile force to exert on the packaging paper in the intersecting-direction conveyance section.

3. A drug packaging device according to claim 2, wherein the urging unit is located on upstream of the first conveyance direction switching section in the conveyance direction.

4. A drug packaging device according to claim 1, wherein the ink ejection unit comprises a linear nozzle array formed of a plurality of nozzles arranged in a direction intersecting the conveyance direction of the packaging paper used by the packaging paper conveying unit.

5. A drug packaging device according to claim 1, further comprising:

a prescription information input unit configured to receive input of prescription information;

a drug image database obtained by accumulating an image of a drug; and a printing control unit configured to control the printing unit, wherein the printing control unit is configured to:

select from the drug image database an image of a drug to be packaged based on the prescription information; and control the printing unit so as to print the selected image of the drug on the packaging paper.

6. A drug packaging device according to claim 1, further comprising:

a prescription information input unit configured to receive input of prescription information;

a color vision information input unit configured to receive input of color vision information relating to whether or not a patient has color vision deficiency; and a printing control unit configured to control the printing unit, wherein the printing control unit is configured to:

determine whether or not a drug to be packaged is prescribed for a patient having color vision deficiency based on the color vision information; and control the printing unit so as to perform printing on the packaging paper in a color other than a color that is difficult for the patient to identify when the drug to be packaged is prescribed for the patient having color vision deficiency.

7. A drug packaging device according to claim 1, further comprising:

a prescription information input unit configured to receive input of prescription information;

a ward information database obtained by accumulating ward information relating to a ward in a medical institution; and a printing control unit configured to control the printing unit, wherein the printing control unit is configured to:

identify the ward information relating to a patient for which a drug to be packaged has been prescribed based on the prescription information; and control the printing unit so as to cause print information to be printed in a ward information specific color, which is set in advance for each piece of ward information.

8. A drug packaging device according to claim 1, further comprising:

a prescription information input unit configured to receive input of prescription information;

a facility information database obtained by accumulating facility information relating to a facility; and a printing control unit configured to control the printing unit, wherein the printing control unit is configured to:

identify the facility information relating to a patient for which a drug to be packaged has been prescribed based on the prescription information; and control the printing unit so as to cause print information to be printed in a facility information specific color, which is set in advance for each piece of facility information.

9. A drug packaging device according to claim 1, further comprising:

a patient information database obtained by accumulating patient information relating to a patient;

a facility information database obtained by accumulating facility information relating to a facility;

a facility resident information database obtained by accumulating information relating to a facility resident; and a printing control unit configured to control the printing unit, wherein:

the patient information, the facility resident information, and the facility information are associated with one another; and the patient information relating to a patient for which a drug to be packaged has been prescribed or the facility resident information relating to the facility resident is identified based on prescription information, the facility information associated with the patient information or the facility resident information that has been identified is identified, and the printing unit is controlled so as to cause print information to be printed in a facility information specific color, which is set in advance for each piece of facility information.

10. A drug packaging device according to claim 1, wherein the drug packaging device is configured to enable selection of whether to print a print item in a color image or a monochrome image.

11. A drug packaging device according to claim 1, further comprising a printing control unit configured to control the printing unit, wherein the drug packaging device is capable of carrying out, under control of the printing control unit, outline printing for performing printing on the packaging paper so that a printing density of an area surrounded by a contour line is lower than a printing density of the contour line.

12. A drug packaging device according to claim 1, wherein the drug packaging device is capable of:

deriving a decrease tendency index indicating a decrease tendency of the ink based on a relationship between a remaining amount of the ink prepared in the printing unit and a quantity of packages; and deriving a number of packages allowed to be subjected to printing with the remaining ink based on the decrease tendency index on condition that the remaining amount of the ink has been reduced to a predetermined amount.

13. A drug packaging device according to claim 1, wherein the drug packaging device is configured to execute a maintenance operation for performing maintenance on the printing unit between printing performed on a last package formed last in preceding packaging processing and printing performed on a first package formed first in succeeding packaging processing.

14. A drug packaging device according to claim 1, wherein the drug packaging device is capable of carrying out a drying suppression operation for suppressing drying of the ink ejection unit after printing is performed on the packaging paper until the printing is performed next.

15. A drug packaging device according to claim 1, further comprising:

a roll setting unit configured to set a paper roll obtained by winding the packaging paper to have a roll shape so as to be capable of unwinding the packaging paper;

a braking unit configured to exert a braking force on the paper roll; and a braking control unit capable of controlling power applied to the braking unit in an analog manner.

16. A drug packaging device according to claim 15, wherein:

the roll setting unit is arranged on upstream of the printing unit in the conveyance direction of the packaging paper;

the packaging unit is arranged on downstream of the printing unit in the conveyance direction of the packaging paper; and the drug packaging device is configured to:

operate a drive unit provided in the packaging unit, to thereby be able to exert a conveyance force toward the conveyance direction on the packaging paper; and operate the braking unit in linkage with driving and stopping of the drive unit.

17. A drug packaging device according to claim 1, further comprising a printing control unit configured to control the printing unit, wherein the drug packaging device is capable of:

executing drug package dividing processing for packaging drugs to be administered simultaneously by dividing the drugs into a plurality of continuous packaging bags; and controlling the printing unit so as to print divided drug package identification information for identifying the plurality of packaging bags as relating to the drug package dividing processing on the plurality of packaging bags formed by the drug package dividing processing.

18. A drug packaging device according to claim 1, further comprising:

a prescription information input unit configured to receive input of prescription information; and a drug image database obtained by accumulating an image of a drug, wherein:

the drug image database comprises:

a real image database obtained by accumulating a real image of a drug so that a color of the real image is distinguishable; and an outline image database obtained by accumulating an outline image including a contour line of a drug; and the drug packaging device is capable of:

executing composite image forming processing for forming a composite image by selecting the real image and the outline image of a drug to be packaged from the real image database and the outline image database, and matching a color of one or a plurality of areas included in the selected outline image with a color of an area within the real image corresponding to the one or the plurality of areas; and printing the composite image formed by the composite image forming processing on the packaging paper.

19. A drug packaging device according to claim 1, wherein the drug packaging device is configured to lower a conveyance speed of a packaging bag on condition that a number of pixels exceeds a predetermined threshold value at any one of lightness values that form a lightness value histogram of an image to be printed.

20. A drug packaging device according to claim 1, further comprising:

a drug database obtained by accumulating information relating to a drug, the information including a drug category defined by categorizing a drug based on an attribute;

a drug image database obtained by accumulating an image of a drug; and a printing control unit configured to control the printing unit, wherein the printing control unit is configured to control, on condition that a drug to be packaged belongs to a predetermined drug category, the printing unit so as to print an image accumulated for the drug to be packaged in the drug image database by surrounding the image by drug category identification information for enabling recognition of the predetermined drug category.

21. A drug packaging device according to claim 1, further comprising a printing control unit configured to control the printing unit, wherein:

the printing control unit is configured to perform control for stopping a printing operation on condition that a packaging operation has been stopped; and the drug packaging device is configured to execute interim printing for performing printing after performing sheet feeding by a predetermined distance within a conveyance distance of the packaging paper corresponding to one package, one time or two or more times on condition that the packaging operation is not restarted after stopping of the packaging operation before a predetermined timing.

22. A drug packaging device according to claim 1, wherein the diameter of the intermediate portion is uniform along a length of the intermediate portion.

* * * * *